US011549733B2

(12) United States Patent
Hirokawa et al.

(10) Patent No.: US 11,549,733 B2
(45) Date of Patent: Jan. 10, 2023

(54) HEAT EXCHANGER AND HEAT PUMP DEVICE

(71) Applicant: DAIKIN INDUSTRIES, LTD., Osaka (JP)

(72) Inventors: Tomoki Hirokawa, Osaka (JP); Tooru Andou, Osaka (JP); Yoshiyuki Matsumoto, Osaka (JP); Hideyuki Kusaka, Osaka (JP); Hirokazu Fujino, Osaka (JP); Kouju Yamada, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/562,302

(22) Filed: Dec. 27, 2021

(65) Prior Publication Data

US 2022/0120481 A1 Apr. 21, 2022

Related U.S. Application Data

(63) Continuation of application No. PCT/JP2020/025553, filed on Jun. 29, 2020.

(30) Foreign Application Priority Data

Jun. 28, 2019 (JP) ..... JP2019-122166

(51) Int. Cl.

| | |
|---|---|
| ***F25B 41/42*** | (2021.01) |
| ***F25B 39/00*** | (2006.01) |
| ***F28F 9/02*** | (2006.01) |

(52) U.S. Cl.

CPC ..... *F25B 41/42* (2021.01); *F25B 39/00* (2013.01); *F28F 9/0268* (2013.01)

(58) Field of Classification Search

CPC ..... F25B 41/40; F25B 41/42; F25B 41/45; F25B 41/48; F25B 39/00; F25B 39/022;

(Continued)

(56) References Cited

U.S. PATENT DOCUMENTS

| | | | |
|---|---|---|---|
| 5,205,347 | A | 4/1993 | Hughes |
| 5,242,016 | A | 9/1993 | Voss et al. |

(Continued)

FOREIGN PATENT DOCUMENTS

| | | | |
|---|---|---|---|
| EP | 2998680 | A1 | 3/2016 |
| JP | H05-296606 | A | 11/1993 |

(Continued)

OTHER PUBLICATIONS

International Preliminary Report on Patentability issued in corresponding International Application No. PCT/JP2020/025553 dated Dec. 28, 2021 (8 pages).

(Continued)

*Primary Examiner* — Miguel A Diaz

(74) *Attorney, Agent, or Firm* — Osha Bergman Watanabe & Burton LLP

(57) ABSTRACT

A heat exchanger includes heat transfer tubes and a header that forms a refrigerant flow path. The header includes: a first member that includes a first plate-shaped portion; a second member that includes a second plate-shaped portion; a third member that includes a third plate-shaped portion positioned between the first plate-shaped portion and the second plate-shaped portion in a first direction that is a direction in which the first plate-shaped portion and the second plate-shaped portion are arranged; a fourth member that includes a fourth plate-shaped portion positioned between the first plate-shaped portion and the second plate-shaped portion in the first direction and a second opening that constitutes a part of the refrigerant flow path, where a second is along a longitudinal direction of the second opening; and a fifth member.

19 Claims, 32 Drawing Sheets

(58) Field of Classification Search
CPC ..... F25B 39/028; F28F 9/02; F28F 9/0221; F28F 9/026; F28F 9/0263; F28F 9/0265; F28F 9/0268; F28F 9/0278
See application file for complete search history.

(56) References Cited

U.S. PATENT DOCUMENTS

| | | | | |
|---|---|---|---|---|
| 2015/0300758 | A1 | 10/2015 | Hofmann et al. | |
| 2018/0087848 | A1 | 3/2018 | Ogata et al. | |
| 2018/0216858 | A1 | 8/2018 | Higashiiue et al. | |
| 2019/0093965 | A1 | 3/2019 | Higashiiue et al. | |
| 2020/0018528 | A1 | 1/2020 | Akaiwa et al. | |
| 2020/0072507 | A1 | 3/2020 | Higashiiue et al. | |
| 2020/0109902 | A1 | 4/2020 | Satou et al. | |
| 2021/0003353 | A1 | 1/2021 | Akaiwa et al. | |
| 2022/0155017 | A1 * | 5/2022 | Andou | F28F 9/0278 |

FOREIGN PATENT DOCUMENTS

| | | | | |
|---|---|---|---|---|
| JP | H06-011291 | A | 1/1994 | |
| JP | 2001-343195 | A | 12/2001 | |
| JP | 2009-041797 | A | 2/2009 | |
| JP | 2016-070622 | A | 5/2016 | |
| JP | 2016-145701 | A | 8/2016 | |
| JP | 2019-056543 | A | 4/2019 | |
| WO | WO-2015162678 | A1 * | 10/2015 | F28D 1/0476 |
| WO | 2017/042866 | A1 | 3/2017 | |
| WO | 2017/203566 | A1 | 11/2017 | |
| WO | 2018/078746 | A1 | 5/2018 | |
| WO | 2018/116413 | A1 | 6/2018 | |
| WO | WO-2019073610 | A1 * | 4/2019 | F25B 39/00 |
| WO | 2019/193713 | A1 | 10/2019 | |

OTHER PUBLICATIONS

International Search Report issued in corresponding International Application No. PCT/JP2020/025553 dated Sep. 8, 2020 (7 pages).
Decision to Grant a Patent issued in Japanese Patent Application No. 2020-111481 dated Dec. 1, 2020 (5 pages).
Notice of Reasons for Refusal issued in Japanese Patent Application No. 2020-111481 dated Sep. 1, 2020 (15 pages).
Extended European Search Report issued in European Application No. 20831706.5 dated Oct. 21, 2022 (12 pages).

* cited by examiner

HEAT EXCHANGER AND HEAT PUMP DEVICE

CROSS-REFERENCE TO RELATED APPLICATIONS

This is a continuation application of International Patent Application No. PCT/JP2020/025377, filed on Jun. 26, 2020, and claims priority to Japanese Patent Application No. 2019-122167, filed on Jun. 28, 2019. The content of these priority applications are incorporated herein by reference.

TECHNICAL FIELD

The present disclosure relates to a heat exchanger and a heat pump device.

BACKGROUND

Hitherto, as heat exchangers of air conditioners, those including a header to which a plurality of heat transfer tubes are connected have been available.

For example, Patent Literature 1 (Japanese Unexamined Patent Application Publication No. 2016-070622) proposes a circular cylindrical header including semi-circular members that abut upon each other.

PATENT LITERATURE

PTL 1: Japanese Laid Open Application No. 2016-070622

SUMMARY

A heat exchanger according to one or more embodiments includes a header that forms a refrigerant flow path, and the header includes a first member, a second member, and a third member. The first member includes a first plate-shaped portion. A plurality of heat transfer tubes are connected to the first plate-shaped portion. The second member includes a second plate-shaped portion. The third member includes a third plate-shaped portion. The third plate-shaped portion is positioned between the first plate-shaped portion and the second plate-shaped portion in a first direction that is a direction in which the first plate-shaped portion and the second plate-shaped portion are arranged. The third plate-shaped portion has a first opening that constitutes a part of the refrigerant flow path. The first opening extends in a second direction that is a direction in which the plurality of heat transfer tubes are arranged. The first opening includes a first region and a second region, and a third region that are arranged in order in the second direction. When a direction that is perpendicular to both of the first direction and the second direction is a third direction, a length of the second region in the third direction is shorter than a length of the first region in the third direction. The length of the second region in the third direction is shorter than a length of the third region in the third direction. The heat exchanger further comprises a fourth member that includes a fourth plate-shaped portion positioned between the first plate-shaped portion and the second plate-shaped portion in the first direction, and having a second opening that constitutes a part of the refrigerant flow path, a longitudinal direction of the second opening is the second direction. The heat exchanger further comprises a fifth member that includes a fifth plate-shaped portion positioned between the third plate-shaped portion and the fourth plate-shaped portion in the first direction. The fifth plate-shaped portion has a third opening that communicates with the third region and the second opening, and a fourth opening that, at a position differing from a position of the third opening in the second direction, communicates with the third region and the second opening.

DETAILED DESCRIPTION

Embodiments of an air conditioner using a heat exchanger of the present disclosure is described below.

(1) Structure of Air Conditioner

An air conditioner 1 according to one or more embodiments is described with reference to the drawings.

Figure 1:
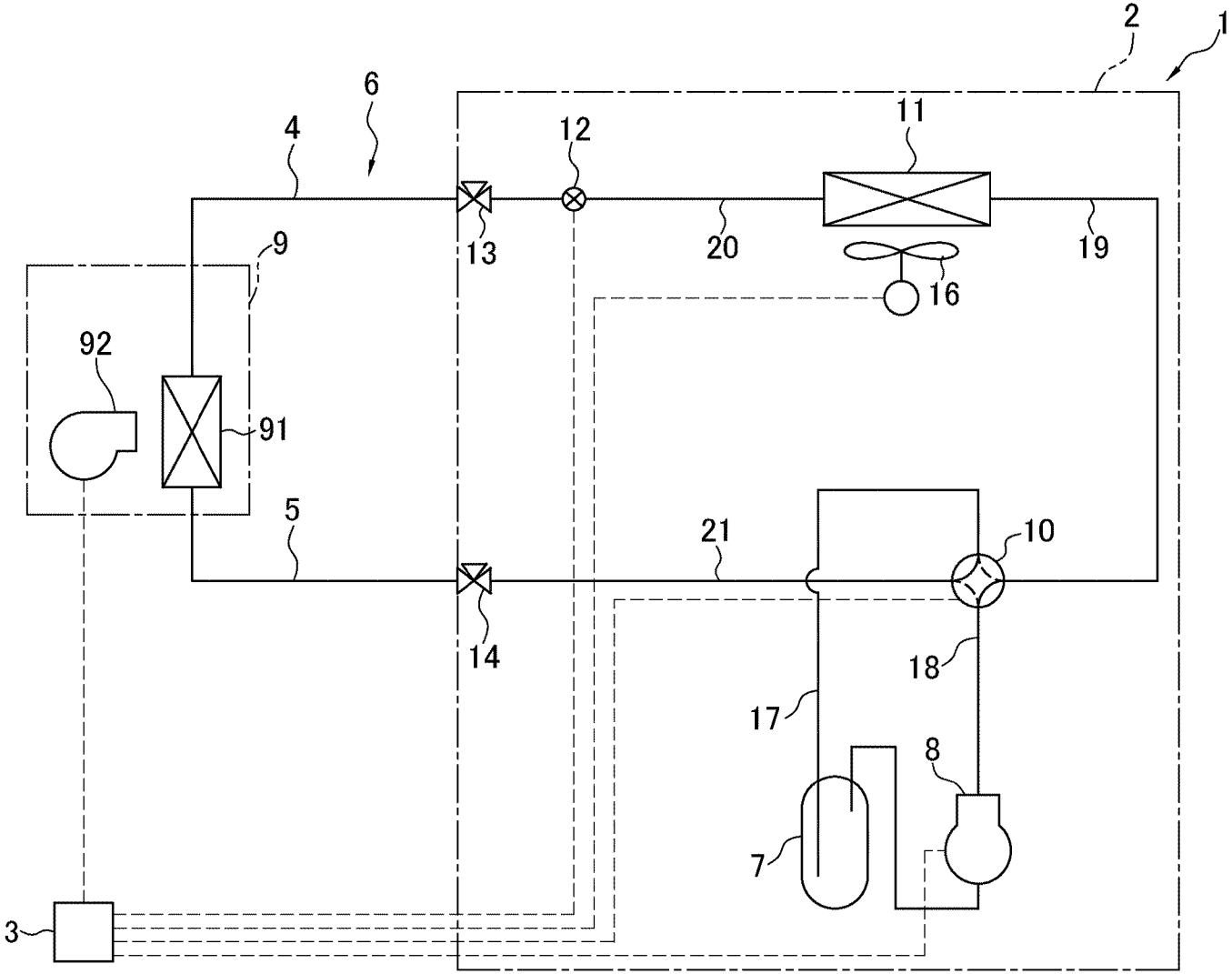
FIG. 1 is a schematic structural view of an air conditioner according to one or more embodiments.

FIG. 1 is a schematic structural view of the air conditioner 1 including a heat exchanger according to one or more embodiments of the present disclosure as an outdoor heat exchanger 11.

The air conditioner 1 (an example of the heat pump device) is a device that cools and heats a space to be air-conditioned by performing a vapor-compression refrigeration cycle. The space to be air-conditioned is, for example, a space in buildings, such as office buildings, commercial facilities, or residences. Note that the air conditioner is merely an example of the refrigerant cycle device, and the heat exchanger of the present disclosure may be used in other refrigerant cycle devices, such as a refrigerator, a freezer, a water heater, or a floor heating device.

As shown in FIG. 1, the air conditioner 1 primarily includes an outdoor unit 2, an indoor unit 9, a liquid-refrigerant connection pipe 4 and a gas-refrigerant connection pipe 5, and a control unit 3 that controls devices that constitute the outdoor unit 2 and the indoor unit 9. The liquid-refrigerant connection pipe 4 and the gas-refrigerant connection pipe 5 are refrigerant connection pipes that connect the outdoor unit 2 and the indoor unit 9 to each other. In the air conditioner 1, the outdoor unit 2 and the indoor unit 9 are connected to each other via the liquid-refrigerant connection pipe 4 and the gas-refrigerant connection pipe 5 to constitute a refrigerant circuit 6.

Note that, although in FIG. 1, the air conditioner 1 includes one indoor unit 9, the air conditioner 1 may include a plurality of indoor units 9 that are connected side by side to the outdoor unit 2 by the liquid-refrigerant connection pipe 4 and the gas-refrigerant connection pipe 5. The air conditioner 1 may also include a plurality of outdoor units 2. The air conditioner 1 may be an integrated air conditioner in which the outdoor unit 2 and the indoor unit 9 are integrated with each other.

(1-1) Outdoor Unit

The outdoor unit 2 is installed outside a space to be air-conditioned, such as on the roof of a building or near a wall surface of a building.

The outdoor unit 2 primarily includes an accumulator 7, a compressor 8, a four-way switching valve 10, the outdoor heat exchanger 11, an expansion mechanism 12, a liquid-side shutoff valve 13 and a gas-side shutoff valve 14, and an outdoor fan 16 (see FIG. 1).

The outdoor unit 2 primarily includes, as refrigerant pipes that connect various devices constituting the refrigerant circuit 6, a suction pipe 17, a discharge pipe 18, a first gas-refrigerant pipe 19, a liquid refrigerant pipe 20, and a second gas-refrigerant pipe 21 (see FIG. 1). The suction pipe 17 connects the four-way switching valve 10 and a suction side of the compressor 8. The accumulator 7 is provided at the suction pipe 17. The discharge pipe 18 connects a discharge side of the compressor 8 and the four-way switching valve 10 to each other. The first gas-refrigerant pipe 19 connects the four-way switching valve 10 and a gas side of the outdoor heat exchanger 11 to each other. The liquid refrigerant pipe 20 connects a liquid side of the outdoor heat exchanger 11 and the liquid-side shutoff valve 13 to each other. The expansion mechanism 12 is provided at the liquid refrigerant pipe 20. The second gas-refrigerant pipe 21 connects the four-way switching valve 10 and the gas-side shutoff valve 14 to each other.

The compressor 8 is a device that sucks in a refrigerant having a low pressure in a refrigeration cycle from the suction pipe 17, compresses the refrigerant at a compression mechanism (not shown), and discharges the compressed refrigerant to the discharge pipe 18.

The four-way switching valve 10 is a mechanism that, by switching a direction of flow of a refrigerant, changes the state of the refrigerant circuit 6 between a cooling operation state and a heating operation state. When the refrigerant circuit 6 is in the cooling operation state, the outdoor heat exchanger 11 functions as a heat dissipater (condenser) of a refrigerant and an indoor heat exchanger 91 functions as an evaporator of a refrigerant. When the refrigerant circuit 6 is in the heating operation state, the outdoor heat exchanger 11 functions as an evaporator of a refrigerant and the indoor heat exchanger 91 functions as a condenser of a refrigerant. When the four-way switching valve 10 changes the state of the refrigerant circuit 6 to the cooling operation state, the four-way switching valve 10 causes the suction pipe 17 to communicate with the second gas-refrigerant pipe 21, and causes the discharge pipe 18 to communicate with the first gas-refrigerant pipe 19 (see solid line in the four-way switching valve 10 in FIG. 1). When the four-way switching valve 10 changes the state of the refrigerant circuit 6 to the heating operation state, the four-way switching valve 10 causes the suction pipe 17 to communicate with the first gas-refrigerant pipe 19, and causes the discharge pipe 18 to communicate with the second gas-refrigerant pipe 21 (see broken line in the four-way switching valve 10 in FIG. 1).

The outdoor heat exchanger 11 (an example of the heat exchanger) is a device that causes a refrigerant that flows therein and air existing at a place of installation of the outdoor unit 2 (heat source air) to exchange heat with each other. The outdoor heat exchanger 11 is described in detail below.

The expansion mechanism 12 is disposed between the outdoor heat exchanger 11 and the indoor heat exchanger 91 in the refrigerant circuit 6. In one or more embodiments, the expansion mechanism 12 is disposed at the liquid refrigerant pipe 20 between the outdoor heat exchanger 11 and the liquid-side shutoff valve 13. Note that, although in the present air conditioner 1, the expansion mechanism 12 is provided at the outdoor unit 2, the expansion mechanism 12 may be provided at the indoor unit 9 (described later) instead. The expansion mechanism 12 is a mechanism that adjusts the pressure and the flow rate of a refrigerant that flows in the liquid refrigerant pipe 20. Although, in one or more embodiments, the expansion mechanism 12 is an electronic expansion valve whose opening degree is variable, the expansion mechanism 12 may be a temperature-sensitive cylinder expansion valve or capillary tube.

The accumulator 7 is a container having a gas-liquid dividing function of dividing an inflowing refrigerant into a gas refrigerant and a liquid refrigerant. The accumulator 7 is also a container having the function of storing excess refrigerant produced in according with, for example, variations in an operation load.

The liquid-side shutoff valve 13 is a valve that is provided at a connection portion between the liquid refrigerant pipe 20 and the liquid-refrigerant connection pipe 4. The gas-side shutoff valve 14 is a valve that is provided at a connection portion between the second gas-refrigerant pipe 21 and the gas-refrigerant connection pipe 5. The liquid-side shutoff valve 13 and the gas-side shutoff valve 14 are open when the air conditioner 1 operates.

The outdoor fan 16 (an example of the fan) is a fan for sucking in external heat source air into a casing of the outdoor unit 2 (not shown), supplying the air to the outdoor heat exchanger 11, and discharging the air that has exchanged heat with a refrigerant in the outdoor heat exchanger 11 to the outside of the casing of the outdoor unit 2. The outdoor fan 16 is, for example, a propeller fan.

(1-2) Indoor Unit

The indoor unit 9 is a unit that is installed in a space to be air-conditioned. Although the indoor unit 9 is, for example, a ceiling-embedded unit, the indoor unit 9 may be a ceiling-suspension unit, a wall-mounted unit, or a floor unit. The indoor unit 9 may be installed outside a space to be air-conditioned. For example, the indoor unit 9 may be installed in an attic, a machine chamber, or a garage. In this case, an air passage that supplies air that has exchanged heat with a refrigerant in the indoor heat exchanger 91 to a space to be air-conditioned from the indoor unit 9 is provided. The air passage is, for example, a duct.

The indoor unit 9 primarily includes the indoor heat exchanger 91 and an indoor fan 92 (see FIG. 1).

In the indoor heat exchanger 91, a refrigerant that flows in the indoor heat exchanger 91 and air in a space to be air-conditioned exchanges heat with each other. Although the type of indoor heat exchanger 91 is not limited, the indoor heat exchanger 91 is, for example, a fin-and-tube heat exchanger including a plurality of heat transfer tubes and fins that are not shown. One end of the indoor heat exchanger 91 is connected to the liquid-refrigerant connection pipe 4 via a refrigerant pipe. The other end of the indoor heat exchanger 91 is connected to the gas-refrigerant connection pipe 5 via a refrigerant pipe.

The indoor fan 92 is a mechanism that sucks in air in a space to be air-conditioned into a casing (not shown) of the indoor unit 9, supplies the air to the indoor heat exchanger 91, and blows out the air that has exchanged heat with a refrigerant in the indoor heat exchanger 91 to the space to be air-conditioned. The indoor fan 92 is, for example, a turbo fan. However, the type of indoor fan 92 is not limited to a turbo fan, and may be selected as appropriate.

(1-3) Control Unit

The control unit 3 is a functional part that controls the operations of various devices that form the air conditioner 1.

The control unit 3 is constituted by, for example, connecting an outdoor control unit (not shown) of the outdoor unit 2 and an indoor control unit (not shown) of the indoor unit 9 via a transmission line (not shown) to allow communication. The outdoor control unit and the indoor control unit are, for example, a microcomputer or a unit including, for example, a memory that stores various programs for controlling the air conditioner 1, which are executable by the microcomputer. Note that, for convenience sake, FIG. 1 illustrates the control unit 3 at a position situated away from the outdoor unit 2 and the indoor unit 9.

Note that the functions of the control unit 3 do not need to be realized by cooperation between the outdoor control unit and the indoor control unit. For example, the functions of the control unit 3 may be realized by either one of the outdoor control unit and the indoor control unit, or some or all of the functions of the control unit 3 may be realized by a control device (not shown) that differs from the outdoor control unit and the indoor control unit.

As shown in FIG. 1, the control unit 3 is electrically connected to the various devices of the outdoor unit 2 and the indoor unit 9, including the compressor 8, the four-way switching valve 10, the expansion mechanism 12, the outdoor fan 16, and the indoor fan 92. The control unit 3 is also electrically connected to various sensors (not shown) that are provided at the outdoor unit 2 and the indoor unit 9. The control unit 3 is constituted to allow communication with a remote controller (not shown) that is operated by a user of the air conditioner 1.

The control unit 3 controls the operation and stopping of the air conditioner 1 or the operations of the various devices that constitute the air conditioner 1, based on, for example, a measurement signal of each of the various sensors or an instruction that is received from a remote controller (not shown).

(2) Structure of Outdoor Heat Exchanger

A structure of the outdoor heat exchanger 11 is described with reference to the drawings.

Figure 2:
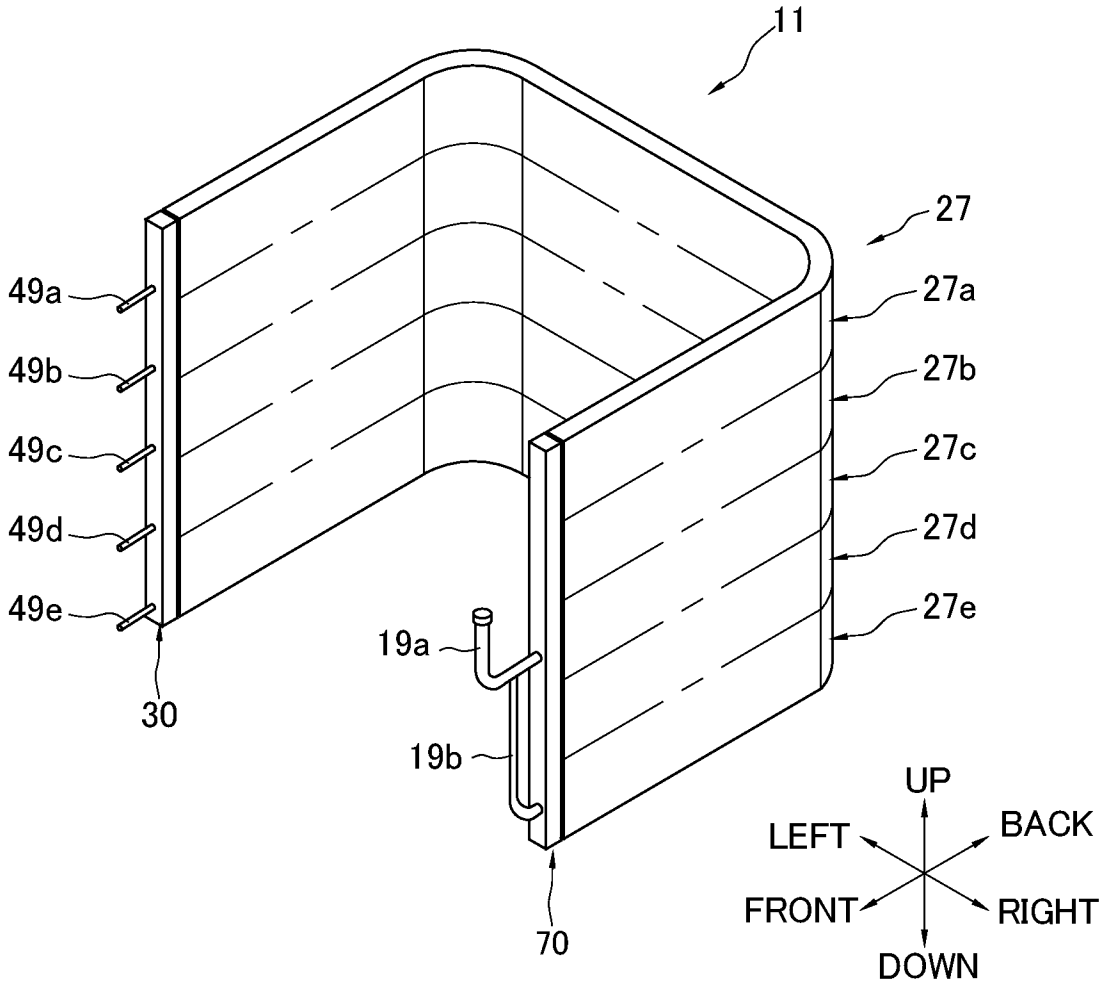
FIG. 2 is a schematic perspective view of an outdoor heat exchanger according to one or more embodiments.
Figure 3:
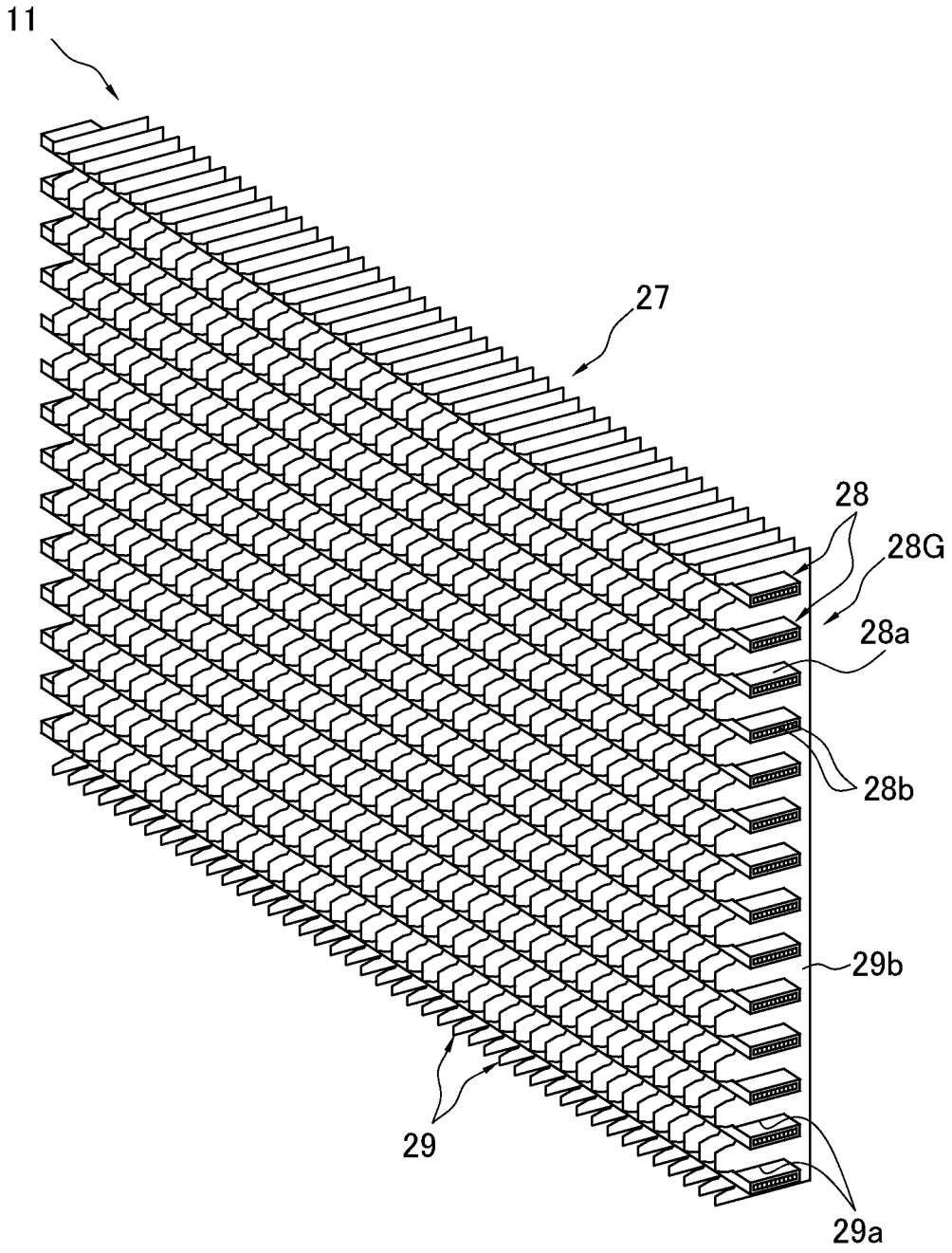
FIG. 3 is an enlarged view of a portion of a heat exchange portion of the outdoor heat exchanger according to one or more embodiments.
Figure 4:
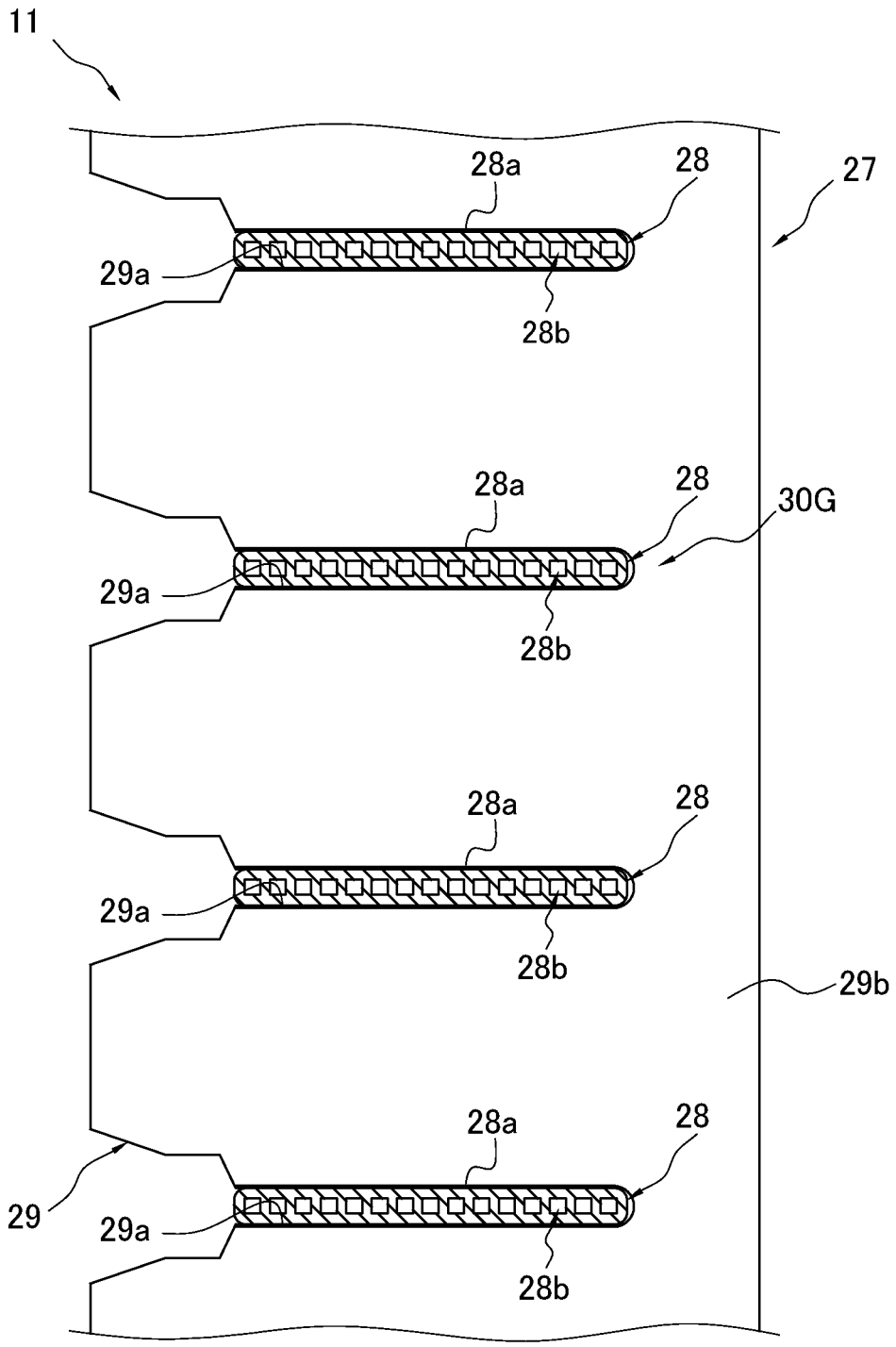
FIG. 4 is a schematic view showing heat transfer fins mounted on flat tubes in the heat exchange portion according to one or more embodiments.
Figure 5:
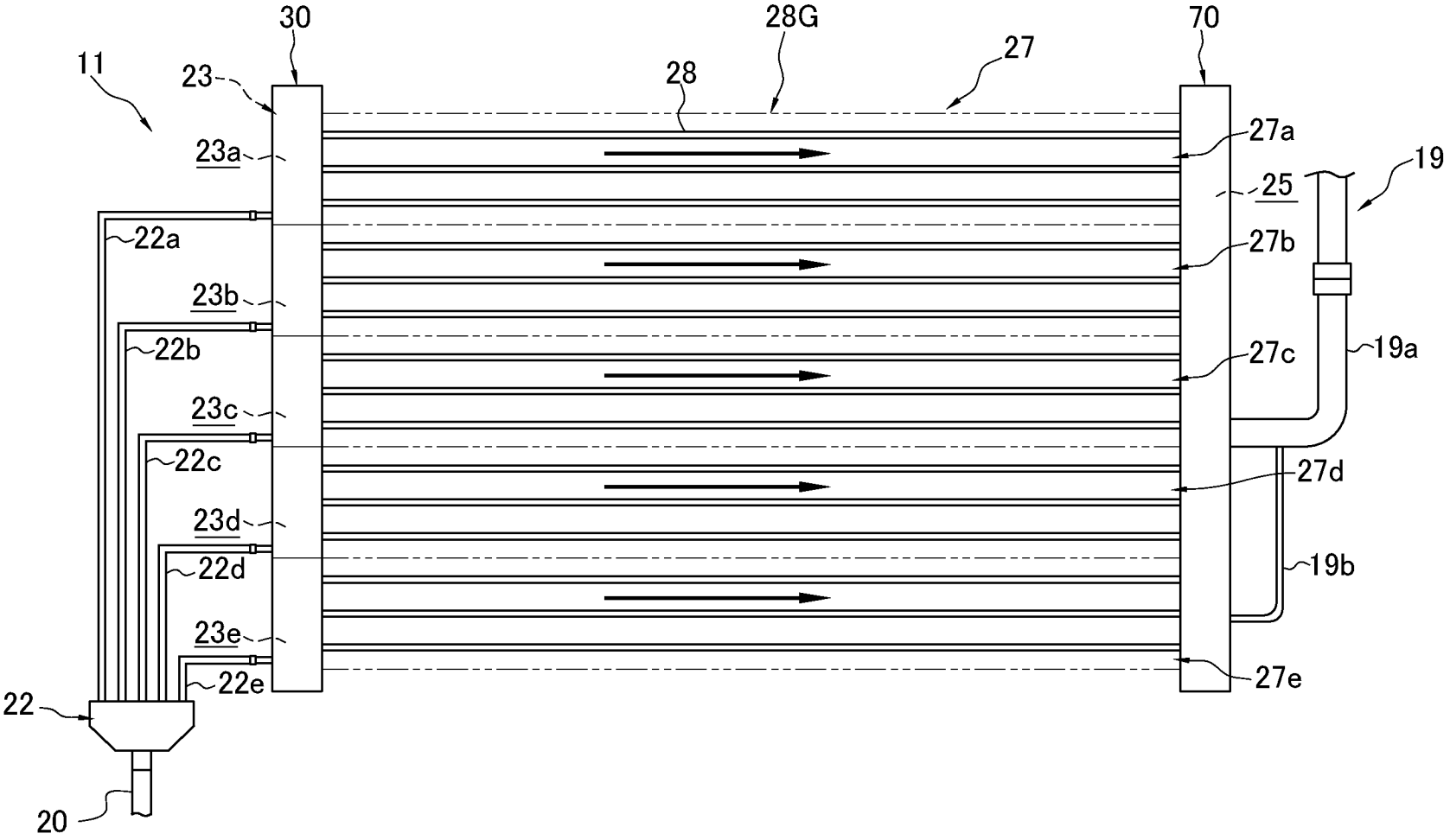
FIG. 5 is an explanatory view showing a state of flow of a refrigerant in the outdoor heat exchanger functioning as an evaporator of the refrigerant according to one or more embodiments.

FIG. 2 is a schematic perspective view of the outdoor heat exchanger 11. FIG. 3 is an enlarged view of a portion of a heat exchange portion 27 (described below) of the outdoor heat exchanger 11. FIG. 4 is a schematic view showing fins 29 (described below) mounted on flat tubes 28 in the heat exchange portion 27. FIG. 5 is a schematic structural view of the outdoor heat exchanger 11. The arrows in the heat exchange portion 27 shown in FIG. 5 indicate flow of a refrigerant at the time of a heating operation (when the outdoor heat exchanger 11 functions as an evaporator).

Note that, in the description below, for describing an orientation and a position, terms, such as "up", "down", "left", "right", "front (front side)", or "back (back side)" may be used. Unless otherwise specified, these expressions are in conformity with the directions of the arrows shown in FIG. 2. Note that these terms that indicate these directions and positions are used for convenience of explanation, and, unless otherwise specified, the orientation and the position of the entire outdoor heat exchanger 11 and the orientation and the position of each structure of the outdoor heat exchanger 11 are not to be determined by the orientations and the positions indicated by these terms.

The outdoor heat exchanger 11 is a device that causes heat to be exchanged between a refrigerant that flows therein and air.

The outdoor heat exchanger 11 primarily includes a distributor 22, a flat tube group 28G including the plurality of flat tubes 28, the plurality of fins 29, a liquid header 30 (an example of the header), and a gas header 70 (see FIGS. 4 and 5). In one or more embodiments, the distributor 22, the flat tubes 28, the fins 29, the liquid header 30, and the gas header 70 are all made of aluminum or an aluminum alloy.

As described below, the flat tubes 28 and the fins 29 that are fixed to the flat tubes 28 form the heat exchange portion 27 (see FIGS. 2 and 3). The outdoor heat exchanger 11 is a device including the one-column heat exchange portion 27, and is not a device in which the plurality of flat tubes 28 are disposed side by side in an air flow direction. In the outdoor heat exchanger 11, by causing air to flow in a ventilation path that is formed by the flat tubes 28 and the fins 29 of the heat exchange portion 27, a refrigerant that flows in the flat tubes 28 exchanges heat with the air that flows in the ventilation path. The heat exchange portion 27 is divided into a first heat exchange portion 27*a*, a second heat exchange portion 27*b*, a third heat exchange portion 27*c*, a fourth heat exchange portion 27*d*, and a fifth heat exchange portion 27*e*, which are disposed side by side in an up-down direction (see FIG. 2).

(2-1) Distributor

The distributor 22 is a mechanism that divides a flow of a refrigerant. The distributor 22 is also a mechanism that merges refrigerants. The liquid refrigerant pipe 20 is connected to the distributor 22. The distributor 22 includes a plurality of flow dividing pipes 22*a* to 22*e*. The distributor 22 has the function of dividing a flow of a refrigerant that has flowed into the distributor 22 from the liquid refrigerant pipe 20 by the plurality of flow dividing pipes 22*a* to 22*e* (an example of refrigerant pipes) and of guiding the separated portions of the refrigerant to a plurality of spaces that are formed in the liquid header 30. The distributor 22 also has the function of merging the portions of the refrigerant that have flowed through the flow dividing pipes 22*a* to 22*e* from the liquid header 30 and of guiding the merged portions of the refrigerant to the liquid refrigerant pipe 20. Specifically, the flow dividing pipes 22*a* to 22*e* and the plurality of spaces in the liquid header 30 are connected to each other via a corresponding one of branch liquid-refrigerant connection pipes 49*a* to 49*e*.

(2-2) Flat Tube Group

The flat tube group 28G is an example of a heat transfer tube group. The flat tube group 28G includes the plurality of flat tubes 28 as a plurality of heat transfer tubes. As shown in FIG. 3, the flat tubes 28 are flat heat transfer tubes having a flat surface 28*a*, which is a heat transfer surface, in the up-down direction. As shown in FIG. 3, the flat tubes 28 have a plurality of refrigerant passages 28*b* in which a refrigerant flows. For example, the flat tubes 28 are flat multi-hole tubes where many refrigerant passages 28*b* in which a refrigerant flows and whose passage cross-sectional area is small are formed. In one or more embodiments, the plurality of refrigerant passages 28*b* are provided side by side in an air flow direction. Note that the maximum width of a cross section of the flat tubes 28 perpendicular to the refrigerant passages 28*b* may be greater than or equal to 70% or greater than or equal to 85% of the outside diameter of a main gas-refrigerant-pipe connection portion 19*a*.

In the outdoor heat exchanger 11, as shown in FIG. 5, the flat tubes 28 extending in a horizontal direction between the liquid header 30 and the gas header 70 are disposed side by side in an up-down direction in a plurality of layers. Note that, in one or more embodiments, the flat tubes 28 extending between the liquid header 30 and the gas header 70 are bent at two locations, and the heat exchange portion 27 that is constituted by the flat tubes 28 is formed in a substantially U shape in plan view (see FIG. 2). In one or more embodiments, the plurality of flat tubes 28 are disposed apart from each other by a certain interval in the up-down direction.

(2-3) Fins

The plurality of fins 29 are members for increasing the heat transfer area of the outdoor heat exchanger 11. Each fin 29 is a plate-shaped member extending in a direction in which the flat tubes 28 are disposed side by side in layers. The outdoor heat exchanger 11 is used in a mode in which the plurality of flat tubes 28 extending in the horizontal direction are disposed side by side in the up-down direction. Therefore, with the outdoor heat exchanger 11 being installed at the outdoor unit 2, each fin 29 extends in the up-down direction.

As shown in FIG. 4, a plurality of cut portions 29*a* extending in an insertion direction of the flat tubes 28 are formed in each fin 29 to allow the plurality of flat tubes 28 to be inserted therein. The cut portions 29*a* extend in the direction of extension of the fins 29 and in a direction orthogonal to a thickness direction of the fins 29. With the outdoor heat exchanger 11 being installed at the outdoor unit 2, the cut portions 29*a* in each fin 29 extend in the horizontal direction. The shape of the cut portions 29*a* of the fins 29 is substantially the same as the external shape of the cross section of the flat tubes 28. The cut portions 29*a* are formed in the fins 29 to be apart from each other by an interval corresponding to an arrangement interval of the flat tubes 28. In the outdoor heat exchanger 11, the plurality of fins 29 are disposed side by side in the direction of extension of the flat tubes 28. By inserting the flat tubes 28 into the plurality of cut portions 29*a* of the plurality of fins 29, portions between the flat tubes 28 that are adjacent to each other are separated into a plurality of ventilation paths in which air flows.

Each fin 29 includes communication portions 29*b* communicating with each other in the up-down direction on an upstream side or a downstream side of the air flow direction with respect to the flat tubes 28. In one or more embodiments, the communication portions 29*b* of the fins 29 are positioned on a windward side with respect to the flat tubes 28.

(2-4) Gas Header and Liquid Header

The gas header 70 and the liquid header 30 are hollow members.

As shown in FIG. 5, one end portion of each flat tube 28 is connected to the liquid header 30, and the other end portion of each flat tube 28 is connected to the gas header 70. The outdoor heat exchanger 11 is disposed in the casing (not shown) of the outdoor unit 2 so that longitudinal directions of the liquid header 30 and the gas header 70 are substantially the same as a vertical direction (an example of the second direction). In one or more embodiments, as shown in FIG. 2, the heat exchange portion 27 of the outdoor heat exchanger 11 has a U shape in plan view. The liquid header 30 is disposed near a left front corner of the casing (not shown) of the outdoor unit 2 (see FIG. 2). The gas header 70 is disposed near a right front corner of the casing (not shown) of the outdoor unit 2 (see FIG. 2).

(2-4-1) Gas Header

The main gas-refrigerant-pipe connection portion 19*a* and a branch gas-refrigerant-pipe connection portion 19*b* that constitute an end portion of the first gas-refrigerant pipe 19 on the side of the gas header 70 are connected to the gas header 70 (see FIG. 5). Note that, although not limited, the outside diameter of the main gas-refrigerant-pipe connection portion 19*a* may be, for example, greater than or equal to three times, or greater than or equal to five times the outside diameter of the branch gas-refrigerant-pipe connection portion 19*b*.

One end of the main gas-refrigerant-pipe connection portion 19*a* is connected to the gas header 70 to communicate with a gas-side internal space 25 at an intermediate position on the gas header 70 in a height direction.

One end of the branch gas-refrigerant-pipe connection portion 19*b* is connected to the gas header 70 to communicate with the gas-side internal space 25 near a lower end of the gas header 70 in the height direction. The other end of the branch gas-refrigerant-pipe connection portion 19*b* is connected to the main gas-refrigerant-pipe connection portion 19*a*. With the inside diameter of the branch gas-refrigerant-pipe connection portion 19*b* being smaller than the inside diameter of the main gas-refrigerant-pipe connection portion 19*a* and with the branch gas-refrigerant-pipe connection portion 19*b* being connected to the gas header 70 at a location below the main gas-refrigerant-pipe connection portion 19*a*, the branch gas-refrigerant-pipe connection portion 19*b* is capable of bringing refrigerating-machine oil that is retained near the lower end of the gas header 70 into the main gas-refrigerant-pipe connection portion 19*a* and returning the refrigerating-machine oil to the compressor 8.

(2-4-2) Liquid Header

A liquid-side internal space 23 of the liquid header 30 is divided into a plurality of sub-spaces 23*a* to 23*e* (see FIG. 5).

The plurality of sub-spaces 23*a* to 23*e* are disposed side by side in the up-down direction. Each of the sub-spaces 23*a* to 23*e* do not communicate with each other in the liquid-side internal space 23 of the liquid header 30.

The branch liquid-refrigerant connection pipes 49*a* to 49*e* (an example of liquid refrigerant pipes) connected to the respective flow dividing pipes 22*a* to 22*e* of the distributor 22 are connected in a one-to-one correspondence with the respective sub-spaces 23*a* to 23*e*. Therefore, in a cooling operation state, portions of a refrigerant that have reached the respective sub-spaces 23*a* to 23*e* flow into the respective branch liquid-refrigerant connection pipes 49*a* to 49*e* and the respective flow dividing pipes 22*a* to 22*e*, and merge at the distributor 22. In a heating operation state, a refrigerant whose flow has been divided at the distributor 22 flows into each of the flow dividing pipes 22*a* to 22*e* and each of the branch liquid-refrigerant connection pipes 49*a* to 49*e*, and is supplied to each of the sub-spaces 23*a* to 23*e*.

(3) Flow of Refrigerant in Outdoor Heat Exchanger

When the air conditioner 1 performs a heating operation and thus the outdoor heat exchanger 11 functions as an evaporator of a refrigerant, a refrigerant in a gas-liquid two-phase state that has reached the distributor 22 from the liquid refrigerant pipe 20 flows through the flow dividing pipes 22*a* to 22*e* and flows into each of the sub-spaces 23*a* to 23*e* that constitute the liquid-side internal space 23 of the liquid header 30. Specifically, a portion of the refrigerant that has flowed in the flow dividing pipe 22*a* flows to the sub-space 23*a*, a portion of the refrigerant that has flowed in the flow dividing pipe 22*b* flows to the sub-space 23*b*, a portion of the refrigerant that has flowed in the flow dividing pipe 22*c* flows to the sub-space 23*c*, a portion of the refrigerant that has flowed in the flow dividing pipe 22*d* flows to the sub-space 23*d*, and a portion of the refrigerant that has flowed in the flow dividing pipe 22*e* flows to the sub-space 23*e*. The portions of the refrigerant that have flowed into the respective sub-spaces 23*a* to 23*e* of the liquid-side internal space 23 flow to the respective flat tubes 28 connected to the respective sub-spaces 23*a* to 23*e*. The portions of the refrigerant flowing in the respective flat tubes 28 exchange heat with air and thus evaporate and become portions of a gas-phase refrigerant, and flow into the gas-side internal space 25 of the gas header 70 to merge with each other.

When the air conditioner 1 performs a cooling operation or a defrost operation, a refrigerant flows in the refrigerant circuit 6 in a direction opposite to that when the air conditioner 1 performs the heating operation. Specifically, a high-temperature gas-phase refrigerant flows into the gas-side internal space 25 of the gas header 70 via the main gas-refrigerant-pipe connection portion 19*a* and the branch gas-refrigerant-pipe connection portion 19*b* of the first gas-refrigerant pipe 19. The refrigerant that has flowed into the gas-side internal space 25 of the gas header 70 is divided by and flows into each flat tube 28. Portions of the refrigerant that have flowed into the respective flat tubes 28 pass through the respective flat tubes 28, and flow into the sub-spaces 23*a* to 23*e* of the liquid-side internal space 23 of the liquid header 30. The portions of the refrigerant that have flowed into the sub-spaces 23*a* to 23*e* of the liquid-side internal space 23 merge at the distributor 22 and flow out of the liquid refrigerant pipe 20.

(4) Details of Liquid Header

Figure 6:
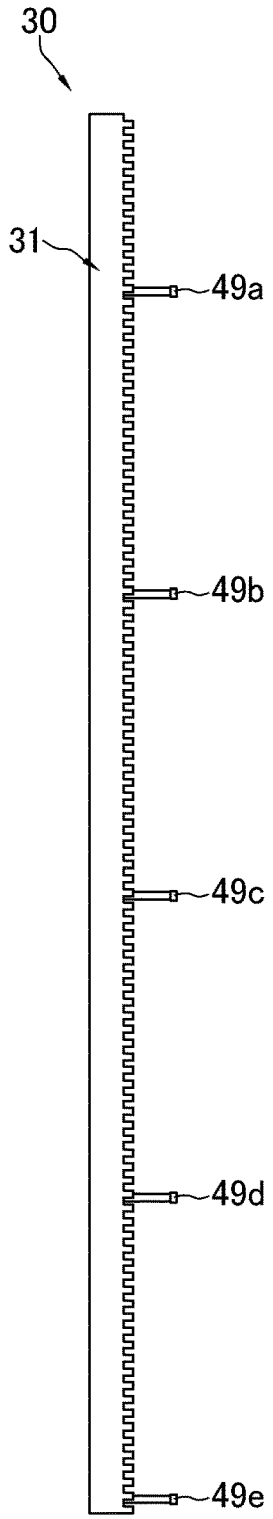
FIG. 6 is a side external structural view showing a state of connection of branch liquid-refrigerant connection pipes with a liquid header according to one or more embodiments.
Figure 7:
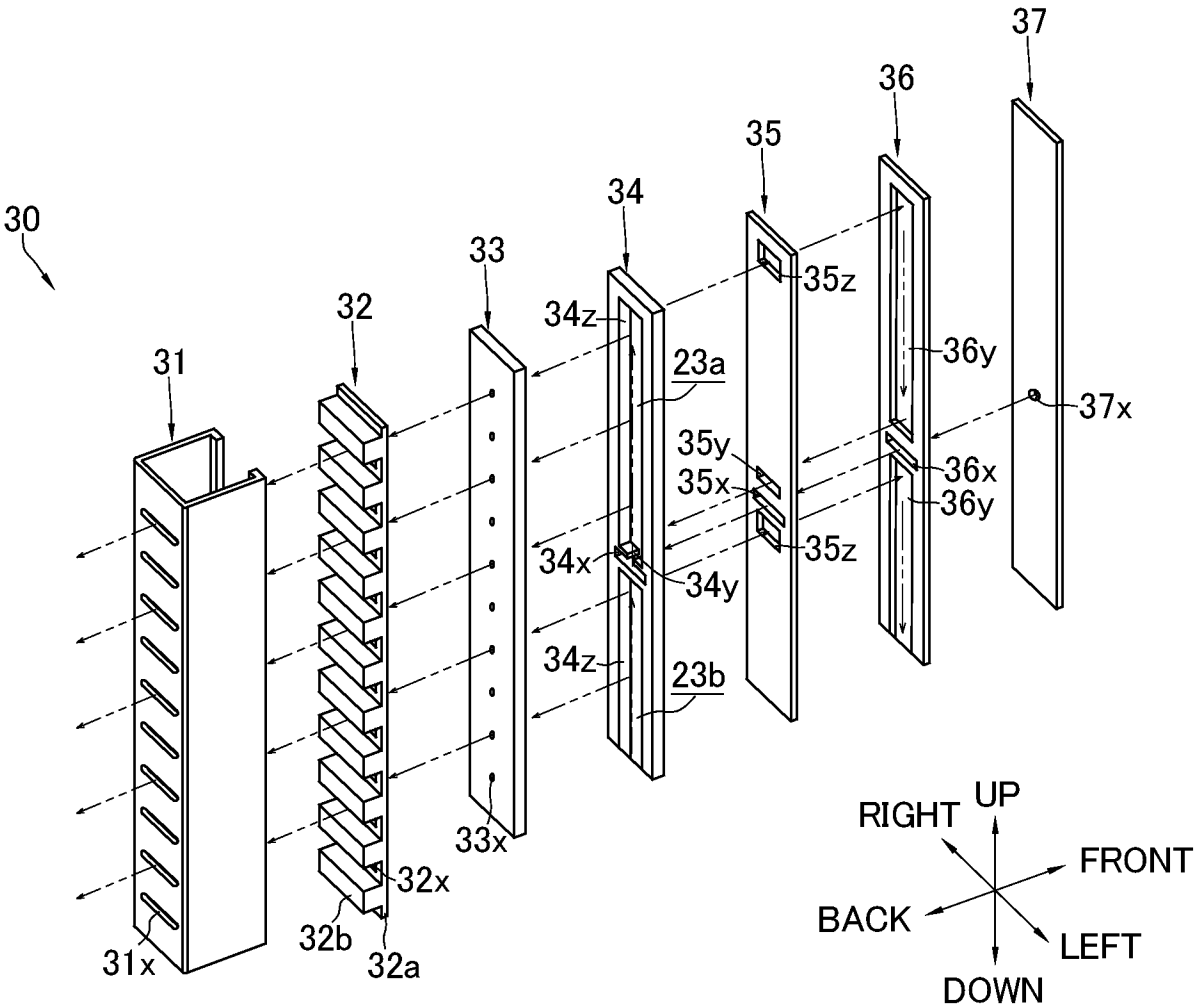
FIG. 7 is an exploded perspective view of the liquid header according to one or more embodiments.
Figure 8:
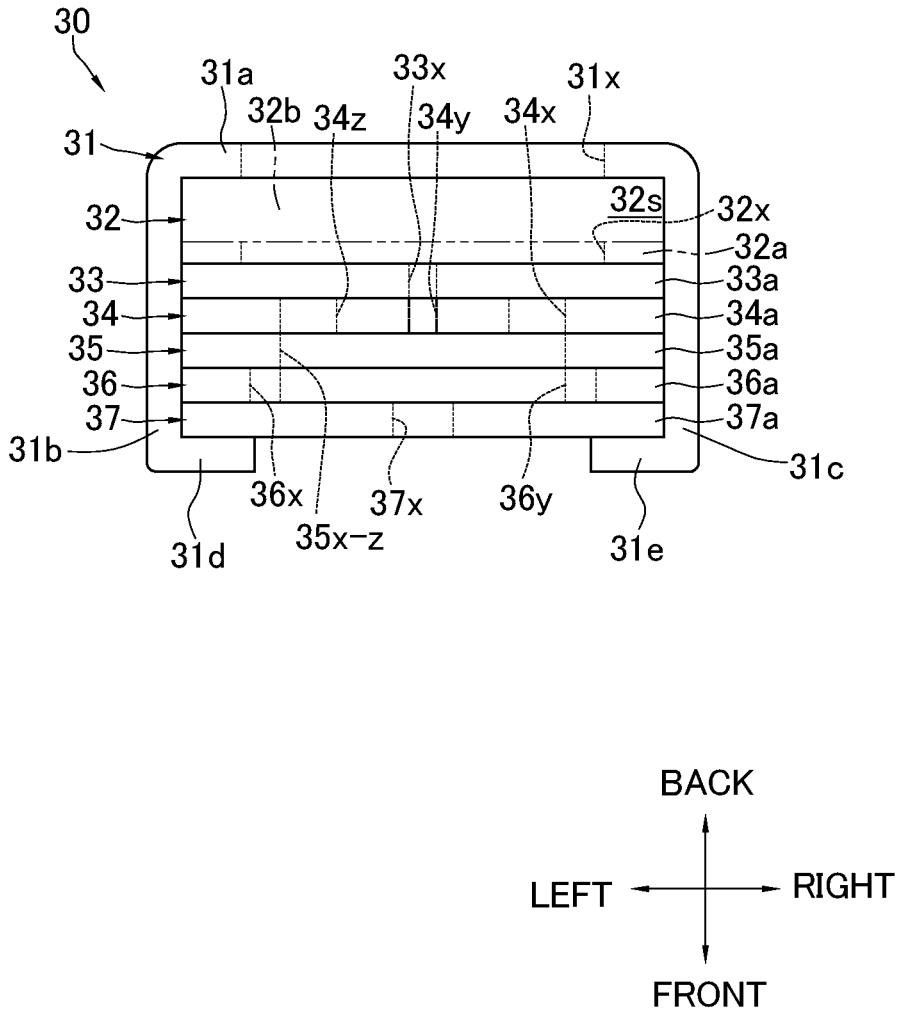
FIG. 8 is a plan sectional view of the liquid header according to one or more embodiments.
Figure 9:
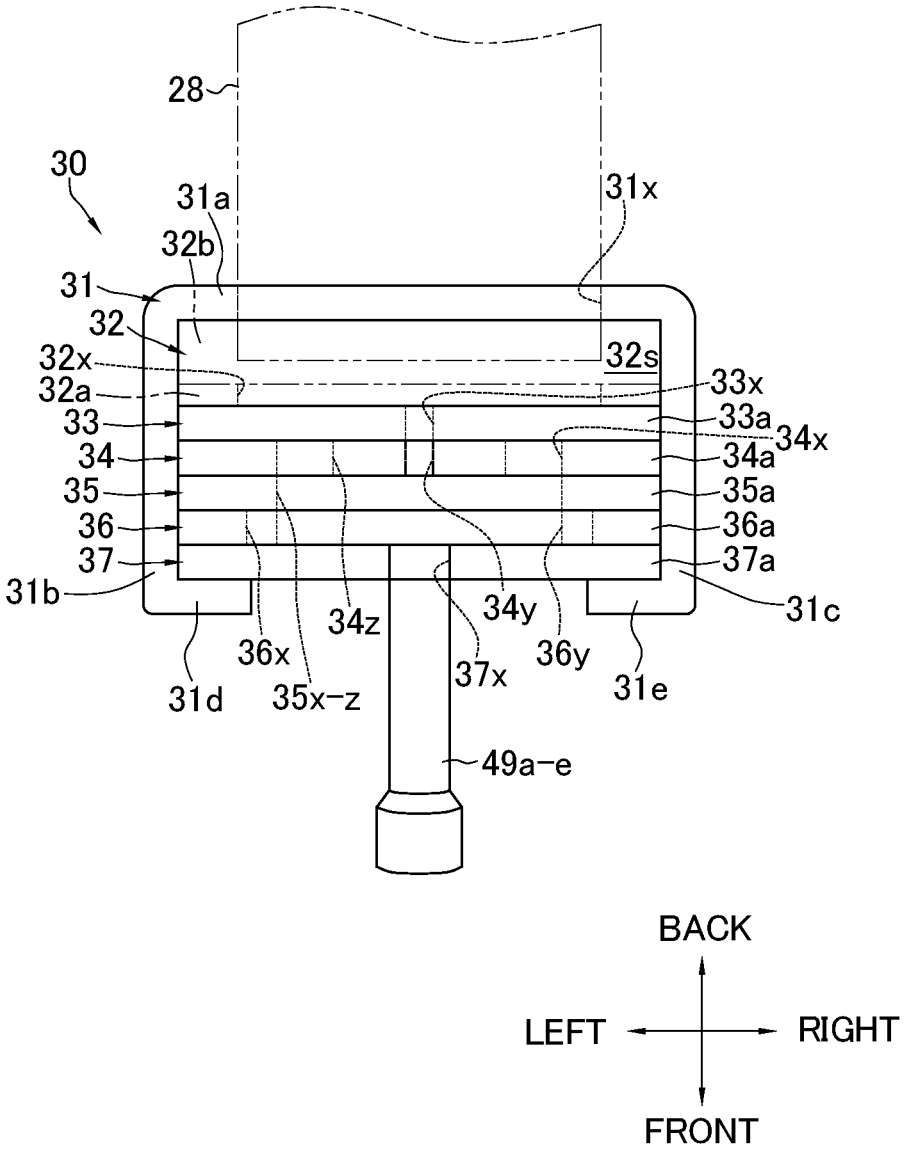
FIG. 9 is a plan sectional view showing a state of connection of the branch liquid-refrigerant connection pipes and flat tubes with the liquid header according to one or more embodiments.
Figure 10:
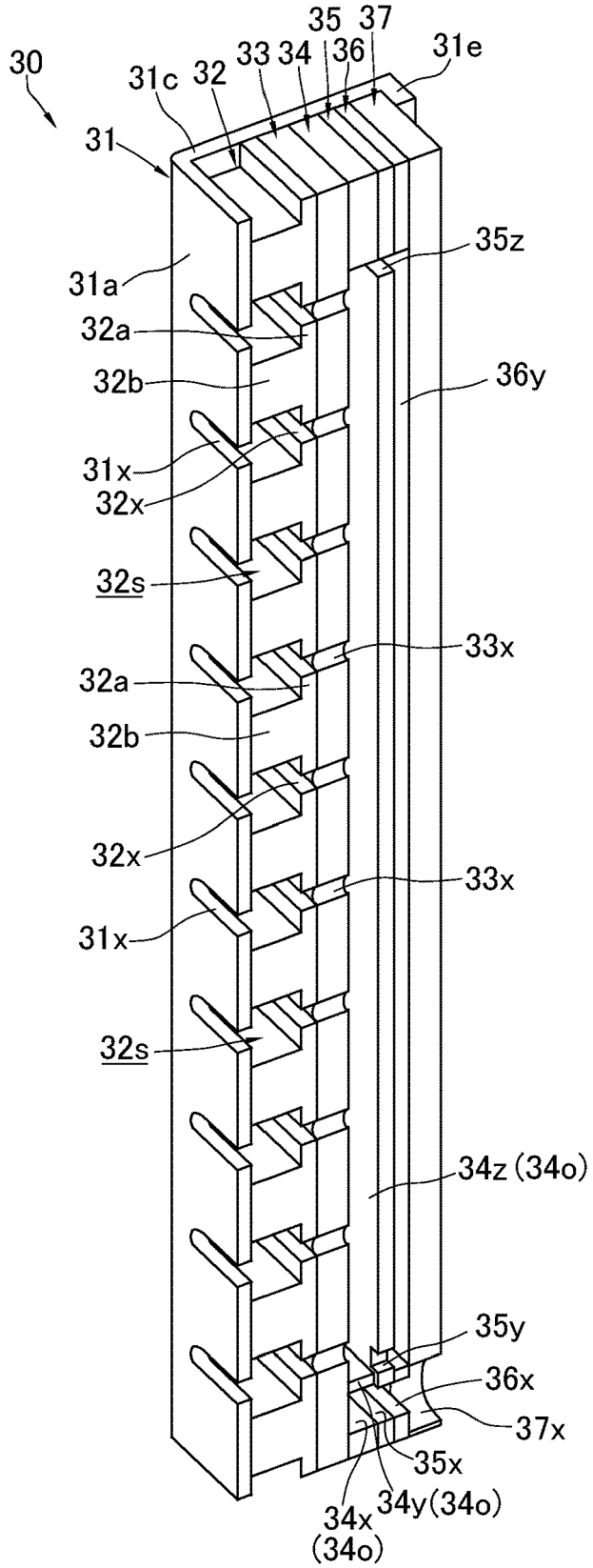
FIG. 10 is a sectional perspective view of a portion of the liquid header according to one or more embodiments near an upper end thereof.

FIG. 6 is a side external structural view showing a state of connection of the branch liquid-refrigerant connection pipes 49*a* to 49*e* with the liquid header 30. FIG. 7 is an exploded perspective view of the liquid header 30 (note that, in this figure, alternate-long-and-two-short-dash-line arrows indicate the flow of a refrigerant when the outdoor heat exchanger 11 functions as an evaporator of the refrigerant). FIG. 8 is a plan sectional view of the liquid header 30. FIG. 9 is a plan sectional view showing a state of connection of the branch liquid-refrigerant connection pipes 49*a* to 49*e* and the flat tubes 28 with the liquid header 30. FIG. 10 is a sectional perspective view of a portion of the liquid header 30 near an upper end thereof.

Figure 11:
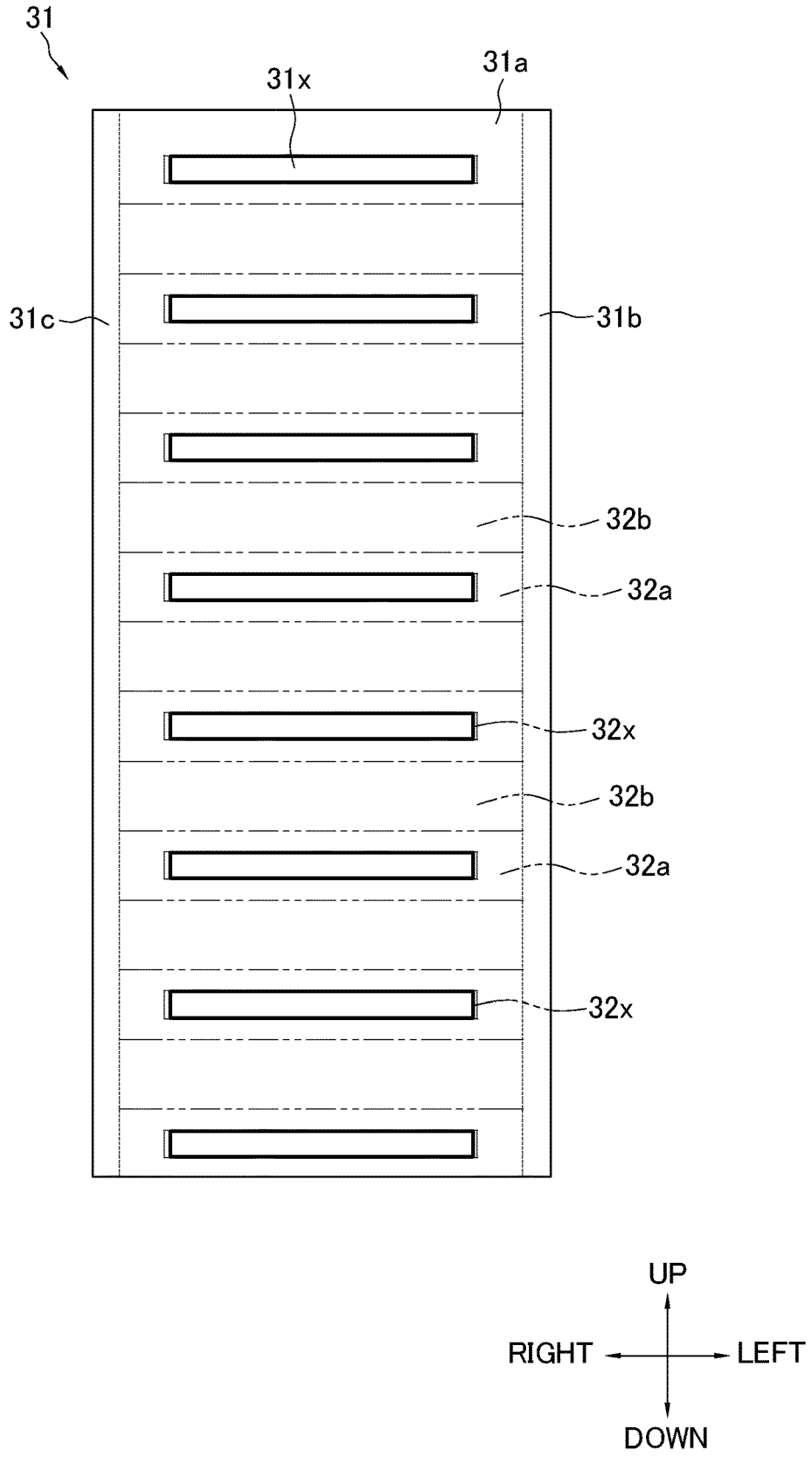
FIG. 11 is a back schematic view of a first liquid-side member according to one or more embodiments.
Figure 12:
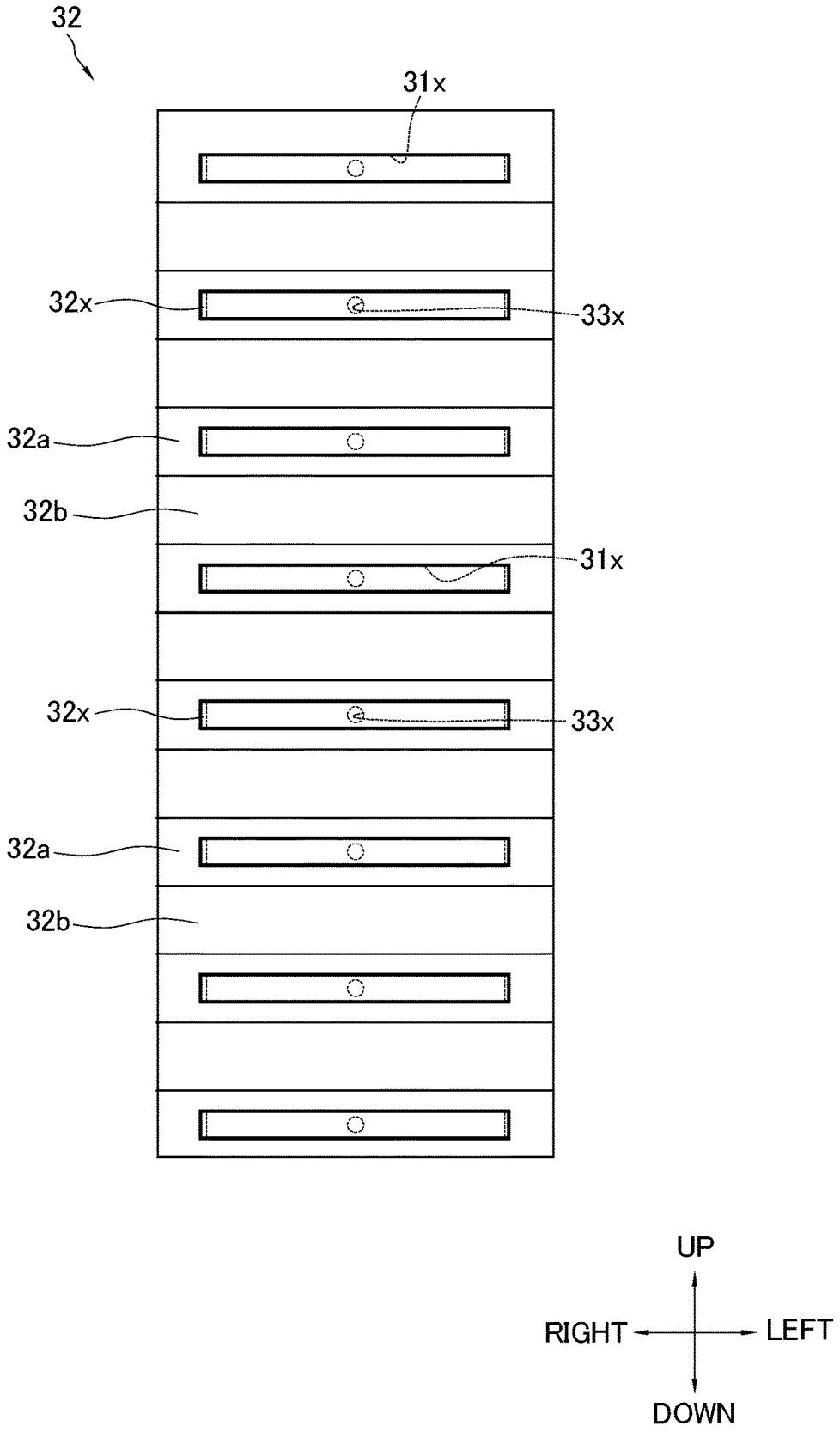
FIG. 12 is a back schematic view of a second liquid-side member according to one or more embodiments.
Figure 13:
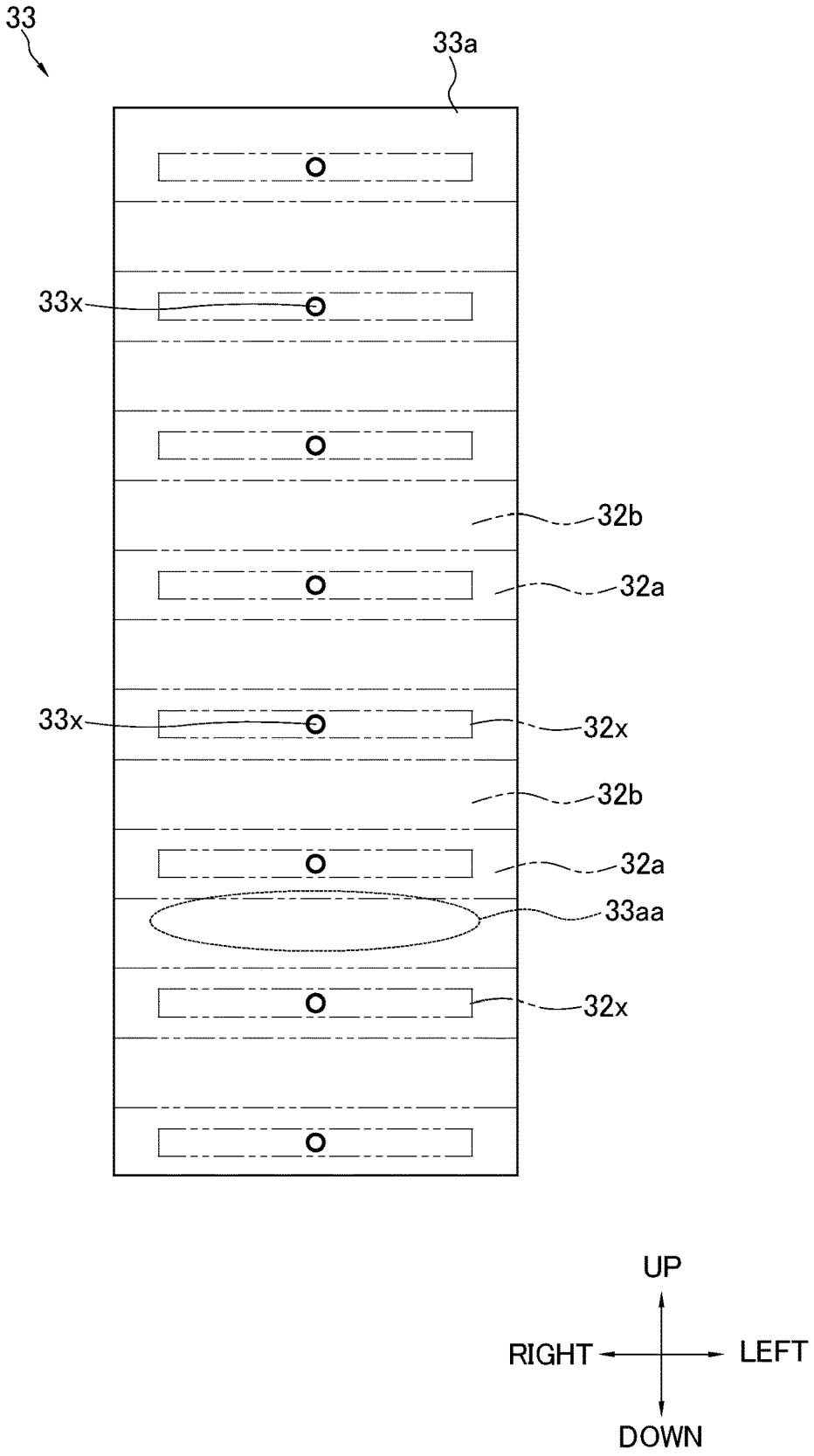
FIG. 13 is a back schematic view of a third liquid-side member according to one or more embodiments.
Figure 14:
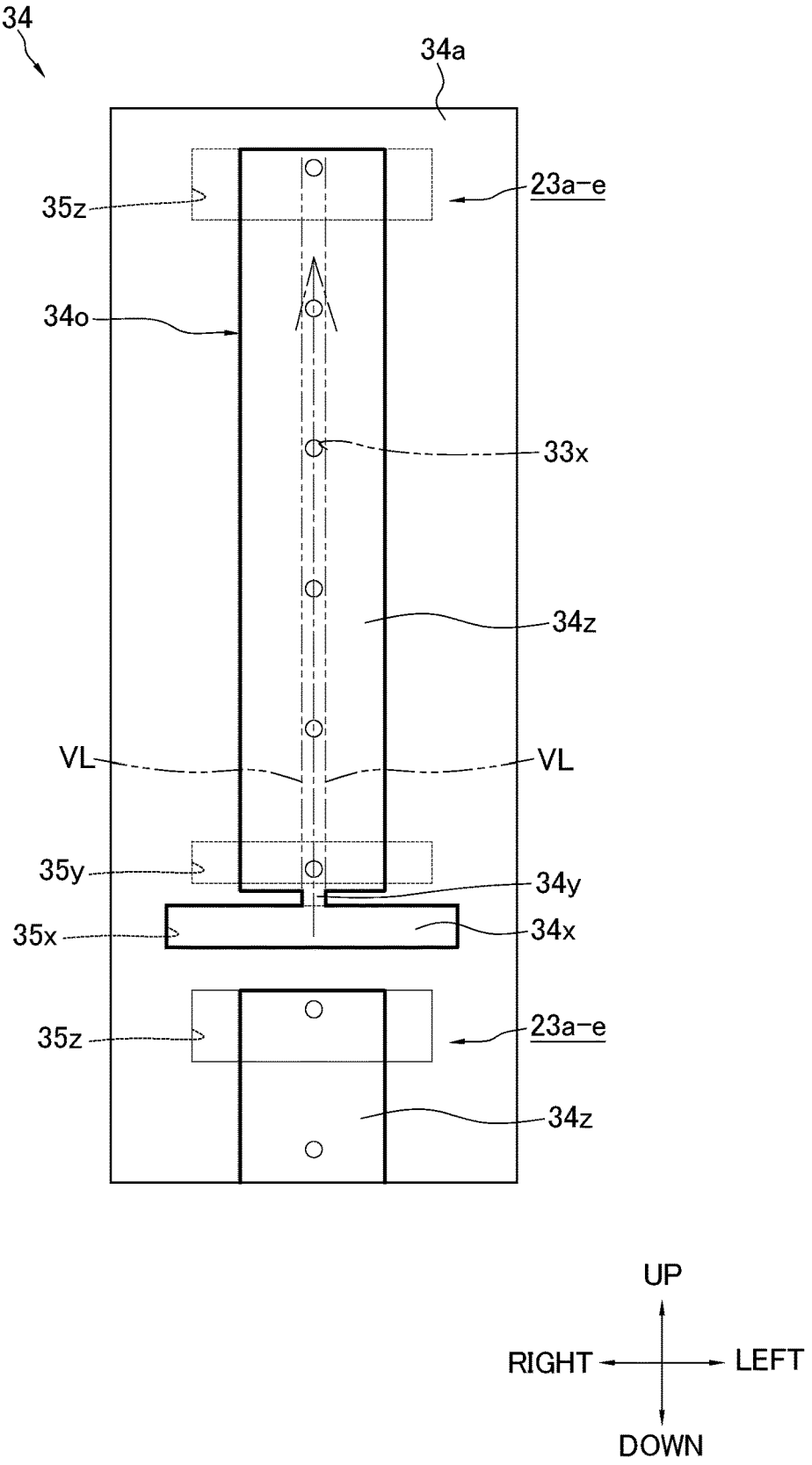
FIG. 14 is a back schematic view of a fourth liquid-side member according to one or more embodiments.
Figure 15:
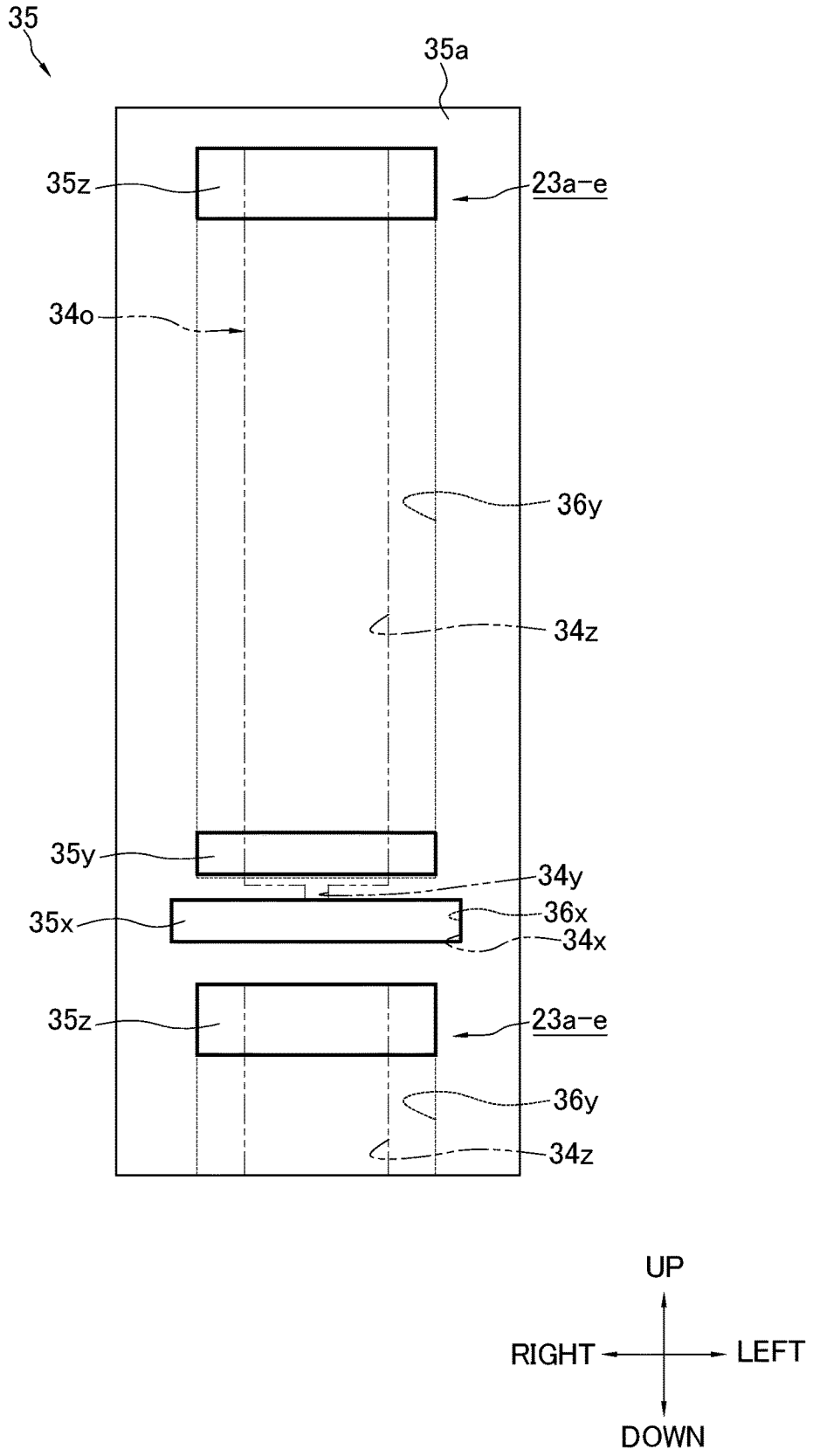
FIG. 15 is a back schematic view of a fifth liquid-side member according to one or more embodiments.
Figure 16:
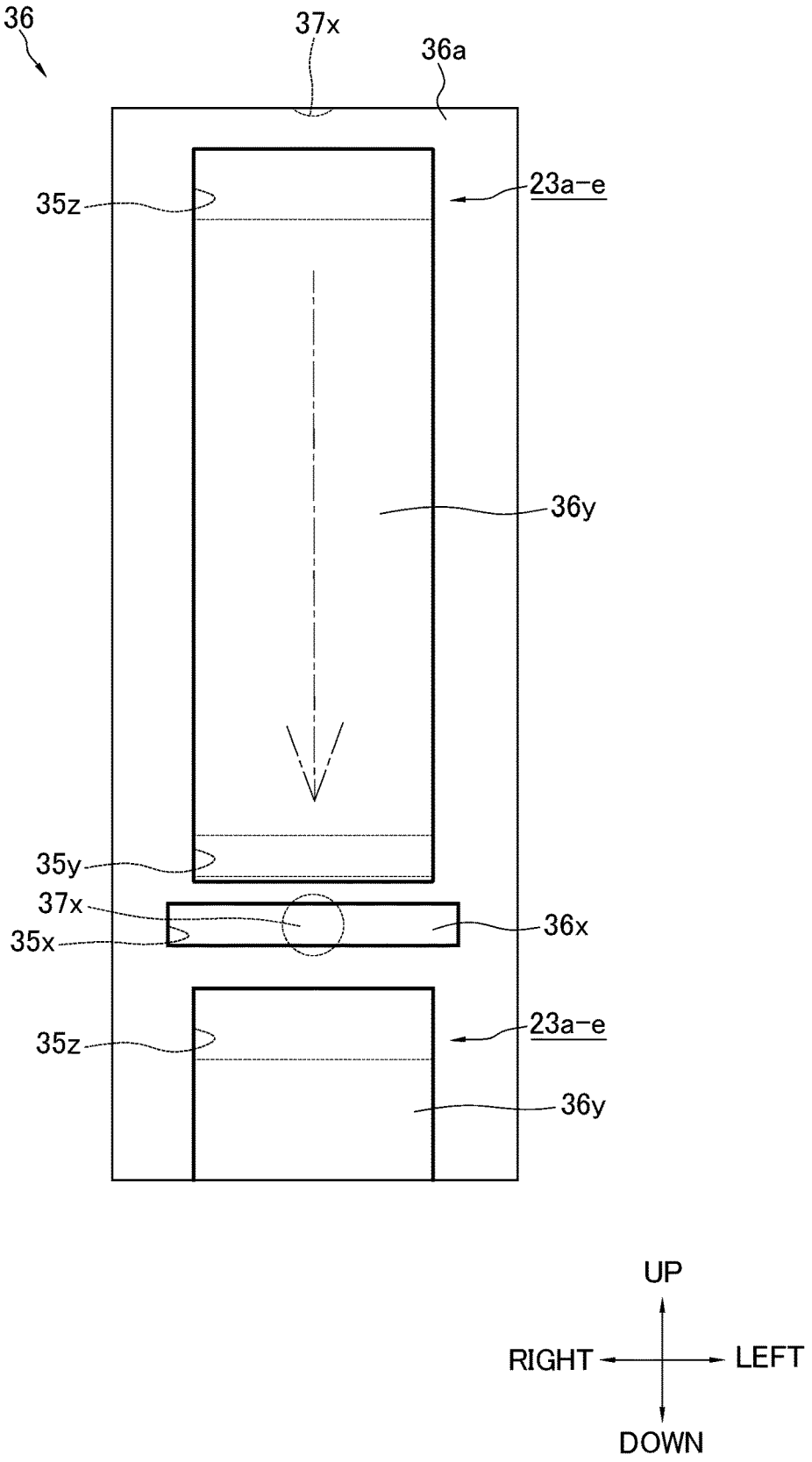
FIG. 16 is a back schematic view of a sixth liquid-side member according to one or more embodiments.
Figure 17:
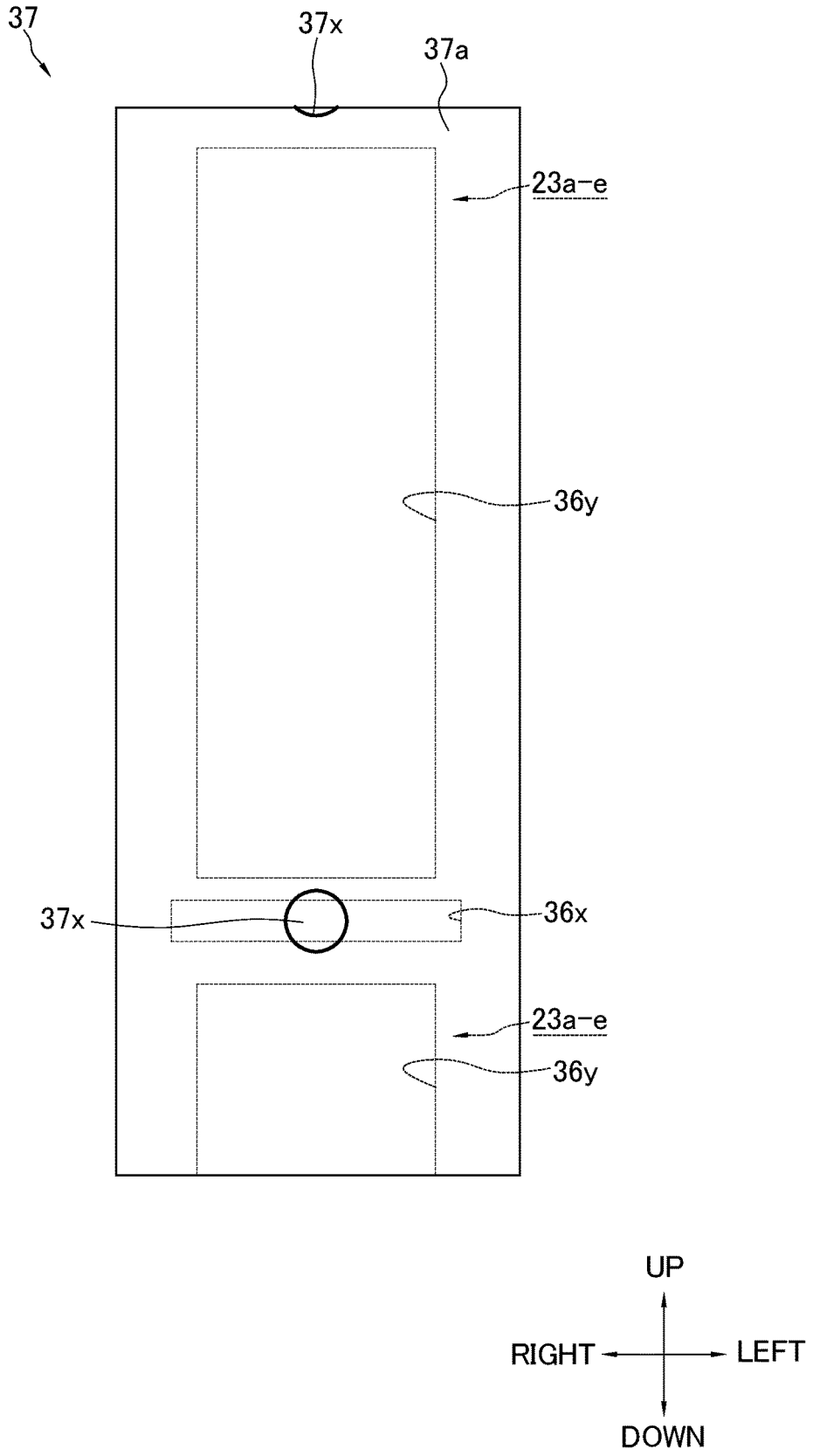
FIG. 17 is a back schematic view of a seventh liquid-side member according to one or more embodiments.

FIG. 11 is a back schematic view of a first liquid-side member 31. FIG. 12 is a back schematic view of a second liquid-side member 32. FIG. 13 is a back schematic view of a third liquid-side member 33. FIG. 14 is a back schematic view of a fourth liquid-side member 34. FIG. 15 is a back schematic view of a fifth liquid-side member 35. FIG. 16 is a back schematic view of a sixth liquid-side member 36. FIG. 17 is a back schematic view of a seventh liquid-side member 37. Note that each of these figures show with, for example, broken lines, the relationships between the positions of openings of the members that are disposed adjacent to each other while projecting them.

The liquid header 30 includes the first liquid-side member 31, the second liquid-side member 32, the third liquid-side member 33, the fourth liquid-side member 34, the fifth liquid-side member 35, the sixth liquid-side member 36, and the seventh liquid-side member 37. The liquid header 30 is constituted by joining the first liquid-side member 31, the second liquid-side member 32, the third liquid-side member 33, the fourth liquid-side member 34, the fifth liquid-side member 35, the sixth liquid-side member 36, and the seventh liquid-side member 37 to each other by brazing.

Note that it is desirable that the first liquid-side member 31, the third liquid-side member 33, the fourth liquid-side member 34, the fifth liquid-side member 35, the sixth liquid-side member 36, and the seventh liquid-side member 37 be constituted to have a plate thickness of 3 mm or less. It is desirable that the first liquid-side member 31, the second liquid-side member 32, the third liquid-side member 33, the fourth liquid-side member 34, the fifth liquid-side member 35, the sixth liquid-side member 36, and the seventh liquid-side member 37 each be a member having a thickness in a plate-thickness direction that is shorter than a length in a vertical direction and that is shorter than a length in a left-right direction. The first liquid-side member 31, the third liquid-side member 33, the fourth liquid-side member 34, the fifth liquid-side member 35, the sixth liquid-side member 36, and the seventh liquid-side member 37 are stacked in a stacking direction (an example of the first direction), which is the plate-thickness direction.

The liquid header 30 has a substantially quadrilateral shape having a connection portion with the flat tubes 28 as one side.

(4-1) First Liquid-Side Member

The first liquid-side member 31 is primarily a member that, together with the seventh liquid-side member 37 described below, constitutes the periphery of the external shape of the liquid header 30. It is desirable that the first liquid-side member 31 have a clad layer formed on a surface thereof, the clad layer having a brazing material.

The first liquid-side member 31 includes a liquid-side flat-tube connection plate 31*a* (an example of the first plate-shaped portion), a first liquid-side outer wall 31*b*, a second liquid-side outer wall 31*c*, a first liquid-side claw portion 31*d*, and a second liquid-side claw portion 31*e*.

Although not limited, the first liquid-side member 31 of one or more embodiments can be formed by bending one metal plate obtained by rolling with the longitudinal direction of the liquid header 30 being a direction of fold. In this case, the plate thickness of each portion of the first liquid-side member 31 is uniform.

The liquid-side flat-tube connection plate 31*a* is a flat-shaped portion extending in the up-down direction and in the left-right direction. A plurality of liquid-side flat-tube connection openings 31*x* disposed side by side in the up-down direction are formed in the liquid-side flat-tube connection plate 31*a*. Each liquid-side flat-tube connection opening 31*x* is a through opening in the thickness direction of the liquid-side flat-tube connection plate 31*a*. With the flat tubes 28 being inserted in the liquid-side flat-tube connection openings 31*x* such that one end of each flat tube 28 passes completely through a corresponding one of the liquid-side flat-tube connection openings 31*x*, the flat tubes 28 are joined to the liquid-side flat-tube connection openings 31*x* by brazing. In the joined state realized by brazing, the entire inner peripheral surface of each liquid-side flat-tube connection opening 31*x* and the entire outer peripheral surface of each flat tube 28 are in contact with each other. Here, since the thickness of the first liquid-side member 31 including the liquid-side flat-tube connection plate 31*a* is relatively small, such as on the order of 1.0 mm or greater and 2.0 mm or less, the length of the inner peripheral surface of each liquid-side flat-tube connection opening 31*x* in the plate-thickness direction can be short. Therefore, when, in a stage before the joining by brazing, the flat tubes 28 are inserted into the liquid-side flat-tube connection openings 31*x*, friction that is produced between the inner peripheral surfaces of the liquid-side flat-tube connection openings 31*x* and the outer peripheral surfaces of the flat tubes 28 can be kept low, and the insertion operation can be facilitated.

The first liquid-side outer wall 31*b* is a flat-shaped portion extending toward a front side from a front surface of an end portion on a left side (outer side of the outdoor unit 2, side opposite to the gas header 70) of the liquid-side flat-tube connection plate 31*a*.

The second liquid-side outer wall 31*c* is a flat-shaped portion extending toward the front side from a front surface of an end portion on a right side (inner side of the outdoor unit 2, side of the gas header 70) of the liquid-side flat-tube connection plate 31*a*.

The first liquid-side claw portion 31*d* is a portion extending toward the right from a front end portion of the first liquid-side outer wall 31*b*. The second liquid-side claw portion 31*e* is a portion extending toward the left from a front end portion of the second liquid-side outer wall 31*c*.

In a state before the second liquid-side member 32, the third liquid-side member 33, the fourth liquid-side member 34, the fifth liquid-side member 35, the sixth liquid-side member 36, and the seventh liquid-side member 37 are disposed on an inner side of the first liquid-side member 31 in plan view, the first liquid-side claw portion 31*d* and the second liquid-side claw portion 31*e* are each in an extended state on an extension line of a corresponding one of the first liquid-side outer wall 31*b* and the second liquid-side outer wall 31*c*. In a state in which the second liquid-side member 32, the third liquid-side member 33, the fourth liquid-side member 34, the fifth liquid-side member 35, the sixth liquid-side member 36, and the seventh liquid-side member 37 are disposed on the inner side of the first liquid-side member 31 in plan view, the first liquid-side claw portion 31*d* and the second liquid-side claw portion 31*e* are bent toward each other to crimp the second liquid-side member 32, the third liquid-side member 33, the fourth liquid-side member 34, the fifth liquid-side member 35, the sixth liquid-side member 36, and the seventh liquid-side member 37 by the first liquid-side member 31, as a result of which they are fixed to each other. When, in this state, brazing is performed, for example, inside a furnace, the members are joined to each other by brazing and are completely fixed to each other.

(4-2) Second Liquid-Side Member

The second liquid-side member 32 includes a plate-shaped base portion 32*a* and a plurality of protrusions 32*b* that protrude toward the liquid-side flat-tube connection plate 31*a* from the base portion 32*a*. The second liquid-side member 32 may not have a clad layer formed on a surface thereof, the clad layer having a brazing material.

The base portion 32*a* extends parallel to the liquid-side flat-tube connection plate 31*a* and has a plate shape in which the direction of extension of the flat tubes 28 is the plate-thickness direction. The width of the base portion 32*a* in the left-right direction is the same as the width of a portion of the liquid-side flat-tube connection plate 31*a* in the left-right direction excluding the two end portions. A plurality of communication holes 32*x* provided side by side in the up-down direction are formed in a one-to-one correspondence with the flat tubes 28 at positions in the base portion 32*a* other than the positions where the protrusions 32*b* are provided. When viewed from the back, the communication holes 32*x* have shapes that are substantially the same as those of the end portions of the flat tubes 28.

The protrusions 32*b* extend in the horizontal direction up to where they come into contact with a front surface of the liquid-side flat-tube connection plate 31*a* by extending toward the back from portions of the base portion 32*a* between the communication holes 32*x* adjacent to each other. Therefore, there are formed insertion spaces 32*s* surrounded by the front surface of the liquid-side flat-tube connection plate 31*a* of the first liquid-side member 31, the first liquid-side outer wall 31*b* and the second liquid-side outer wall 31*c* of the first liquid-side member 31, the protrusions 32*b* that are adjacent to each other in the up-down direction of the second liquid-side member 32, and portions of a back surface of the base portion 32*a* of the second liquid-side member 32 other than the communication holes 32*x*. The insertion spaces 32*s* are provided side by side in the longitudinal direction of the liquid header 30. An end portion of each flat tube 28 is positioned in each insertion space 32*s*. Note that the lengths of the protrusions 32*b* in the front-back direction are adjusted to be larger than the plate thickness of any one of the first liquid-side member 31, the third liquid-side member 33, the fourth liquid-side member 34, the fifth liquid-side member 35, the sixth liquid-side member 36, and the seventh liquid-side member 37 that constitute the liquid header 30. Therefore, even if an error occurs in the amount of insertion of the flat tubes 28 into the liquid header 30, as long as the error is within a range of the lengths of the protrusions 32*b* in the front-back direction, blockages or difficulty flowing, such as portions at which a flow of a refrigerant is blocked or portions at which a refrigerant has difficulty flowing being formed when the liquid header 30 has been completed, are less likely to occur. It is also possible to suppress a brazing material from moving due to a capillary action when the members are joined by brazing, and to thus suppress the brazing material from closing the refrigerant passages 28*b* of the flat tubes 28.

(4-3) Third Liquid-Side Member

The third liquid-side member 33 is a member that is stacked on a surface on a front side (side at which the branch liquid-refrigerant connection pipes 49*a* to 49*e* and the liquid header 30 are connected to each other) of the base portion 32*a* of the second liquid-side member 32 so as to face and contact this surface. The length of the third liquid-side member 33 in the left-right direction is the same as the length of the second liquid-side member 32 in the left-right direction. It is desirable that the third liquid-side member 33 have a clad layer formed on a surface thereof, the clad layer having a brazing material.

The third liquid-side member 33 (an example of the sixth member) includes a third internal plate 33*a* (an example of the sixth plate-shaped portion) and a plurality of flow dividing openings 33*x* (an example of the fifth openings).

The third internal plate 33*a* has a flat shape extending in the up-down direction and in the left-right direction.

The plurality of flow dividing openings 33*x* are disposed side by side in the up-down direction, and are through openings in the plate-thickness direction of the third internal plate 33*a*. In one or more embodiments, each flow dividing opening 33*x* is formed near the center of the third internal plate 33*a* in the left-right direction. When viewed from the back, each flow dividing opening 33*x* overlaps a corresponding one of the communication holes 32*x* of the second liquid-side member 32 and communicates with each other. Therefore, a refrigerant that flows in an ascending space 34*z* (described below) can be branched toward each of the flow dividing openings 33*x* and caused to flow, and the refrigerant can be divided with respect to each flat tube 28 connected to a corresponding one of the flow dividing openings 33*x*.

Note that, of a front surface of the third internal plate 33*a*, a surface thereof other than where the flow dividing openings 33*x* are formed forms the contour of the ascending space 34*z* (described below).

(4-4) Fourth Liquid-Side Member

The fourth liquid-side member 34 is a member that is stacked on a surface on a front side (side at which the branch liquid-refrigerant connection pipes 49*a* to 49*e* and the liquid header 30 are connected to each other) of the third internal plate 33*a* of the third liquid-side member 33 so as to face and contact this surface. The length of the fourth liquid-side member 34 in the left-right direction is the same as the length of the third liquid-side member 33 in the left-right direction. The fourth liquid-side member 34 may not have a clad layer formed on a surface thereof, the clad layer having a brazing material.

The fourth liquid-side member 34 (an example of the third member) includes a fourth internal plate 34*a* (an example of the third plate-shaped portion) and a first penetration portion 34*o* (an example of the first opening).

The fourth internal plate 34*a* has a flat shape extending in the up-down direction and in the left-right direction.

The first penetration portion 34*o* is an opening extending through the fourth internal plate 34*a* in the plate-thickness direction, and has an introduction space 34*x* (an example of the first region), a nozzle 34*y* (an example of the second region), and the ascending space 34*z* (an example of the third region). In one or more embodiments, the introduction space 34*x*, the nozzle 34*y*, and the ascending space 34*z* are provided side by side in the vertical direction in this order from the bottom. In one or more embodiments, the widths of the introduction space 34*x*, the nozzle 34*y*, and the ascending space 34*z* in the front-back direction are the same.

The introduction space 34*x*, the nozzle 34*y*, and the ascending space 34*z* are spaces that are interposed in the front-back direction between the front surface of the third internal plate 33*a* of the third liquid-side member 33 and a back surface of a fifth internal plate 35*a* of the fifth liquid-side member 35 (described below).

The introduction space 34*x* faces a wall portion 33*aa* of the third internal plate 33*a* of the third liquid-side member 33, and, when viewed from the back, does not overlap the flow dividing openings 33*x* and does not communicate with the flow dividing openings 33*x*. Note that, when viewed from the back, the introduction space 34*x* overlaps a second connection opening 35*x* of the fifth liquid-side member 35 (described below) and communicates with the second connection opening 35*x*. In this way, since a back side of the introduction space 34*x* is covered by the wall portion 33*aa* of the third internal plate 33*a*, a gas-phase refrigerant and a liquid-phase refrigerant that have flowed into the introduction space 34*x* can be mixed by colliding with the wall portion 33*aa*, and a refrigerant in which the gas-phase refrigerant and the liquid-phase refrigerant are in a mixed state can be sent to the nozzle 34*y*.

The nozzle 34*y* faces the third internal plate 33*a* of the third liquid-side member 33, and, when viewed from the back, does not overlap the flow dividing openings 33*x* and does not communicate with the flow dividing openings 33*x*. Note that the nozzle 34*y* faces the fifth internal plate 35*a* of the fifth liquid-side member 35 (described below), and, when viewed from the back, does not overlap the second connection opening 35*x*, a return flow path 35*y*, and an outward flow path 35*z*, and does not communicate with them.

The ascending space 34*z* faces the third internal plate 33*a* of the third liquid-side member 33, and, when viewed from the back, overlaps the plurality of flow dividing openings 33*x* and communicates with the plurality of flow dividing openings 33*x*. Note that the ascending space 34*z* faces the fifth internal plate 35*a* of the fifth liquid-side member 35 (described below), and, when viewed from the back, does not overlap the second connection opening 35*x*, and overlaps the return flow path 35*y* and the outward flow path 35*z*. The ascending space 34*z* does not communicate with the second connection opening 35*x* and communicates with the return flow path 35*y* and the outward flow path 35*z*. Note that the length of the ascending space 34*z* in the longitudinal direction of the liquid header 30 is longer than the length of the introduction space 34*x* in the longitudinal direction of the liquid header 30 and is longer than the length of the nozzle 34*y* in the longitudinal direction of the liquid header 30. Therefore, it is possible to increase the number of flat tubes 28 that are made to communicate via the ascending space 34*z*.

Note that, in the ascending space 34*z*, a refrigerant flow path in which a refrigerant flows so as to be blown in the longitudinal direction of the liquid header 30 can be constituted by the front surface of the third internal plate 33*a* of the third liquid-side member 33, the back surface of the fifth internal plate 35*a* of the fifth liquid-side member 35 (described below), and thick portions of left and right edges of the first penetration portion 34*o* of the fourth internal plate 34*a* of the fourth liquid-side member 34. Therefore, the structure is one that makes it less likely for errors in a flow-path cross-sectional area caused by manufacturing to occur, and that makes it easier to obtain the liquid header 30 that allows a refrigerant to stably move upward and flow.

Here, the length of the nozzle 34*y* in the left-right direction (a direction that is perpendicular to the longitudinal direction of the liquid header 30 and that is perpendicular to the direction of extension of the flat tubes 28 (an example of the third direction) is shorter than the length of the introduction space 34*x* in the left-right direction and shorter than the length of the ascending space 34*z* in the left-right direction. Therefore, when the outdoor heat exchanger 11 is used as an evaporator of a refrigerant, a refrigerant that has been sent to the introduction space 34*x* has its flow velocity increased when passing through the nozzle 34*y* and easily reaches an upper portion of the ascending space 34*z*. Note that, since the width of the ascending space 34*z* in the left-right direction is narrower than the width of the introduction space 34*x* in the left-right direction and a passage cross-sectional area of a refrigerant in the ascending space 34*z* can be decreased, the flow velocity of the refrigerant that flows upward in the ascending space 34*z* can be kept high.

Here, the nozzle 34*y* is provided near the center of the fourth internal plate 34*a* in the left-right direction. In the left-right direction that is perpendicular to the longitudinal direction of the liquid header 30 and that is perpendicular to the plate-thickness direction of the fourth internal plate 34*a*, the width of the nozzle 34*y* is larger than the plate thickness of the fourth internal plate 34*a*. Therefore, an opening width can be made larger than the plate thickness. Therefore, for example, when the first penetration portion 34*o* is to be formed in the fourth internal plate 34*a* by a punching operation, it is possible to reduce the load applied to a punch portion corresponding to the nozzle 34*y* and to suppress damage to the punch portion.

When viewed in the front-back direction, a corresponding one of the branch liquid-refrigerant connection pipes 49*a* to 49*e* is connected at the center in the left-right direction of the introduction space 34*x*. When viewed in the front-back direction, a connection portion between the introduction space 34*x* and the corresponding one of the branch liquid-refrigerant connection pipes 49*a* to 49*e*, the nozzle 34*y*, and the ascending space 34*z* are disposed side by side in the vertical direction. Therefore, a refrigerant that has flowed in the corresponding one of the branch liquid-refrigerant connection pipes 49*a* to 49*e* flows into the center in the left-right direction of the introduction space 34*x* via an external liquid-pipe connection opening 37*x*, a first connection opening 36*x*, and a second connection opening 35*x*, and can be blown vertically upward toward the ascending space 34*z* via the nozzle 34*y* from the introduction space 34*x* without moving in the left-right direction or without moving very much in the left-right direction. Note that, for example, when a structure is one in which a refrigerant in a region of the introduction space 34*x* located toward the left side flows in, the refrigerant that passes through the nozzle 34*y* is deflected and flows in an upper right direction, whereas, when a structure is one in which a refrigerant in a region of the introduction space 34*x* located toward the right side flows in, the refrigerant that passes through the nozzle 34*y* may be deflected and may flow in an upper left direction. However, in the structure of one or more embodiments, such deflections can be suppressed.

Note that, when viewed from the back, the plurality of flow dividing openings 33*x* of the third liquid-side member 33 are positioned to overlap a range of a virtual region (region interposed between virtual lines VL in FIG. 14 from the left and right) obtained by extending in a virtual manner the nozzle 34*y* in the longitudinal direction of the liquid header 30. When the outdoor heat exchanger 11 functions as an evaporator of a refrigerant, although a refrigerant that has passed through the nozzle 34*y* has its flow velocity increased and flows upward, a liquid refrigerant tends to be retained in spaces of the ascending space 34*z* situated slightly to the upper left and the upper right of the nozzle 34*y*. In contrast, by disposing the plurality of flow dividing openings 33*x* and the nozzle 34*y* in the arrangement relationship above, it is possible to prevent the liquid refrigerant from flowing in a concentrated manner with respect to the lowest flow dividing opening 33*x* among the flow dividing openings 33*x* that communicate with the ascending space 34*z*.

(4-5) Fifth Liquid-Side Member

The fifth liquid-side member 35 is a member that is stacked on a surface on a front side (side at which the branch liquid-refrigerant connection pipes 49*a* to 49*e* and the liquid header 30 are connected to each other) of the fourth internal plate 34*a* of the fourth liquid-side member 34 so as to face and contact this surface. The length of the fifth liquid-side member 35 in the left-right direction is the same as the length of the fourth liquid-side member 34 in the left-right direction. It is desirable that the fifth liquid-side member 35 have a clad layer formed on a surface thereof, the clad layer having a brazing material.

The fifth liquid-side member 35 (an example of the fifth member) includes the fifth internal plate 35*a* (an example of the fifth plate-shaped portion), the second connection opening 35*x* (an example of the seventh opening), the return flow path 35*y* (an example of the fourth opening), and the outward flow path 35*z* (an example of the third opening).

The fifth internal plate 35*a* has a flat shape extending in the up-down direction and in the left-right direction.

The second connection opening 35*x*, the return flow path 35*y*, and the outward flow path 35*z* are openings that are independently disposed side by side in this order from the bottom, and are through openings in a plate-thickness direction of the fifth internal plate 35*a*.

When viewed from the back, the second connection opening 35*x* overlaps the introduction space 34*x* of the first penetration portion 34*o* of the fourth liquid-side member 34, and communicates therewith. When viewed from the back, the second connection opening 35*x* overlaps the first connection opening 36*x* of the sixth liquid-side member 36 (described below) and communicates therewith. When viewed from the back, the second connection opening 35*x* does not overlap the nozzle 34*y* and the ascending space 34*z* of the first penetration portion 34*o* of the fourth liquid-side member 34, and does not communicate therewith. When viewed from the back, the second connection opening 35*x* does not overlap a descending space 36*y* of the sixth liquid-side member 36 (described below), and does not communicate therewith.

When viewed from the back, the return flow path 35*y* overlaps a portion near a lower end of the ascending space 34*z* of the first penetration portion 34*o* of the fourth liquid side member 34, and communicates with the portion near the lower end of the ascending space 34*z*. Note that, when viewed from the back, the return flow path 35*y* does not overlap the nozzle 34*y* and does not communicate with the nozzle 34*y*.

When viewed from the back, the outward flow path 35*z* overlaps a portion near an upper end of the ascending space 34*z* of the first penetration portion 34*o* of the fourth liquid side member 34, and communicates with the portion near the upper end of the ascending space 34*z*. Note that, in one or more embodiments, when the liquid header 30 is viewed from the stacking direction of each member, the area of the outward flow path 35*z* is larger than the area of the return flow path 35*y*. Specifically, in one or more embodiments, the width of the outward flow path 35*z* in the longitudinal direction of the liquid header 30 is larger than the width of the return flow path 35*y* in the longitudinal direction of the liquid header 30. Therefore, a refrigerant that has moved upward in the ascending space 34*z* and reached the vicinity of the upper end of the ascending space 34*z* easily passes through the outward flow path 35*z*. In one or more embodiments, when the liquid header 30 is viewed from the stacking direction of each member, the area of the return flow path 35*y* is smaller than the area of the outward flow path 35*z*. Specifically, in one or more embodiments, the width of the return flow path 35*y* in the longitudinal direction of the liquid header 30 is smaller than the width of the outward flow path 35*z* in the longitudinal direction of the liquid header 30. Therefore, it is possible to suppress a refrigerant from flowing in a reverse direction to the return flow path 35*y* from the ascending space 34*z*.

(4-6) Sixth Liquid-Side Member

The sixth liquid-side member 36 is a member that is stacked on a surface on a front side (side at which the branch liquid-refrigerant connection pipes 49*a* to 49*e* and the liquid header 30 are connected to each other) of the fifth internal plate 35*a* of the fifth liquid-side member 35 so as to face and contact this surface. The length of the sixth liquid-side member 36 in the left-right direction is the same as the length of the fifth liquid-side member 35 in the left-right direction. The sixth liquid-side member 36 may not have a clad layer formed on a surface thereof, the clad layer having a brazing material.

The sixth liquid-side member 36 (an example of the fourth member) includes a sixth internal plate 36*a* (an example of the fourth plate-shaped portion), the first connection opening 36*x* (an example of the sixth opening), and the descending space 36*y* (an example of the second opening).

The sixth internal plate 36*a* has a flat shape extending in the up-down direction and in the left-right direction.

The first connection opening 36*x* and the descending space 36*y* are openings that are independently disposed side by side in this order from the bottom, and are through openings in a plate-thickness direction of the sixth internal plate 36*a*.

When viewed from the back, the first connection space 36*x* overlaps the second connection opening 35*x* of the fifth liquid-side member 35 and communicates therewith. When viewed from the back, the first connection opening 36*x* overlaps the external liquid-pipe connection opening 37*x* of the seventh liquid-side member 37 (described below) and communicates therewith.

When viewed from the back, the descending space 36*y* overlaps a part of the fifth internal plate 35*a* of the fifth liquid-side member 35, the return flow path 35*y*, and the outward flow path 35*z*, and communicates with the return flow path 35*y* and the outward flow path 35*z*. Note that, when viewed from the back, the descending space 36*y* does not overlap the external liquid-pipe connection opening 37*x* of the seventh liquid-side member 37 (described below), and does not communicate therewith.

In the longitudinal direction of the liquid header 30, the length of the descending space 36*y* is the same as the length of the ascending space 34*z*, and the descending space 36*y* and the ascending space 34*z* communicate near upper ends of the ascending space 34*z* and the descending space 36*y* via the outward flow path 35*z* and communicate near lower ends of the ascending space 34*z* and the descending space 36*y* via the return flow path 35*y*. Note that the width of the descending space 36*y* in the left-right direction is larger than the width of the ascending space 34*z* in the left-right direction. Therefore, it is possible to reduce pressure loss when a refrigerant passes in the descending space 36*y*, while suppressing a reduction in the flow velocity when a refrigerant moves upward and flows in the ascending space 34*z*.

(4-7) Seventh Liquid-Side Member

The seventh liquid-side member 37 is a member that is stacked on a surface on a front side (side at which the branch liquid-refrigerant connection pipes 49*a* to 49*e* and the liquid header 30 are connected to each other) of the sixth internal plate 36*a* of the sixth liquid-side member 36 so as to face and contact this surface. The length of the seventh liquid-side member 37 in the left-right direction is the same as the length of the sixth liquid-side member 36 in the left-right direction. It is desirable that the seventh liquid-side member 37 have a clad layer formed on a surface thereof, the clad layer having a brazing material.

The seventh liquid-side member 37 (an example of the second member) includes a liquid-side external plate 37*a* (an example of the second plate-shaped portion) and the external liquid-pipe connection opening 37*x*.

The liquid-side external plate 37*a* has a flat shape extending in the up-down direction and in the left-right direction.

The external liquid-pipe connection opening 37*x* is a through opening in a plate-thickness direction of the liquid-side external plate 37*a*. When viewed from the back, the external liquid-pipe connection opening 37*x* overlaps a part of the first connection opening 36*x* of the sixth liquid-side member 36 and communicates therewith. Note that, when viewed from the back, the external liquid-pipe connection opening 37*x* does not overlap the descending space 36*y* of the sixth liquid-side member 36, and does not communicate therewith.

The external liquid-pipe connection opening 37*x* is a circular opening to which any one of the branch liquid-refrigerant connection pipes 49*a* to 49*e* is inserted and connected. Therefore, when the outdoor heat exchanger 11 functions as an evaporator of a refrigerant, a refrigerant that flows in each of the branch liquid-refrigerant connection pipes 49*a* to 49*e* is sent to the introduction space 34*x* of a corresponding one of the first penetration portions 34*o* via a corresponding one of the first connection openings 36*x* and a corresponding one of the second connection openings 35*x*.

Note that a front surface of the seventh liquid-side member 37 is in contact with and crimped to the first liquid-side claw portion 31*d* and the second liquid-side claw portion 31*e* of the first liquid-side member 31.

(4-8) Repetition of Shapes of Sub-Spaces

Note that, in the description above, among the plurality of sub-spaces 23*a* to 23*e* that constitute the liquid-side internal space 23 of the liquid header 30, one of the sub-spaces 23*a* to 23*e* to which one of the branch liquid-refrigerant connection pipes 49*a* to 49*e* is connection is focused upon and described.

Therefore, for example, in the seventh liquid-side member 37, external liquid-pipe connection openings 37*x* for the respective branch liquid-refrigerant connection pipes 49*a* to 49*e* are formed side by side in the longitudinal direction of the liquid header 30 in one liquid-side external plate 37*a*. Similarly, in the fourth liquid-side member 34, first penetration portions 34*o* each including an introduction space 34*x*, a nozzle 34*y*, and an ascending space 34*z* are formed side by side in the longitudinal direction of the liquid header 30 in one fourth internal plate 34*a*.

(5) Flow of Refrigerant in Liquid Header

A flow of a refrigerant in the liquid header 30 when the outdoor heat exchanger 11 functions as an evaporator of the refrigerant is described below. Note that, when the outdoor heat exchanger 11 functions as a condenser or a heat dissipater of the refrigerant, the flow is in a direction substantially opposite to that when the outdoor heat exchanger 11 functions as an evaporator.

First, a liquid refrigerant or a refrigerant in a gas-liquid two-phase state that has flowed by being divided by the plurality of flow dividing pipes 22*a* to 22*e* of the distributor 22 flows in the branch liquid-refrigerant connection pipes 49*a* to 49*e* to pass through the external liquid-pipe connection openings 37*x* of the liquid-side external plate 37*a* of the seventh liquid-side member 37 and to flow into the sub-spaces 23*a* to 23*e* of the liquid header 30.

Specifically, the refrigerant flows into the first connection openings 36*x* at the respective sub-spaces 23*a* to 23*e*.

The refrigerant that has flowed into the first connection openings 36*x* flows into the introduction spaces 34*x* of the first penetration portions 34*o* of the fourth liquid-side member 34 via the second connection openings 35*x*.

The refrigerant that has flowed into the introduction spaces 34*x* has its velocity increased when the refrigerant passes through the nozzles 34*y*, and moves upward in the ascending spaces 34*z*. Note that, even if a refrigerant circulation amount of the refrigerant circuit 6 is small, such as even if a driving frequency of the compressor 8 is low, by causing the width of the ascending spaces 34*z* in the left-right direction to be narrower than the introduction spaces 34*x*, a refrigerant that has flowed into each ascending spaces 34*z* easily reaches the flow dividing openings 33*x* that are positioned near the upper end of the corresponding ascending space 34*z*. Here, the refrigerant that has flowed into each ascending space 34*z* moves to the vicinity of the upper end of each the ascending space 34*z* while being divided and flowing toward the flow dividing openings 33*x*. Note that, when the refrigerant circulation amount of the refrigerant circuit 6 is large, such as when the driving frequency of the compressor 8 is high, the amount of refrigerant that reaches the vicinity of the upper end of each ascending space 34*z* is large, and the refrigerant reaches the corresponding descending space 36*y* via the corresponding outward flow path 35*z*. The refrigerant that has reached each descending space 36*y* moves downward and is returned again to a space above the corresponding nozzle 34*y* near a lower portion of the corresponding ascending space 34*z* via the corresponding return flow path 35*y*. Here, in each ascending space 34*z*, since the flow velocity of the refrigerant is increased as a result of passing through the corresponding nozzle 34*y*, the static pressure is lower at a portion of each ascending space 34*z* near the corresponding return flow path 35*y* than at a portion of the corresponding descending space 36*y* near the corresponding return flow path 35*y*. Therefore, the refrigerant that has moved down each descending space 36*y* easily returns to the corresponding ascending space 34*z* via the corresponding return flow path 35*y*. In this way, since it is possible to circulate the refrigerant by using each ascending space 34*z*, each outward flow path 35*z*, each descending space 36*y*, and each return flow path 35*y*, even if there is a refrigerant that has not flowed by being divided by any one of the flow dividing openings 33*x* when the refrigerant moves upward and flows in each ascending space 34*z*, the refrigerant can be returned again to each ascending space 34*z* via the corresponding outward flow path 35*z*, the corresponding descending space 36*y*, and the corresponding return flow path 35*y*. Therefore, the refrigerant easily flows in any one of the flow dividing openings 33*x*.

As described above, the refrigerant that has flowed by being divided by the flow dividing openings 33*x* flows into the flat tubes 28 via the insertion spaces 32*s* while being kept divided.

(6) Features of Embodiments (6-1)

In the liquid header 30 of the outdoor heat exchanger 11 of one or more embodiments, the length of each nozzle 34*y* in the left-right direction is shorter than the length of the corresponding introduction space 34*x* in the left-right direction and is shorter than the length of the corresponding ascending space 34*z* in the left-right direction. Therefore, in terms of a flow-path cross-sectional area with respect to the refrigerant passage direction, which is the longitudinal direction of the liquid header 30, each nozzle 34*y* is smaller than the corresponding introduction space 34*x* and is smaller than the corresponding ascending space 34*z*.

Therefore, when the outdoor heat exchanger 11 functions as an evaporator of a refrigerant, the refrigerant that passes through each nozzle 34*y* has its flow velocity increased and flows into the corresponding ascending space 34*z*. Consequently, it is possible to sufficiently guide the refrigerant also to, among the plurality of flow dividing openings 33*x* that communicate with a corresponding one of the ascending spaces 34*z*, the flow dividing openings 33*x* that are positioned far away above a corresponding one of the nozzles 34*y*. Thus, deflected flows of the refrigerant between the plurality of flat tubes 28 that communicate with the same ascending space 34*z* can be kept small.

Moreover, as described above, the structure that narrows a flow path for blowing a refrigerant in the longitudinal direction of the liquid header 30, which is the direction in which the flat tubes 28 are disposed side by side, can be realized by one fourth liquid-side member 34. Therefore, it no longer becomes necessary to provide, as a new member different from a member for forming an internal space, a plate-shaped member in which a nozzle is formed while the internal space is partitioned into one side and the other side in the longitudinal direction of the liquid header, as has been provided in liquid headers known in the art.

Since, in the liquid header 30 of one or more embodiments, the structure above can be realized by only merely stacking each member in the plate-thickness direction, the structure can be easily manufactured.

(6-2)

In the liquid header 30 of the outdoor heat exchanger 11 of one or more embodiments, since the refrigerant that has flowed to each ascending space 34*z* from the corresponding nozzle 34*y* has its flow velocity increased while moving upward, it is possible to supply the refrigerant even to the flow dividing openings 33*x* that communicate with the upper portion of a corresponding one of the ascending spaces 34*z*. Further, since the width of each ascending space 34*z* in the left-right direction is narrower than the width of the corresponding introduction space 34*x* in the left-right direction, and a refrigerant passage area of each ascending space 34*z* is small, even when the circulation amount of a refrigerant in the refrigerant circuit 6 is small, it is possible to suppress a reduction in the refrigerant flow velocity of the refrigerant on the upper side that flows in each ascending space 34*z* and to sufficiently supply the refrigerant even to the flow dividing openings 33*x* at the upper portion of a corresponding one of the ascending spaces 34*z*.

Each ascending space 34*z* communicates, near the upper end thereof, with the corresponding descending space 36*y* via the corresponding outward flow path 35*z*. Further, each descending space 36*y* communicates, near the lower end thereof, with the corresponding ascending space 34*z* via the corresponding return flow path 35*y*. Therefore, even if the circulation amount of the refrigerant in the refrigerant circuit 6 is large and a large amount of refrigerant is supplied to the vicinity of the upper end of each ascending space 34*z*, it is possible to return again the refrigerant to each ascending space 34*z* and guide the refrigerant to the flow dividing openings 33*x* via the corresponding outward flow path 35*z*, the corresponding descending space 36*y*, and the corresponding return flow path 35*y*.

Consequently, even if the longitudinal direction of the liquid header 30 when the outdoor heat exchanger 11 is constructed is the vertical direction, it is possible to suppress deflected flows of the refrigerant between the flat tubes 28 in the up-down direction.

(6-3)

In the liquid header 30 of the outdoor heat exchanger 11 of one or more embodiments, the flat tubes 28 are connected on a side close to a corresponding one of the ascending spaces 34*z* instead of on a side close to a corresponding one of the descending spaces 36*y*. Therefore, when the outdoor heat exchanger 11 functions as an evaporator of a refrigerant, since a refrigerant that flows in each ascending space 34*z* easily flows to be drawn toward the plurality of flow dividing openings 33*x*, a reverse flow of a refrigerant in each return flow path 35*y* (a flow toward each descending space 36*y* via the corresponding return flow path 35*y* from the corresponding ascending space 34*z*) can be suppressed.

(6-4)

In the liquid header 30 of the outdoor heat exchanger 11 of one or more embodiments, the branch liquid-refrigerant connection pipes 49*a* to 49*e* and the introduction spaces 34*x* communicate with each other via the first connection openings 36*x* of the sixth liquid-side member 36 and the second connection openings 35*x* of the fifth liquid-side member 35.

Therefore, by using the fifth liquid-side member 35, in which the outward flow paths 35*z* and the return flow paths 35*y* are formed, and the sixth liquid-side member 36, in which the descending spaces 36*y* are formed, the fifth liquid-side member 35 and the sixth liquid-side member 36 being provided for circulating a refrigerant in the liquid header 30, the branch liquid-refrigerant connection pipes 49*a* to 49*e* and the introduction spaces 34*x* can be made to communicate with each other.

(6-5)

In the liquid header 30 of the outdoor heat exchanger 11 of one or more embodiments, the first liquid-side member 31, the third liquid-side member 33, the fourth liquid-side member 34, the fifth liquid-side member 35, the sixth liquid-side member 36, and the seventh liquid-side member 37 have a plate thickness of 3 mm or less. Therefore, the through openings in the plate-thickness direction of the members can be easily formed by a pressing operation.

(6-6)

In a circular cylindrical header known in the art, when the entire end portions of the flat tubes, which are flat heat transfer tubes, are positioned in an internal space of the header, a large part of the flat tubes is placed in the circular cylindrical header, and useless space in which a refrigerant tends to be retained is formed above and below a portion of each flat tube that is positioned in the circular cylindrical header. In addition, since the inside diameter of the circular cylindrical header has at least a magnitude that contains the entire end portions of the flat tubes, the space in the circular cylindrical header tends to be large, and a passage cross-sectional area when a refrigerant is caused to flow in the header in an axial direction is increased, as a result of which it is difficult to increase the flow velocity of the refrigerant. This tendency becomes noticeable particularly when the length of a cross section of each flat tube in a longitudinal direction is large.

In contrast, a connection portion of the liquid header 30 of one or more embodiments with the flat tubes 28 is a surface that extends in a direction perpendicular to the longitudinal direction of the flat tubes 28, and has a substantially rectangular shape in plan view. Therefore, the shape can be one that does not easily give rise to the difficulty of increasing the flow velocity that may exist in the circular cylindrical header. In addition, since the insertion spaces 32*s*, in which the flat tubes 28 are inserted, and the ascending spaces 34*z* are separated by the plate-shaped base portion 32*a* of the second liquid-side member 32 and the third internal plate 33*a* of the third liquid-side member 33, useless space in which a refrigerant is retained is not easily formed. The magnitude a flow-path cross-sectional area of each ascending space 34*z* in which a refrigerant flows in the longitudinal direction of the liquid header 30 can be easily adjusted by only adjusting the plate thickness of a plate-shaped member or the size of an opening, and the flow velocity of the refrigerant can also be increased by reducing a passage cross-sectional area of the refrigerant.

(7) Modifications (7-1) Modification A

In the embodiments described above, the liquid header 30 in which, with respect to each ascending space 34*z*, the corresponding outward flow path 35*z*, the corresponding descending space 36*y*, and the corresponding return flow path 35*y* are provided on a side opposite to where the flat tubes 28 are connected has been given as an example and described.

Figure 18:
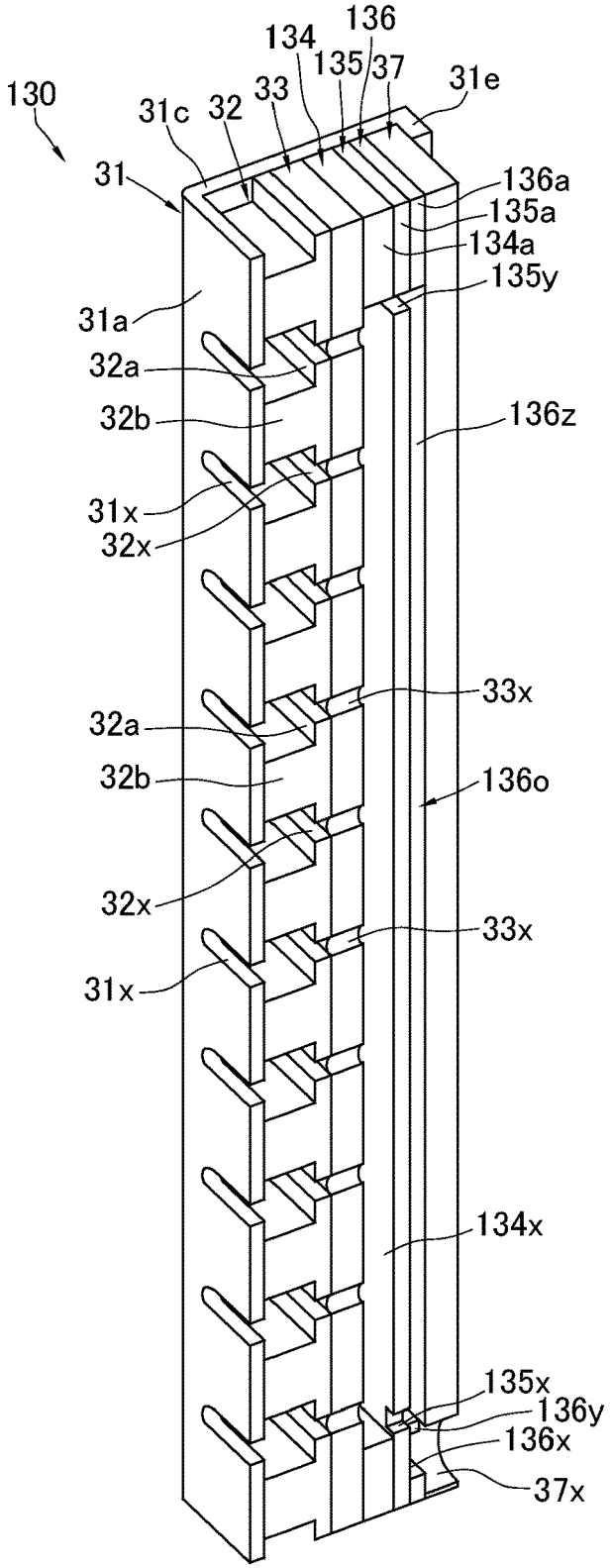
FIG. 18 is a sectional perspective view of a liquid header according to Modification A.

In contrast, as a liquid header, for example, as shown in FIG. 18, a liquid header 130 in which, with respect to each ascending space 136*z*, a corresponding outward flow path 135*y*, a corresponding descending space 134*x*, and a corresponding return flow path 135*x* are provided on a side where the flat tubes 28 are connected may be used.

Note that, in the liquid header 130 (an example of the header), the first liquid-side member 31, the second liquid-side member 32, the third liquid-side member 33, and the seventh liquid-side member 37 are the same as those of the embodiments described above, and are not described.

In place of the fourth liquid-side member 34, the fifth liquid-side member 35, and the sixth-liquid side member 36, the liquid header 130 includes an eighth liquid-side member 134 (an example of the fourth member), a ninth liquid-side member 135 (an example of the fifth member), and a tenth liquid-side member 136 (an example of the third member).

The eighth liquid-side member 134 is disposed to contact the third liquid-side member 33, and includes an eighth internal plate 134*a* (an example of the fourth plate-shaped portion) and each descending space 134*x* (an example of the second opening). The descending spaces 134*x* communicate with the plurality of flow dividing openings 33*x*.

The ninth liquid-side member 135 is disposed to contact the eighth liquid-side member 134, and includes a ninth internal plate 135*a* (an example of the fifth plate-shaped portion), each return flow path 135*x* (an example of the fourth opening), and each outward flow path 135*y* (an example of the third opening). Note that the shapes of and the relationships between the outward flow paths 135*y* and the return flow paths 135*x* are the same as the shapes of and the relationships between the outward flow paths 35*z* and the return flow paths 35*y* in the embodiments described above. The outward flow paths 135*y* communicate with the vicinities of upper ends of the ascending spaces 136*z* and the vicinities of upper ends of the descending spaces 134*x*, and the return flow paths 135*x* communicate with the vicinities of lower ends of the ascending spaces 136*z* and the vicinities of lower ends of the descending spaces 134*x*.

The tenth liquid-side member 136 is disposed to contact the ninth liquid-side member 135, and includes a tenth internal plate 136*a* (an example of the third plate-shaped portion) and first penetration portions 136*o* (an example of first openings). Each first penetration portion 136*o* includes, in order from the bottom, an introduction space 136*x* (an example of the first region), a nozzle 136*y* (an example of the second region), and the ascending space 136*z* (an example of the third region). Note that the shapes of and the relationships between the introduction spaces 136*x*, the nozzles 136*y*, and the ascending spaces 136*z* are the same as the shapes of and the relationships between the introduction spaces 34*x*, the nozzles 34*y*, and the ascending spaces 34*z* in the embodiments described above. Here, the introduction spaces 34*x* communicate with the external liquid-pipe connection openings 37*x* of the seventh liquid-side member 37.

In the structure above, when the outdoor heat exchanger 11 functions as an evaporator of a refrigerant, a refrigerant that has flowed into the liquid header 130 via the branch liquid-refrigerant connection pipes 49*a* to 49*e* flows into the introduction spaces 136*x*. The refrigerant that has been sent to the introduction spaces 136*x* has its flow velocity increased at the nozzles 136*y* and moves upward in the ascending spaces 136*z*. The refrigerant that has reached the vicinity of the upper end of each ascending space 136*z* reaches the corresponding descending space 134*x* via the corresponding outward flow path 135*y*. The refrigerant that has reached each descending space 134*x* is divided by the plurality of flow dividing openings 33*x* and flows while moving downward. The refrigerant that has reached the vicinity of the lower end of each descending space 134*x* without flowing in the flow dividing openings 33*x* is guided again to the corresponding ascending space 136*z* via the corresponding return flow path 135*x* and circulates.

Even in the liquid header 130 above, as in the embodiments described above, a refrigerant can be made to flow in the direction in which the plurality of flat tubes 28 are disposed side by side.

(7-2) Modification B

In the embodiments described above, the liquid header 30 of the outdoor heat exchanger 11 having a structure in which, by providing the outward flow paths 35*z*, the descending spaces 36*y*, and the return flow paths 35*y*, a refrigerant circulates and flows in the liquid header 30 has been given as an example and described.

Figure 19:
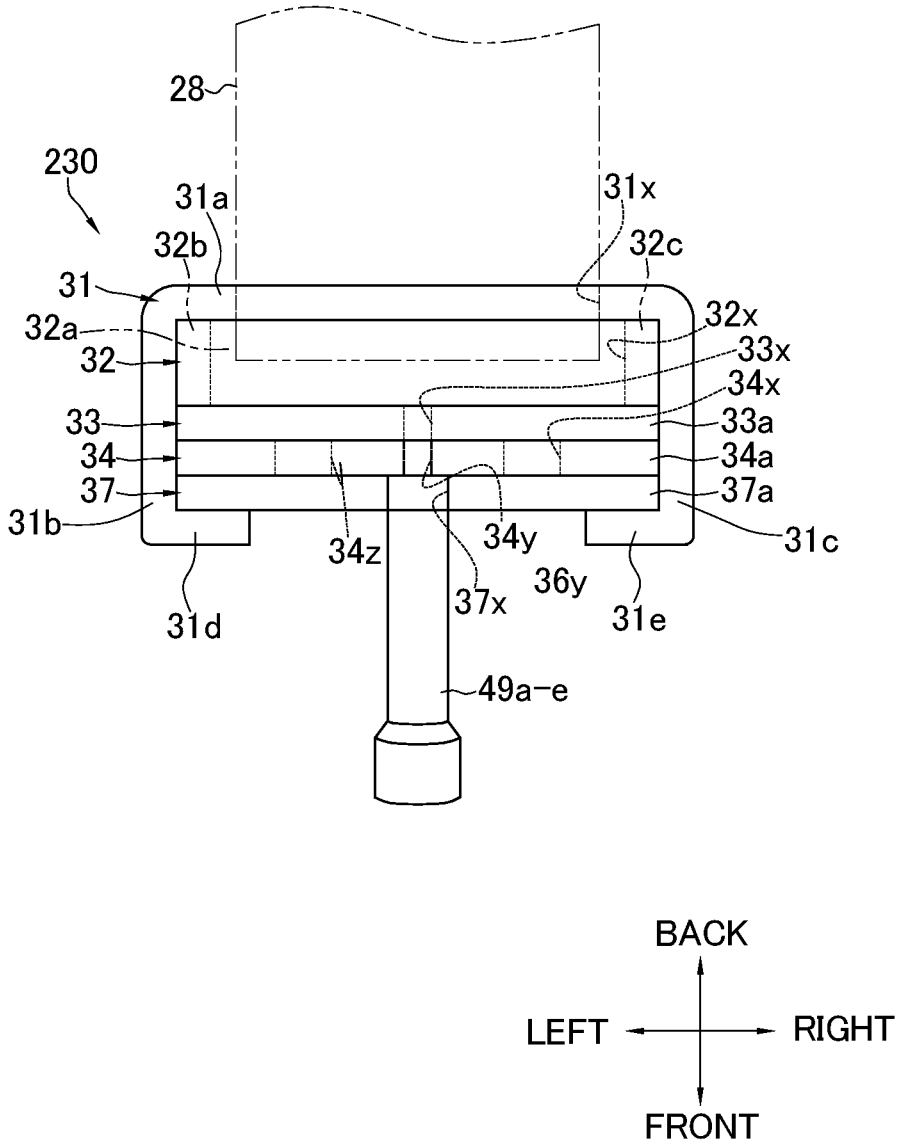
FIG. 19 is a plan sectional view showing a state of connection of the branch liquid-refrigerant connection pipes and the flat tubes with a liquid header according to Modification B.

In contrast, the liquid header is not limited to one in which a refrigerant circulates therein. For example, as shown in FIG. 19, the liquid header may be a liquid header 230 that does not include the fifth liquid-side member 35 and the sixth liquid-side member 36 of the embodiments described above and that includes the second liquid-side member 32, the third liquid-side member 33, the fourth liquid-side member 34, and the seventh liquid-side member 37 that are stacked on each other and that are crimped by the first liquid-side member 31.

Here, the external liquid-pipe connection openings 37*x* of the seventh liquid-side member 37 and the introduction spaces 34*x* of the fourth liquid-side member 34 directly communicate with each other, and the front sides of the ascending spaces 34*z* are covered by the liquid-side external plates 37*a* of the seventh liquid-side member 37.

In this form, although a refrigerant does not circulate in the liquid header 230, that, in each first penetration portion 34*o* of the fourth liquid-side member 34, a refrigerant can be made to flow in the direction in which the flat tubes 28 are disposed side by side is the same as the embodiments described above.

(7-3) Modification C

In the embodiments described above, the liquid header 30 having a structure in which a refrigerant is made to circulate and flow at the plurality of plate-shaped portions constituted by the third liquid-side member 33, the fourth liquid-side member 34, and the fifth liquid-side member 35, which constitute the liquid header 30, has been given as an example and described.

In contrast, in place of the liquid header 30 above, a liquid header 40 having a structure that allows a refrigerant to circulate in one plate-shaped portion instead of in the plurality of plate-shaped portions may be used.

Figure 20:
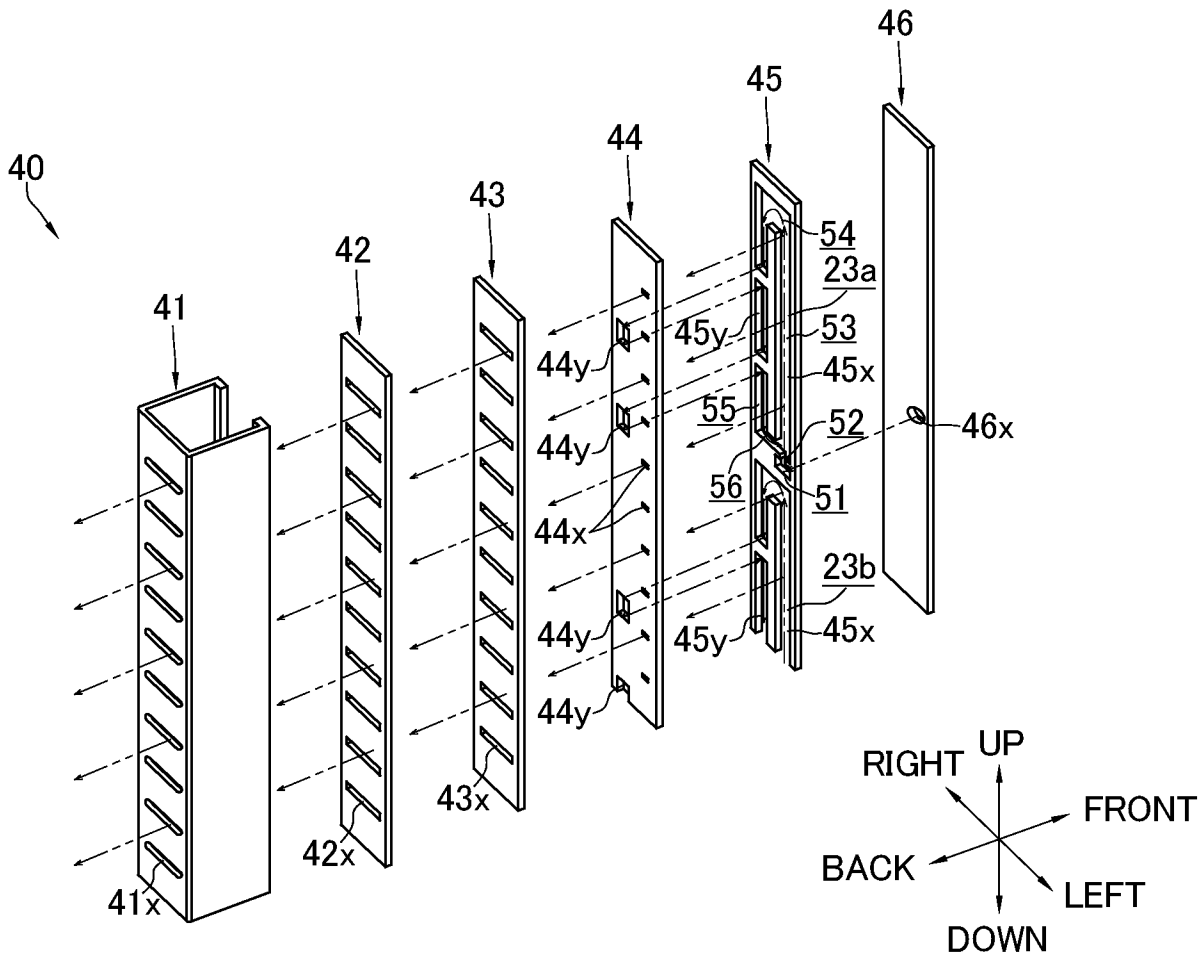
FIG. 20 is an exploded perspective view of a liquid header according to Modification C.
Figure 21:
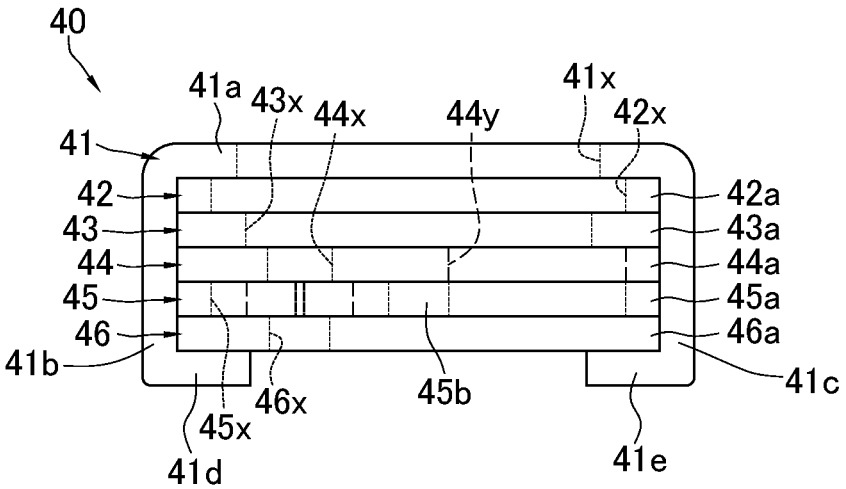
FIG. 21 is a plan sectional view of the liquid header according to Modification C.
Figure 21:
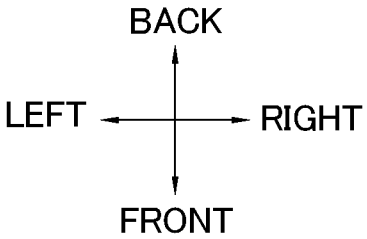
Figure 22:
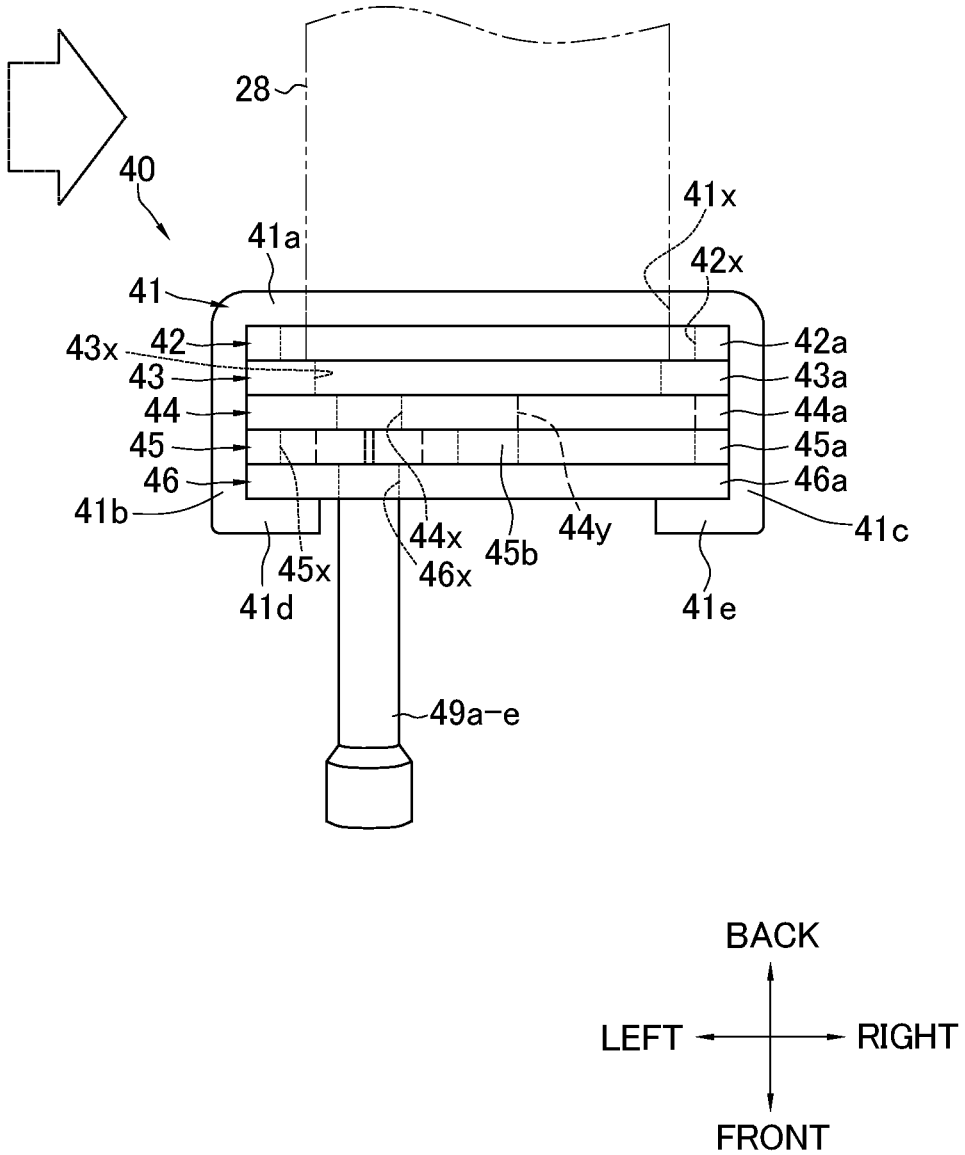
FIG. 22 is a plan sectional view showing a state of connection of the branch liquid-refrigerant connection pipes and the flat tubes with the liquid header according to Modification C.

FIG. 20 is an exploded perspective view of the liquid header 40 (note that, in this figure, alternate-long-and-two-short-dash-line arrows indicate the flow of a refrigerant when the outdoor heat exchanger 11 functions as an evaporator of the refrigerant). FIG. 21 is a plan sectional view of the liquid header 40. FIG. 22 is a plan sectional view showing a state of connection of the branch liquid-refrigerant connection pipes 49*a* to 49*e* and the flat tubes 28 with the liquid header 40.

Figure 23:
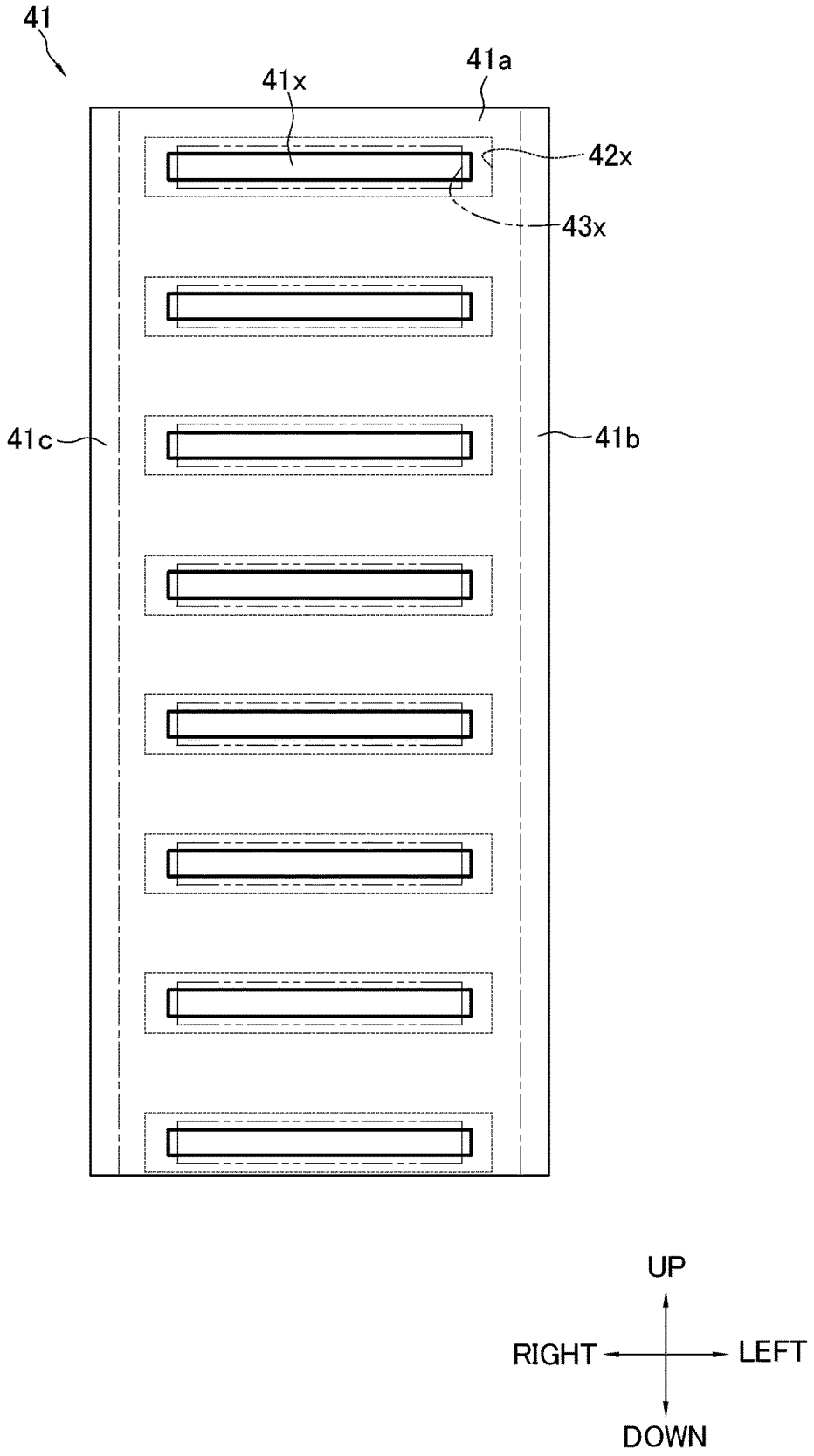
FIG. 23 is a back schematic view of an eleventh liquid-side member according to Modification C.
Figure 24:
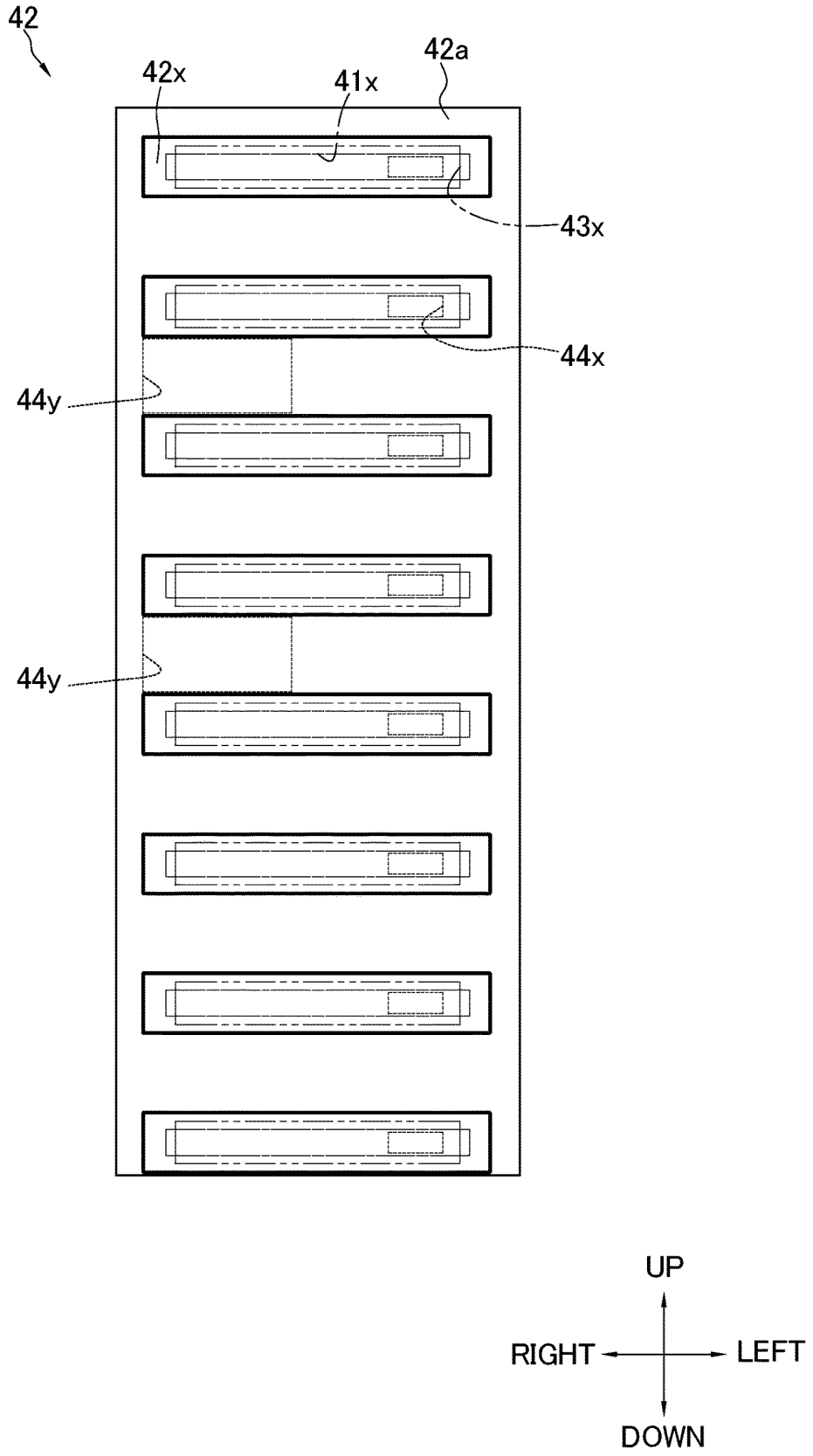
FIG. 24 is a back schematic view of a twelfth liquid-side member according to Modification C.
Figure 25:
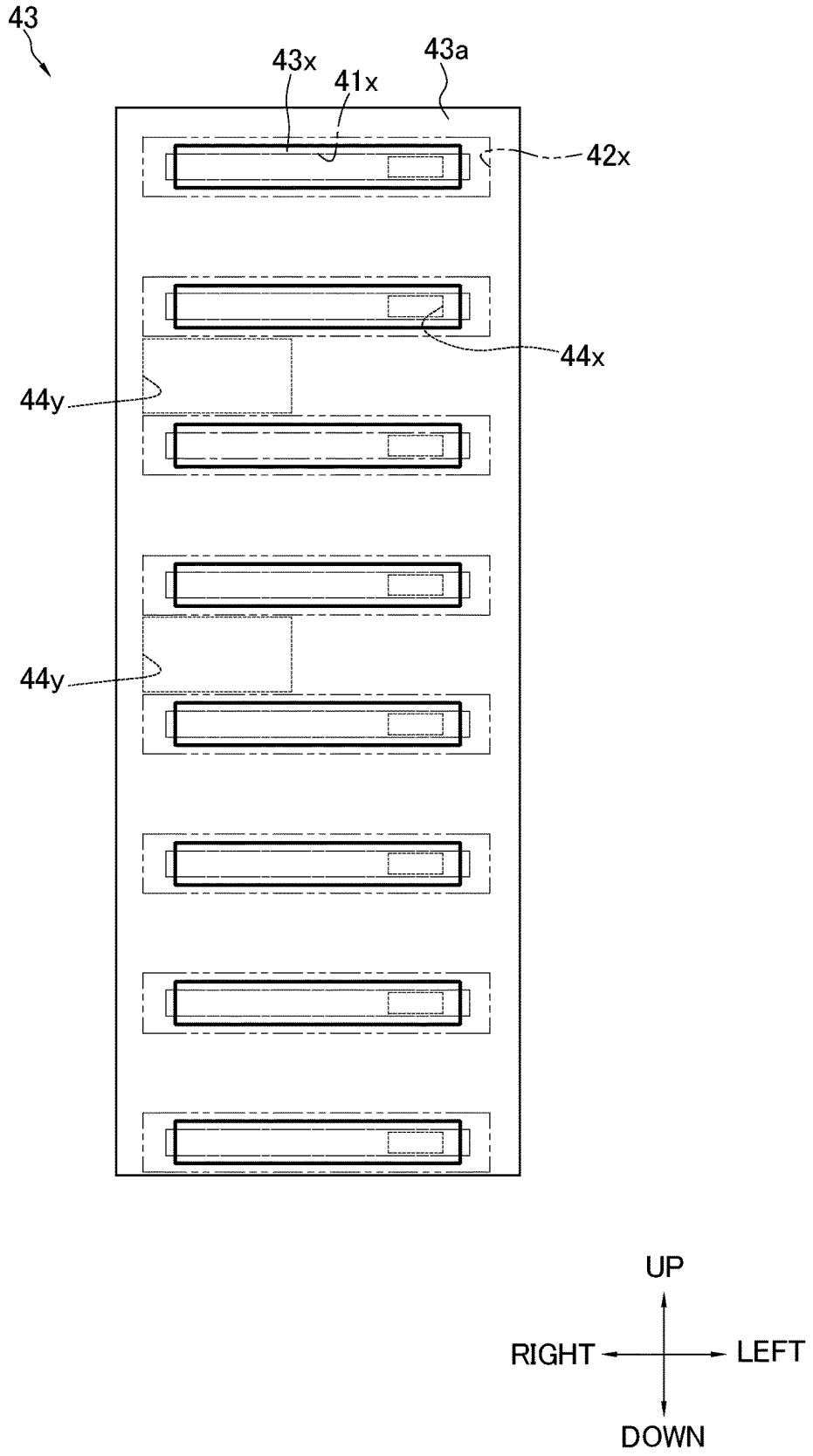
FIG. 25 is a back schematic view of a thirteenth liquid-side member according to Modification C.
Figure 26:
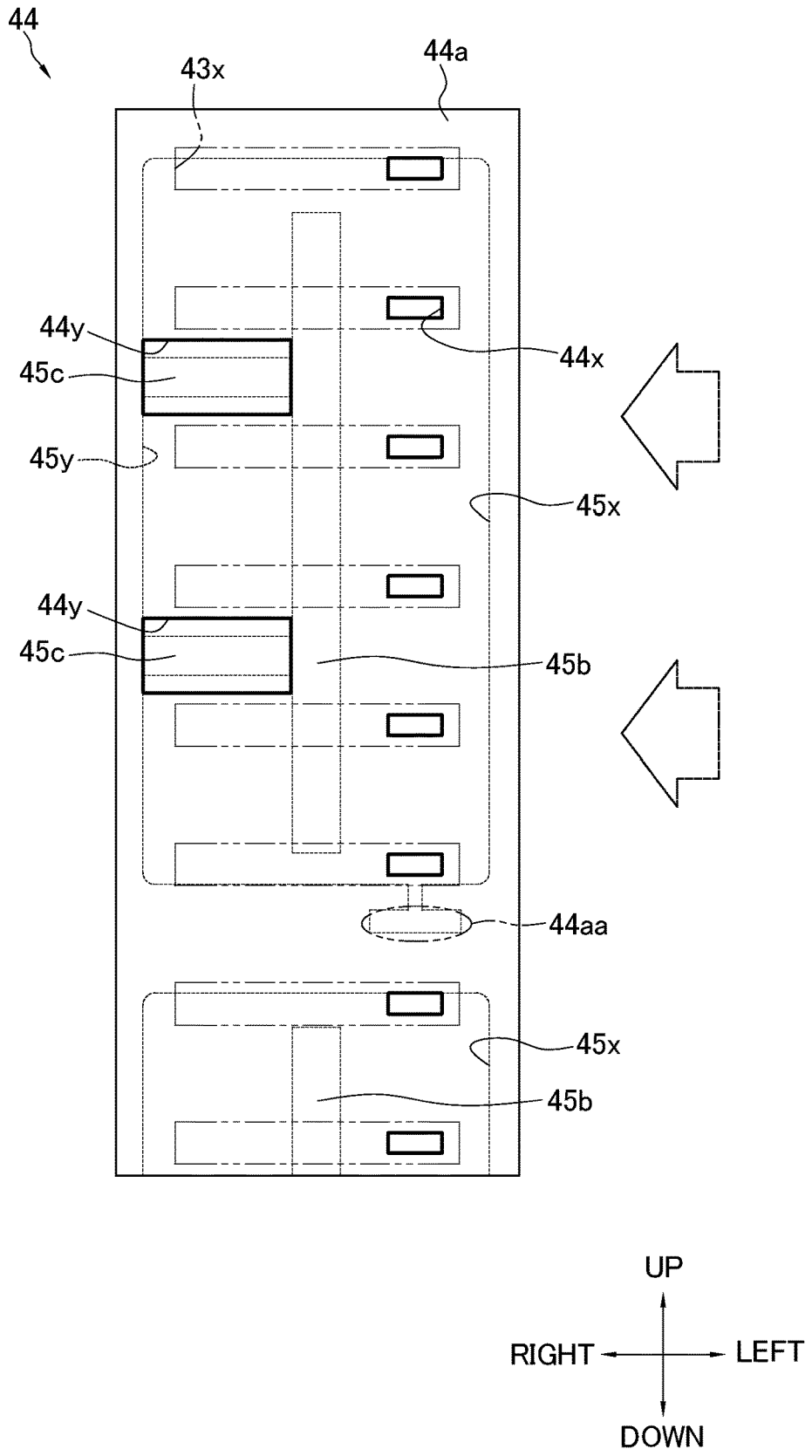
FIG. 26 is a back schematic view of a fourteenth liquid-side member according to Modification C.
Figure 27:
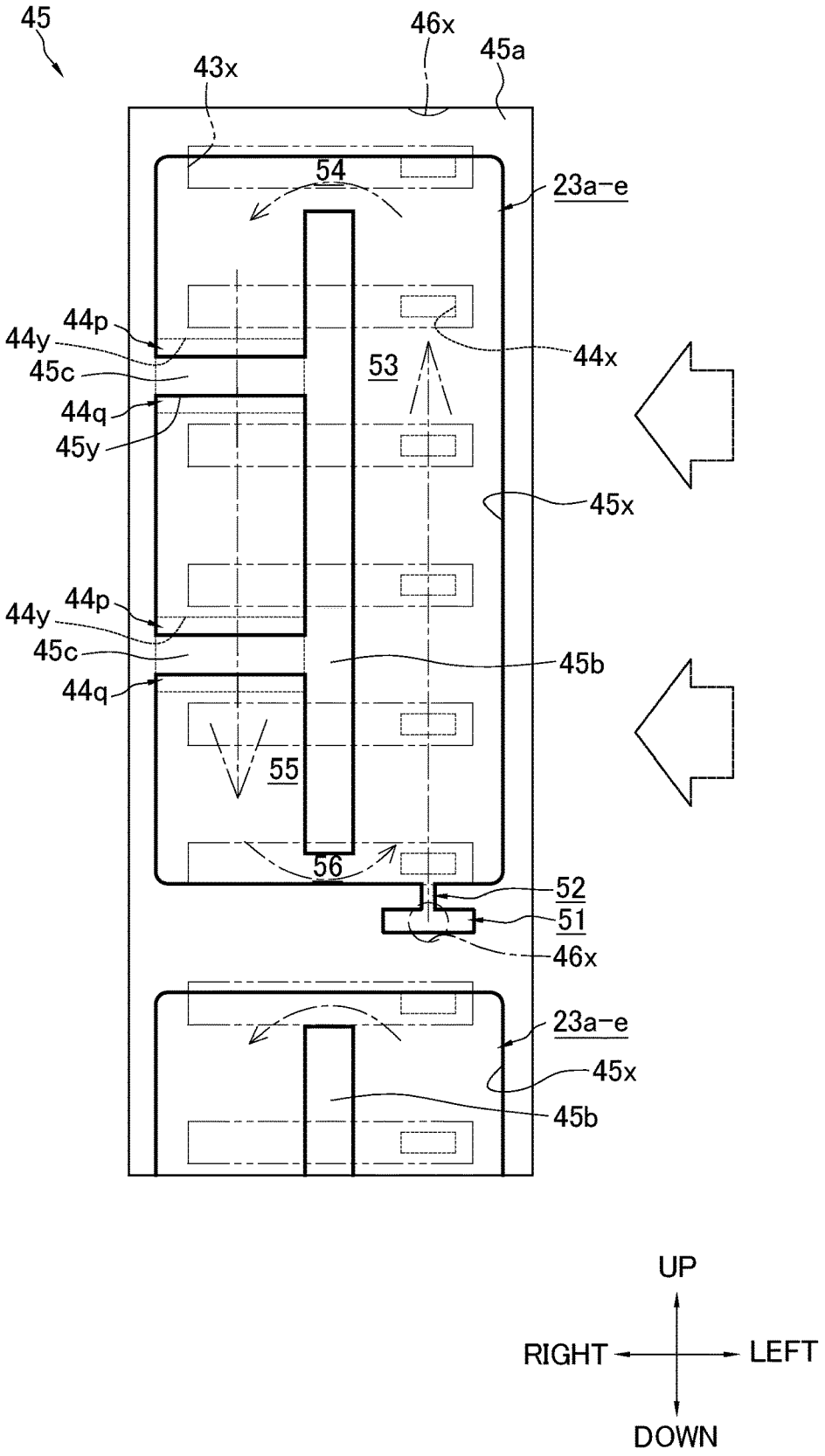
FIG. 27 is a back schematic view of a fifteenth liquid-side member according to Modification C.
Figure 28:
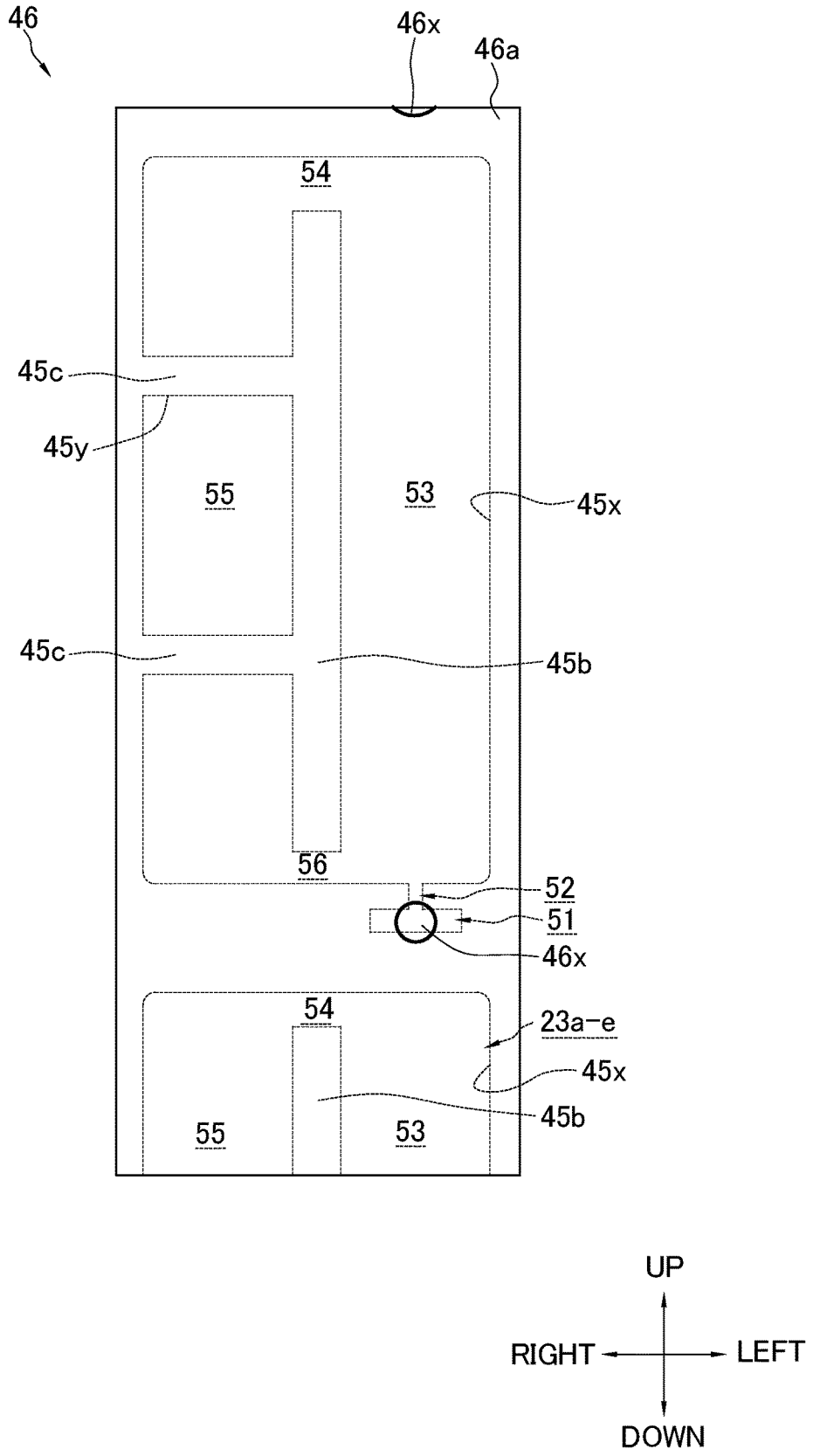
FIG. 28 is a back schematic view of a sixteenth liquid-side member according to Modification C.

FIG. 23 is a back schematic view of an eleventh liquid-side member 41. FIG. 24 is a back schematic view of a twelfth liquid-side member 42. FIG. 25 is a back schematic view of a thirteenth liquid-side member 43. FIG. 26 is a back schematic view of a fourteenth liquid-side member 44. FIG. 27 is a back schematic view of a fifteenth liquid-side member 45. FIG. 28 is a back schematic view of a sixteenth liquid-side member 46. Note that each of these figures show with, for example, broken lines, the relationships between the positions of openings of the members that are disposed adjacent to each other while projecting them.

The liquid header 40 (an example of the header) includes the eleventh liquid-side member 41 (an example of the first member), the twelfth liquid-side member 42, the thirteenth liquid-side member 43, the fourteenth liquid-side member 44, the fifteenth liquid-side member 45 (an example of the third member), and the sixteenth liquid-side member 46 (an example of the second member). The liquid header 40 is constituted by joining the sixteenth liquid-side member 46, the eleventh liquid-side member 41, the fifteenth liquid-side member 45, the fourteenth liquid-side member 44, the thirteenth liquid-side member 43, and the twelfth liquid-side member 42 to each other by brazing.

The liquid header 40 has a substantially quadrilateral shape having a connection portion with the flat tubes 28 as one side.

(7-3-1) Eleventh Liquid-Side Member

The eleventh liquid-side member 41 is primarily a member that, together with the sixteenth liquid-side member 46 described below, constitutes the periphery of the external shape of the liquid header 40. It is desirable that the eleventh liquid-side member 41 have a clad layer formed on a surface thereof, the clad layer having a brazing material.

The eleventh liquid-side member 41 includes a liquid-side flat-tube connection plate 41*a* (an example of the first plate-shaped portion), a first liquid-side outer wall 41*b*, a second liquid-side outer wall 41*c*, a first liquid-side claw portion 41*d*, and a second liquid-side claw portion 41*e*.

Although not limited, the eleventh liquid-side member 41 of one or more embodiments can be formed by bending one metal plate obtained by rolling with a longitudinal direction of the liquid header 40 being a direction of fold. In this case, the plate thickness of each portion of the eleventh liquid-side member 41 is uniform.

The liquid-side flat-tube connection plate 41*a* is a flat-shaped portion extending in the up-down direction and in the left-right direction. A plurality of liquid-side flat-tube connection openings 41*x* disposed side by side in the up-down direction are formed in the liquid-side flat-tube connection plate 41*a*. Each liquid-side flat-tube connection opening 41*x* is an opening extending through the liquid-side flat-tube connection plate 41*a* in the thickness direction. With the flat tubes 28 being inserted in the liquid-side flat-tube connection openings 41*x* such that one end of each flat tube 28 passes completely through the corresponding liquid-side flat-tube connection opening 41*x*, the flat tubes 28 are joined to the liquid-side flat-tube connection openings 41*x* by brazing. In the joined state realized by brazing, the entire inner peripheral surface of each liquid-side flat-tube connection opening 41*x* and the entire outer peripheral surface of the corresponding flat tube 28 are in contact with each other.

The first liquid-side outer wall 41*b* is a flat-shaped portion extending toward a front side from an end portion on a left side (outer side of the outdoor unit 2, side opposite to the gas header 70) of the liquid-side flat-tube connection plate 41*a*.

The second liquid-side outer wall 41*c* is a flat-shaped portion extending toward the front side from an end portion on a right side (inner side of the outdoor unit 2, side of the gas header 70) of the liquid-side flat-tube connection plate 41*a*.

The first liquid-side claw portion 41*d* is a portion extending toward the right from a front-side end portion of the first liquid-side outer wall 41*b*. The second liquid-side claw portion 41*e* is a portion extending toward the left from a front-side end portion of the second liquid-side outer wall 41*c*.

In a state before the twelfth liquid-side member 42, the thirteenth liquid-side member 43, the fourteenth liquid-side member 44, the fifteenth liquid-side member 45, and the sixteenth liquid-side member 46 are disposed on an inner side of the eleventh liquid-side member 41 in plan view, the first liquid-side claw portion 41*d* and the second liquid-side claw portion 41*e* are each in an extended state on an extension line of a corresponding one of the first liquid-side outer wall 41*b* and the second liquid-side outer wall 41*c*. In a state in which the twelfth liquid-side member 42, the thirteenth liquid-side member 43, the fourteenth liquid-side member 44, the fifteenth liquid-side member 45, and the sixteenth liquid-side member 46 are disposed on the inner side of the eleventh liquid-side member 41 in plan view, the first liquid-side claw portion 41*d* and the second liquid-side claw portion 41*e* are bent toward each other to crimp the twelfth liquid-side member 42, the thirteenth liquid-side member 43, the fourteenth liquid-side member 44, the fifteenth liquid-side member 45, and the sixteenth liquid-side member 46 by the eleventh liquid-side member 41, as a result of which they are fixed to each other. When, in this state, brazing is performed, for example, inside a furnace, the members are joined to each other by brazing and are completely fixed to each other.

(7-3-2) Twelfth Liquid-Side Member

The twelfth liquid-side member 42 is a member that is stacked on a surface on a front side (side at which the branch liquid-refrigerant connection pipes 49*a* to 49*e* and the liquid header 40 are connected to each other) of the liquid-side flat-tube connection plate 41*a* of the eleventh liquid-side member 41 so as to face and contact this surface. The length of the twelfth liquid-side member 42 in the left-right direction is the same as the length of the liquid-side flat-tube connection plate 41*a* of the eleventh liquid-side member 41 in the left-right direction. It is desirable that the twelfth liquid-side member 42 have a clad layer formed on a surface thereof, the clad layer having a brazing material.

The twelfth liquid-side member 42 includes a twelfth internal plate 42*a* and a plurality of twelfth openings 42*x*. The twelfth internal plate 42*a* has a flat shape extending in the up-down direction and in the left-right direction. The plurality of twelfth openings 42*x* are disposed side by side in the up-down direction, and are through openings in the plate-thickness direction of the twelfth internal plate 42*a*.

Each twelfth opening 42*x* is an opening that is larger than each liquid-side flat-tube connection opening 41*x* of the liquid-side flat-tube connection plate 41*a* of the eleventh liquid-side member 41. In a state in which the twelfth liquid-side member 42 is stacked on the liquid-side flat-tube connection plate 41*a* of the eleventh liquid-side member 41, outer edges of each twelfth opening 42*x* are formed to be, in a stacking direction of each member, more specifically, in the front-back direction, positioned on outer sides of outer edges of each liquid-side flat-tube connection opening 41*x* of the liquid-side flat-tube connection plate 41*a* of the eleventh liquid-side member 41. Therefore, it is possible to suppress a brazing material from moving due to a capillary action when the members are joined by brazing, and to thus suppress the brazing material from closing the refrigerant passages 28*b* of the flat tubes 28. From this viewpoint, it is desirable that upper and lower portions of the outer edges of each twelfth opening 42*x* be situated apart from upper and lower portions of the outer edges of each liquid-side flat-tube connection opening 41*x* of the liquid-side flat-tube connection plate 41*a* by 2 mm or greater or 3 mm or greater.

Note that, even if the eleventh liquid-side member 41 including the liquid-side flat-tube connection plate 41*a* is thin, the twelfth liquid-side member 42 is further stacked on the liquid-side flat-tube connection plate 41*a* in the plate-thickness direction. Therefore, it is possible to increase the compressive strength of a portion of the liquid header 40 on a side at which the flat tubes 28 are connected.

Note that, by only forming the twelfth internal plate 42*a* with a small plate thickness, it is possible to reduce useless space in which a refrigerant is retained between the flat tubes 28 that are disposed side by side.

(7-3-3) Thirteenth Liquid-Side Member

The thirteenth liquid-side member 43 is a member that is stacked on a surface on a front side (side at which the branch liquid-refrigerant connection pipes 49*a* to 49*e* and the liquid header 40 are connected to each other) of the twelfth liquid-side member 42 so as to face and contact this surface. The length of the thirteenth liquid-side member 43 in the left-right direction is the same as the length of the twelfth liquid-side member 42 in the left-right direction. It is desirable that the thirteenth liquid-side member 43 have a clad layer formed on a surface thereof, the clad layer having a brazing material.

The thirteenth liquid-side member 43 includes a thirteenth internal plate 43*a* (an example of the plate-shaped portion) and a plurality of thirteenth openings 43*x* (an example of the opening). The thirteenth internal plate 43*a* has a flat shape extending in the up-down direction and in the left-right direction. The plurality of thirteenth openings 43*x* are disposed side by side in the up-down direction, and are through openings in the plate-thickness direction of the thirteenth internal plate 43*a*.

Each thirteenth opening 43*x* is an opening in which left and right edges of each thirteenth opening 43*x*, when viewed in the stacking direction, are positioned on inner sides of the corresponding twelfth opening 42*x* of the twelfth liquid-side member 42, are positioned on inner sides of the corresponding liquid-side flat-tube connection opening 41*x* of the liquid-side flat-tube connection plate 41*a* of the eleventh liquid-side member 41, and are positioned on inner sides of the width of each flat tube 28 on the left and right sides. Note that each thirteenth opening 43*x* is an opening in which upper and lower edges of each thirteenth opening 43*x*, when viewed in the stacking direction, are positioned on inner sides of the corresponding twelfth opening 42*x* of the twelfth liquid-side member 42, and are positioned on outer sides of the corresponding liquid-side flat-tube connection opening 41*x* of the liquid-side flat-tube connection plate 41*a* of the eleventh liquid-side member 41.

Therefore, since the vicinities of left and right ends of a tip of each flat tube 28 that is inserted into the liquid header 40 can collide with edges of the corresponding thirteenth opening 43*x* of the thirteenth liquid-side member 43, it is possible to restrict the amount of insertion of each flat tube 28 into the liquid header 40.

(7-3-4) Fourteenth Liquid-Side Member

The fourteenth liquid-side member 44 is a member that is stacked on a surface on a front side (side at which the branch liquid-refrigerant connection pipes 49*a* to 49*e* and the liquid header 40 are connected to each other) of the thirteenth liquid-side member 43 so as to face and contact this surface. The length of the fourteenth liquid-side member 44 in the left-right direction is the same as the length of the thirteenth liquid-side member 43 in the left-right direction. It is desirable that the fourteenth liquid-side member 44 have a clad layer formed on a surface thereof, the clad layer having a brazing material.

The fourteenth liquid-side member 44 includes a fourteenth internal plate 44*a* (an example of the plate-shaped portion), a plurality of fourteenth ascending-side openings 44*x* (an example of openings), and a plurality of fourteenth descending-side openings 44*y*.

The fourteenth internal plate 44*a* has a flat shape extending in the up-down direction and in the left-right direction. Note that, when viewed in the front-back direction (the stacking direction), the fourteenth internal plate 44*a* includes wall portions 44*aa* that covers a corresponding one of the introduction spaces 51 (described below) from the back thereof. Therefore, a refrigerant that has flowed into each introduction space 51 is such that a gas-phase refrigerant and a liquid-phase refrigerant are mixed by colliding with the corresponding wall portion 44*aa* to make it possible to send a refrigerant in which the gas-phase refrigerant and the liquid-phase refrigerant have been mixed to a corresponding nozzle 52.

The plurality of fourteenth ascending-side openings 44*x* are disposed side by side in the up-down direction, and are through openings in the plate-thickness direction of the fourteenth internal plate 44*a*. Each fourteenth ascending-side opening 44*x* is disposed upstream from each fourteenth descending-side opening 44*y* in an air flow direction of air flow that is produced by the outdoor fan 16. Note that FIGS. 26 and 27 show the air flow that is produced by the outdoor fan 16 by dotted-line arrows. Edges of each fourteenth ascending-side opening 44*x* are, when viewed in the stacking direction, positioned on inner sides of the edges of the corresponding thirteenth opening 43*x* of the thirteenth liquid-side member 43. Therefore, a refrigerant that flows in each ascending space 53 (described below) can be branched toward each of the fourteenth ascending-side opening 44*x* and flow, and the refrigerant can be divided with respect to each flat tube 28 connected to a corresponding one of the fourteenth ascending-side openings 44*x*. Here, each fourteenth ascending-side opening 44*x* is, in the air flow direction of air flow that is produced by the outdoor fan 16, disposed upstream from the center of each flat tube 28 in plan view. Therefore, when the outdoor heat exchanger functions as an evaporator of a refrigerant, the refrigerant that has passed through each fourteenth ascending-side opening 44*x* can be guided in a large amount to a windward side of each flat tube 28. Therefore, by guiding a large amount of refrigerant to the windward side where the difference between the temperature of air and the temperature of the refrigerant is easily ensured, heat-exchange performance can be enhanced.

The plurality of fourteenth descending-side openings 44*y* are disposed side by side in the up-down direction, and are through openings in the plate-thickness direction of the fourteenth internal plate 44*a*. Each fourteenth descending-side opening 44*y* is, when viewed in the stacking direction, provided so as not to overlap each thirteenth opening 43*x* of the thirteenth liquid-side member 43. Specifically, when viewed in the stacking direction, each fourteenth descending-side opening 44*y* is disposed where it overlaps a corresponding one of connection portions 45*c* of the fifteenth liquid-side member 45 (described below), and is disposed between in the up-down direction the corresponding thirteenth openings 43*x* that are adjacent to each other in the up-down direction of the thirteenth liquid-side member 43. Therefore, a space in each thirteenth opening 43*x* of the thirteenth liquid-side member 43 and a space in each fourteenth descending-side opening 44*y* of the fourteenth liquid-side member 44 do not communicate with each other and do not directly communicate with each other in the stacking direction. Therefore, a refrigerant that flows in each descending space 55 (described below) moves toward the front and thus does not reach each thirteenth opening 43*x* of the thirteenth liquid-side member 43. Note that, when viewed in the stacking direction, an upper end of each fourteenth descending-side opening 44*y* is positioned further above an upper end of the corresponding connection portion 45*c* that it overlaps, and a lower end of each fourteenth descending-side opening 44*y* is positioned further below a lower end of the corresponding connection portion 45*c* that it overlaps.

Note that a plate-shaped portion of the fourteenth internal plate 44*a* extends between each fourteenth ascending-side opening 44*x* in the up-down direction. Similarly, the plate-shaped portion of the fourteenth internal plate 44*a* extends between the plurality of fourteenth descending-side openings 44*y* in the up-down direction.

(7-3-5) Fifteenth Liquid-Side Member

The fifteenth liquid-side member 45 is a member that is stacked on a surface on a front side (side at which the branch liquid-refrigerant connection pipes 49*a* to 49*e* and the liquid header 40 are connected to each other) of the fourteenth liquid-side member 44 so as to face and contact this surface. The length of the fifteenth liquid-side member 45 in the left-right direction is the same as the length of the fourteenth liquid-side member 44 in the left-right direction. It is desirable that the fifteenth liquid-side member 45 have a clad layer formed on a surface thereof, the clad layer having a brazing material.

The fifteenth liquid-side member 45 includes a fifteenth internal plate 45*a* (an example of the third plate-shaped portion), a plurality of first through openings 45*x* (an example of the first opening), and a plurality of second penetration portions 45*y*.

The fifteenth internal plate 45*a* has a flat shape extending in the up-down direction and in the left-right direction. The fifteenth internal plate 45*a* has partition portions 45*b* in correspondence with a corresponding one of the first penetration portions 45*x*, each partition portion 45*b* extending in the longitudinal direction of the liquid header 40 to separate left and right spaces while forming gaps between end portions in the up-down direction of the first penetration portions 45*x*. In this way, the ascending spaces 53 can have a narrower width in the left-right direction by forming the partition portions 45*b*. Therefore, even in a state in which the circulation amount of a refrigerant in the refrigerant circuit 6 is small, such as when the amount of a refrigerant that is sent to the liquid header 40 is small, a refrigerant that moves upward in the ascending spaces 53 can be sufficiently supplied even to the flat tubes 28 that are connected to the vicinities of upper ends of the ascending spaces 53.

The fifteenth internal plate 45*a* includes connection portions 45*c* extending to a corresponding one of the partition portions 45*b* from the vicinity of a right edge portion, which is a downstream side in the air flow direction of air flow that is formed by the outdoor fan 16. In one or more embodiments, two connection portions 45*c* disposed side by side in the up-down direction extend from one partition portion 45*b*. Here, the thickness of each portion of the fifteenth internal plate 45*a* in the plate-thickness direction is the same, including the partition portions 45*b* and the connection portions 45*c*. In this way, the fifteenth internal plate 45*a* includes the partition portions 45*b* and the connection portions 45*c* that are integrated with each other. Therefore, even if a flow path that allows a refrigerant to be circulated and to flow is to be formed within the plate thickness of the fifteenth liquid-side member 45, this can be realized by one member without separation into a plurality of members. Note that, when viewed in the stacking direction, the connection portions 45*c* and the fourteenth descending-side openings 44*y* are positioned so that only a part of each connection portion 45*c* overlaps a part of a corresponding one of the descending-side openings 44*y*. Specifically, when viewed in the stacking direction, the fifteenth liquid-side member 45 and the fourteenth liquid-side member 44 are disposed so that upper bypass openings 44*p* extending through an upper side of a corresponding one of the connection portions 45*c* in the plate-thickness direction are formed in an upper region of a corresponding one of the fourteenth descending-side openings 44*y*, and so that lower bypass openings 44*q* extending through a lower side of the corresponding one of the connection portions 45*c* in the plate-thickness direction are formed in a lower region of the corresponding one of the fourteenth descending openings 44*y*. Therefore, the connection portions 45*c* are prevented from hindering a flow of a refrigerant that circulates while the fifteenth internal plate 45*a* includes the partition portions 45*b* and the connection portions 45*c* that are integrated with each other.

The plurality of first penetration portions 45*x* are disposed side by side in the up-down direction, and are through openings in the plate-thickness direction of the fourteenth internal plate 44*a*. When viewed in the stacking direction, a plurality of fourteenth ascending-side openings 44*x* overlap one first penetration portion 45*x*.

One first penetration portion 45*x* includes one introduction space 51 (an example of the first region), one nozzle 52 (an example of the second region), one ascending space 53 (an example of the third region), one outward flow path 54, a part of one descending space 55, and one return flow path 56. Note that each fourteenth descending-side opening 44*y* of the fourteenth liquid-side member 44 constitutes the other part of a corresponding one of the descending spaces 55. Note that each nozzle 52 is positioned below any portion of the fourteenth liquid-side member 44 that communicates with the corresponding first penetration portion 45*x* where the nozzle 52 is provided.

Here, each nozzle 52, each outward flow path 54, and each return flow path 56 are a space that is surrounded by a back surface of a liquid-side external plate 46*a* of the sixteenth liquid-side member 46 (described below) and a front surface of the fourteenth internal plate 44*a* of the fourteenth liquid-side member 44. A back side of each introduction space 51 is covered by the front surface of the fourteenth internal plate 44*a* of the fourteenth liquid-side member 44, and a front side of each introduction space 51 communicates with a corresponding one of the branch liquid-refrigerant connection pipes 49*a* to 49*e* connected to external liquid-pipe connection openings 46*x* of the liquid-side external plate 46*a* of the sixteenth liquid-side member 46 (described below). A front side of each ascending space 53 is covered by the back surface of the liquid-side external plate 46*a* of the sixteenth liquid-side member 46 (described below), and a back side of each ascending space 53 is such that a portion thereof other than where the fourteenth ascending-side openings 44*x* of the fourteenth liquid-side member 44 are provided is covered by the front surface of the fourteenth internal plate 44*a* of the fourteenth liquid-side member 44. Therefore, regardless of the amount of insertion of each flat tube 28 in the liquid header 40, it is possible to stably ensure a flow-path cross-sectional area of each ascending space 53 for allowing a refrigerant to move upward and flow. Note that the fourteenth ascending-side openings 44*x* of the fourteenth liquid-side member 44 communicate with the ascending spaces 53 of the fifteenth liquid-side member 45, and do not communicate with the introduction spaces 51, the nozzles 52, the outward flow paths 54, the descending spaces 55, and the return flow paths 56 of the fifteenth liquid-side member 45.

A front side of each descending space 55 is covered by the back surface of the liquid-side external plate 46*a* of the sixteenth liquid-side member 46 (described below) and by the connection portions 45*c* of the fourteenth liquid-side member 44. Regarding a back side of each descending space 55, a portion thereof where the fourteenth descending-side openings 44*y* are not provided is covered by the front surface of the fourteenth internal plate 44*a* of the fourteenth liquid-side member 44, and a portion thereof where the fourteenth descending-side openings 44*y* of the fourteenth liquid-side member 44 are provided is covered by the front surface of the thirteenth internal plate 43*a* of the thirteenth liquid-side member 43.

As described above, in the liquid header 40, in a space that is interposed between the sixteenth liquid-side member 46 and the thirteenth liquid-side member 43 in the stacking direction, a circulation flow-path structure including one set of introduction space 51, nozzle 52, ascending space 53, outward flow path 54, descending space 55, and return flow path 56 is formed. Note that such circulation flow-path structures are provided side by side in the up-down direction in a one-to-one correspondence with the branch liquid-refrigerant connection pipes 49*a* to 49*e*.

Each introduction space 51, the corresponding nozzle 52, and the corresponding ascending space 53 are disposed side by side in the longitudinal direction of the liquid header 40. In one or more embodiments, each introduction space 51, the corresponding nozzle 52, and the corresponding ascending space 53 are disposed side by side in this order from the bottom. A left edge of each nozzle 52 is positioned to the right of a left edge of the corresponding introduction space 51 and to the right of a left edge of the corresponding ascending space 53. A right edge of each nozzle 52 is positioned to the left of a right edge of the corresponding introduction space 51 and to the left of a right edge of the corresponding ascending space 53. The width of each nozzle 52 in the left-right direction is smaller than the width of the corresponding introduction space 51 in the left-right direction and is smaller than the width of the corresponding ascending space 53 in the left-right direction. Therefore, a refrigerant that moves toward each ascending space 53 from the corresponding introduction space 51 can have its flow velocity increased when the refrigerant passes through the corresponding nozzle 52 whose passage area has been narrowed. In addition, the refrigerant whose flow velocity has been increased and that has flowed into each ascending space 53 is capable of also reaching the fourteenth ascending-side openings 44*x* that are positioned far away above the corresponding nozzle 52. Note that the flow-path cross-sectional area of each ascending space 53 can be easily adjusted by only adjusting the plate thickness of the fifteenth internal plate 45*a* or the size of an opening, and a structure that easily increases the flow velocity of a refrigerant by reducing a passage cross-sectional area of the refrigerant is provided.

When viewed in the front-back direction, the branch liquid-refrigerant connection pipes 49*a* to 49*e* are connected at the center in the left-right direction of the introduction spaces 51. When viewed in the front-back direction, each connection portion with a corresponding one of the branch liquid-refrigerant connection pipes 49*a* to 49*e* corresponding to the introduction spaces 51, the corresponding nozzle 52, and the corresponding ascending space 53 are disposed side by side in the vertical direction. Therefore, a refrigerant that has flowed in each of the branch liquid-refrigerant connection pipes 49*a* to 49*e* flows into the center in the left-right direction of the corresponding introduction space 51 via the corresponding external liquid-pipe connection opening 46*x*, and can be blown vertically upward toward the corresponding ascending space 53 via the corresponding nozzle 52 from the corresponding introduction space 51 without moving in the left-right direction or without moving very much in the left-right direction. Note that, for example, when a structure is one in which a refrigerant in a region of each introduction space 51 located toward the left side flows in, the refrigerant that passes through the corresponding nozzle 52 flows in an upper right direction, whereas, when a structure is one in which a refrigerant in a region of each introduction space 51 located toward the right side flows in, the refrigerant that passes through the corresponding nozzle 52 may flow in an upper left direction. However, in the structure of one or more embodiments, such deflections can be suppressed.

An upper end portion of each ascending space 53 and an upper end portion of the corresponding descending space 55 are caused to communicate with each other by the corresponding outward flow path 54. A lower end portion of each ascending space 53 and a lower end portion of the corresponding descending space 55 are caused to communicate with each other by the corresponding return flow path 56. In this way, in each first penetration portion 45*x*, the outward flow path 54 and the return flow path 56 extending in the left-right direction, which is a direction differing from the longitudinal direction of the liquid header 40, communicate with the ascending space 53 extending in the longitudinal direction of the liquid header 40. Therefore, in the liquid header 40, the direction of flow of a refrigerant in the interior can be changed by the shape of the penetration portions of one plate-shaped member. Consequently, it is possible to keep small the number of plate-shaped members required for changing the direction of flow of a refrigerant in the liquid header 40. In this way, by reducing the number of plate-shaped members required for a target refrigerant flow-path design, when performing brazing, sufficient heat is easily input even to members that are positioned relatively inward and the brazing performance can also be increased. Further, since the direction of a flow of a refrigerant can be changed by only changing the shape of the penetration portions of one plate-shaped member, it is possible to design a flow path in the liquid header 40 with a greater degree of freedom. In particular, even if the circulation amount of a refrigerant in the refrigerant circuit 6 is large, such as even if the amount of refrigerant that is sent to the liquid header 40 is large, a refrigerant that has reached the upper end of each ascending space 53 without being sent to the flat tubes 28 can be sent again to the flat tubes 28 via the corresponding outward flow path 54, the corresponding descending space 55, and the corresponding return flow path 56.

Note that, in one or more embodiments, when the liquid header 40 is viewed from the left-right direction (a direction orthogonal to both the stacking direction and the longitudinal direction of the liquid header), the area of each outward flow path 54 is larger than the area of the corresponding return flow path 56. Specifically, in one or more embodiments, the width of each outward flow path 54 in the longitudinal direction of the liquid header 40 is larger than the width of the corresponding return flow path 56 in the longitudinal direction of the liquid header 40. Therefore, a refrigerant that has moved upward in each ascending space 53 and reached the vicinity of the upper end of each ascending space 53 easily passes through the corresponding outward flow path 54. In one or more embodiments, when the liquid header 40 is viewed from the left-right direction (a direction orthogonal to both the stacking direction and the longitudinal direction of the liquid header), the area of each return flow path 56 is smaller than the area of the corresponding return flow path 54. Specifically, in one or more embodiments, the width of each return flow path 56 in the longitudinal direction of the liquid header 40 is smaller than the width of the corresponding outward flow path 54 in the longitudinal direction of the liquid header 40. Therefore, it is possible to suppress a refrigerant from flowing in a reverse direction to each return flow path 56 from the corresponding ascending space 53.

On the right side, which is a downstream side in the air flow direction of air flow that is formed by the outdoor fan 16, the plurality of second penetration portions 45*y* are disposed side by side in the up-down direction and are through openings in the plate-thickness direction of the fourteenth internal plate 44*a*. One second penetration portion 45*y* is an opening surrounded by one partition portion 45*b*, two connection portions 45*c* extending from the one partition portion 45*b*, and an edge portion of the vicinity of a right end portion of the fifteenth internal plate 45*a*.

(7-3-6) Sixteenth Liquid-Side Member

The sixteenth liquid-side member 46 is a member that is stacked on a surface on a front side of the fifteenth internal plate 45*a* of the fifteenth liquid-side member 45 so as to face and contact this surface. The length of the sixteenth liquid-side member 46 in the left-right direction is the same as the lengths in the left-right direction of the fifteenth liquid-side member 45, the fourteenth liquid-side member 44, the thirteenth liquid-side member 43, and the twelfth liquid-side member 42, and is the same as the length of the liquid-side flat-tube connection plate 41*a* of the eleventh liquid-side member 41 in the left-right direction.

It is desirable that the sixteenth liquid-side member 46 have a clad layer formed on a surface thereof, the clad layer having a brazing material.

The sixteenth liquid-side member 46 includes the liquid-side external plate 46*a* (an example of the second plate-shaped portion).

The liquid-side external plate 46*a* has a flat shape extending in the up-down direction and in the left-right direction.

The liquid-side external plate 46*a* has the plurality of external liquid-pipe connection openings 46*x* where the respective branch liquid-refrigerant connection pipes 49*a* to 49*e* are inserted and connected. The external liquid-pipe connection openings 46*x* are through openings in the plate-thickness direction of the liquid-side external plate 46*a*. The plurality of external liquid-pipe connection openings 46*x* are disposed side by side in the longitudinal direction of the liquid header 40. In the stacking direction, each external liquid-pipe connection opening 46*x* is positioned on a side opposite to the corresponding introduction space 51 where the nozzle 52 is provided. Note that, in one or more embodiments, each external liquid-pipe connection opening 46*x* is disposed toward a windward side of the liquid-side external plate 46*a*, and is disposed so that its center is positioned directly below the corresponding nozzle 52 when viewed in the stacking direction.

Therefore, each of the branch liquid-refrigerant connection pipes 49*a* to 49*e* communicates with a corresponding one of the plurality of flat tubes 28 via the corresponding external liquid-pipe connection opening 46*x* of the sixteenth liquid-side member 46, the corresponding first penetration portion 45*x* of the fifteenth liquid-side member 45, the corresponding fourteenth ascending-side opening 44*x* of the fourteenth liquid-side member 44, and the corresponding thirteenth opening 43*x* of the thirteenth liquid-side member 43.

Note that a front surface of the sixteenth liquid-side member 46 is in contact with and crimped to the first liquid-side claw portion 41*d* and the second liquid-side claw portion 41*e* of the eleventh liquid-side member 41.

(7-3-7) Flow of Refrigerant in Liquid Header

A flow of a refrigerant in the liquid header 40 when the outdoor heat exchanger 11 functions as an evaporator of the refrigerant is described below. Note that, when the outdoor heat exchanger 11 functions as a condenser or a heat dissipater of the refrigerant, the flow is in a direction substantially opposite to that when the outdoor heat exchanger 11 functions as an evaporator.

First, a liquid refrigerant or a refrigerant in a gas-liquid two-phase state that has flowed by being divided by the plurality of flow dividing pipes 22*a* to 22*e* of the distributor 22 flows in the branch liquid-refrigerant connection pipes 49*a* to 49*e* to pass through the external liquid-pipe connection openings 46*x* of the liquid-side external plate 46*a* of the eleventh liquid-side member 41 and to flow into the sub-spaces 23*a* to 23*e* of the liquid header 40.

Specifically, the refrigerant flows into the introduction spaces 51 of the fifteenth liquid-side member 45 at the respective sub-spaces 23*a* to 23*e*.

The refrigerant that has flowed into each introduction space 51 has its velocity increased when the refrigerant passes through the corresponding nozzle 52 at which the flow path is narrow, and moves into the corresponding ascending space 53. Note that due to the width of each ascending space 53 in the left-right direction being made narrower by the corresponding partition portion 45*b*, even if a refrigerant circulation amount of the refrigerant circuit 6 is small, such as even if a driving frequency of the compressor 8 is low, a refrigerant that has flowed into each ascending space 53 easily reaches the fourteenth ascending-side openings 44*x* that are positioned near the upper end of the corresponding ascending space 53. Here, the refrigerant that has flowed into each ascending space 53 moves to the vicinity of the upper end of each ascending space 53 while being divided and flowing toward each fourteenth ascending-side opening 44*x*. Note that, when the refrigerant circulation amount of the refrigerant circuit 6 is large, such as when the driving frequency of the compressor 8 is high, the amount of refrigerant that reaches the vicinity of the upper end of each ascending space 53 is large, and the refrigerant reaches each descending space 55 via the corresponding outward flow path 54. The refrigerant that has reached each descending space 55 moves downward and is returned again to a space above the corresponding nozzle 52 near a lower portion of the corresponding ascending space 53 via the corresponding return flow path 56. Here, in each ascending space 53, since the flow velocity of the refrigerant is increased as a result of passing through the nozzle 52, the static pressure is lower at a portion of the ascending space 53 near the return flow path 56 than at a portion of the descending space 55 near the return flow path 56. Therefore, the refrigerant that has moved down each descending space 55 easily returns to the corresponding ascending space 53 via the return corresponding flow path 56. In this way, since it is possible to circulate the refrigerant by using each ascending space 53, each outward flow path 54, each descending space 55, and each return flow path 56, even if there is a refrigerant that has not flowed by being divided by any one of the fourteenth ascending-side openings 44*x* when the refrigerant moves upward and flows in each ascending space 53, the refrigerant can be returned again to each ascending space 53 via the corresponding outward flow path 54, the corresponding descending space 55, and the corresponding return flow path 56. Therefore, the refrigerant easily flows in any one of the fourteenth ascending-side openings 44*x*.

Note that the refrigerant that moves down each descending space 55 primarily flows to move down a right region of the corresponding first penetration portion 45*x* and the corresponding second penetration portions 45*y* of the fifteenth internal plate 45*a* of the fifteenth liquid-side member 45. More specifically, at a portion where the connection portions 45*c* do not exist, the refrigerant that flows down each descending space 55 moves down and flows in a region between the back surface of the liquid-side external plate 46*a* of the sixteenth liquid-side member 46 and the front surface of the fourteenth internal plate 44*a* of the fourteenth liquid-side member 44, and, at a portion where the connection portions 45*c* exist, the refrigerant that flows down each descending space 55 moves around the connection portions 45*c*. When the refrigerant moves around the connection portions 45*c*, after the refrigerant has flowed to the fourteenth descending-side openings 44*y* of the fourteenth liquid-side member 44 via the upper bypass openings 44*p*, the refrigerant flows to return to the corresponding first penetration portion 45*x* or the corresponding second penetration portions 45*y* of the fifteenth liquid-side member 45 via the corresponding lower bypass openings 44*q*.

As described above, the refrigerant that has flowed by being divided by each fourteenth ascending-side opening 44*x* of the fourteenth liquid-side member 44 flows into each flat tube 28 by passing through the thirteenth openings 43*x* of the thirteenth liquid-side member 43, while being kept divided.

Even in the liquid header 40 described above, similarly to the embodiments described above, a structure that narrows a flow path for blowing a refrigerant in the longitudinal direction of the liquid header 40, which is the direction in which the flat tubes 28 are disposed side by side, can be realized by one fifteenth liquid-side member 45.

(7-4) Modification D

In Modification C above, the liquid header 40 of the outdoor heat exchanger 11 having a structure in which the flow of a refrigerant is divided by each fourteenth ascending-side opening 44*x* of the fourteenth liquid-side member 44 while the refrigerant is circulated in the fifteenth liquid-side member 45 has been given as an example and described.

Figure 29:
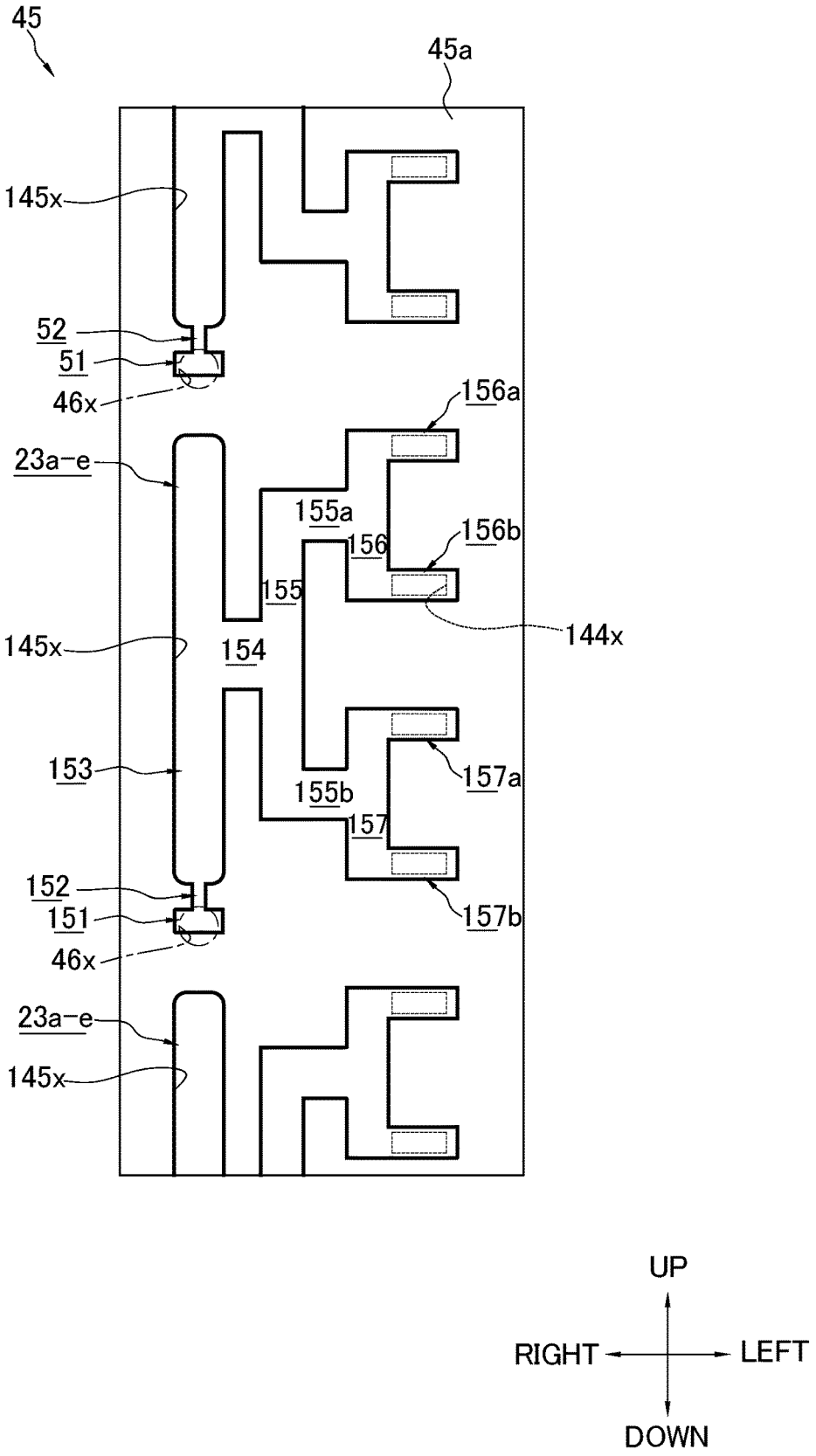
FIG. 29 is a back schematic view of a fifteenth liquid-side member according to Modification D.

In contrast, as the liquid header 40 of the outdoor heat exchanger 11, for example, as shown in FIG. 29, with regard to the embodiments described above, a liquid header may be one including a fourteenth liquid-side member 44 whose fourteenth internal plate 44*a* is formed to extend flatly without forming the fourteenth descending-side openings 44*y* and a fifteenth liquid-side member 45 that has penetration portions 145*x* where a refrigerant flow path branches toward a windward side from the respective ascending spaces 153. FIG. 29 is a back schematic view of the fifteenth liquid-side member 45, and shows the positional relationship between the fourth openings 144*x* of the fourteenth liquid-side member 44 that is stacked on the back side and the external liquid-pipe connection openings 46*x* of the sixteenth liquid-side member 46 that is stacked on the front side.

Each penetration portion 145*x* (an example of the first opening) includes an introduction space 151 (an example of the first region), a nozzle 152 (an example of the second region), an ascending space 153 (an example of the third region), a first branch space 154, a first flow dividing space 155, a second branch space 155*a*, a third branch space 155*b*, a second flow dividing space 156, a third flow dividing space 157, a first end portion 156*a*, a second end portion 156*b*, a third end portion 157*a*, and a fourth end portion 157*b*.

Each introduction space 151 is a portion extending from the center of the fifteenth liquid-side member 45 in the air flow direction toward a downstream side of the air flow, which is a side opposite to each introduction space 51 of the embodiments described above. A part of each introduction space 151 communicates with the corresponding external liquid-pipe connection opening 46*x* of the sixteenth liquid-side member 46.

Each nozzle 152 is provided above the corresponding introduction space 151 on a downstream side in the air flow direction.

Each ascending space 153 is provided above the corresponding nozzle 152 and extends further upward. Similarly to the embodiments described above, a refrigerant that has flowed into each introduction space 151 from a corresponding one of the branch liquid-refrigerant connection pipes 49*a* to 49*e* has its flow velocity increased when the refrigerant passes through the corresponding nozzle 152, and moves up the corresponding ascending space 153.

Each first branch space 154 is provided in the middle of the corresponding ascending space 153 in the up-down direction, and extends toward an upstream side in the air flow direction, which is a direction differing from the direction of extension of the corresponding ascending space 153.

Each first flow dividing space 155 is a flow path that guides upward or downward a refrigerant that has flowed in the corresponding first branch space 154.

Each second branch space 155*a* and each third branch space 155*b* extend toward the upstream side of the air flow direction from an upper end or a lower end of the corresponding first flow dividing space 155.

Each second flow dividing space 156 is a flow path that guides upward or downward a refrigerant that has flowed in the corresponding second branch space 155*a*. Each third flow dividing space 157 is a flow path that guides upward or downward a refrigerant that has flowed in the corresponding third flow dividing space 155*b*.

Each first end portion 156*a* and each second end portion 156*b* extend toward the upstream side of the air flow direction from an upper end or a lower end of the corresponding second flow dividing space 156. Each third end portion 157*a* and each fourth end portion 157*b* extend toward the upstream side of the air flow direction from an upper end or a lower end of the corresponding third flow dividing space 157.

Each first end portion 156*a* and each second end portion 156*b* and each third end portion 157*a* and each fourth end portion 157*b* communicate with a corresponding one of the fourth openings 144*x* in the stacking direction.

The third liquid-side member 145 above is capable of dividing one refrigerant flow into a plurality of refrigerant flows by the penetration portions 145*x* having more branches toward the upstream side in the air flow direction from a corresponding one of the ascending spaces 153.

(7-5) Modification E

In the embodiments described above, as heat transfer tubes, the flat tubes 28 that are flat tubes whose length in the horizontal direction is longer than its length in the vertical direction in a cross-sectional shape that is perpendicular to the flow paths have been given as an example and described.

In contrast, with heat transfer tubes not being limited thereto, for example, as such heat transfer tubes, heat transfer tubes having a circular cylindrical shape whose cross-sectional shape perpendicular to the flow paths is circular may be used.

(7-6) Modification F

In the embodiments and each modification above, an example in which only one heat transfer tube group that is constituted by a plurality of heat transfer tubes disposed side by side in a direction intersecting the air flow direction is provided in the air flow direction has been described.

In contrast, with the heat transfer tubes of the heat exchanger not being limited thereto, for example, a plurality of heat transfer tube groups, each being constituted by a plurality of heat transfer tubes disposed side by side in a direction intersecting the air flow direction, may be disposed side by side in the air flow direction. In this case, it is desirable that each refrigerant flow path in the liquid header be disposed side by side in the air flow direction.

(7-7) Modification G

In the embodiments described above, for example, the width of each ascending space 34*z* in a direction (in the left-right direction in the embodiments described above) that is perpendicular to both the longitudinal direction and the stacking direction of the header (liquid header) has been described as being larger than the width of the corresponding nozzle 34*y*.

In contrast, each ascending space 34*z* may be such that the relationship between a width Wf in a direction perpendicular to both the longitudinal direction and the stacking direction of the header and a width Tf in the stacking direction satisfy Wf/Tf≤2.5. Therefore, even if the heat exchanger is used under a condition in which the flow velocity of a refrigerant is high, specifically, in a state in which the flow velocity of a refrigerant that flows upward in each ascending space 34*z* is relatively high, the flow of the refrigerant can be divided by keeping small deflections between the plurality of heat transfer tubes 28.

Figure 30:
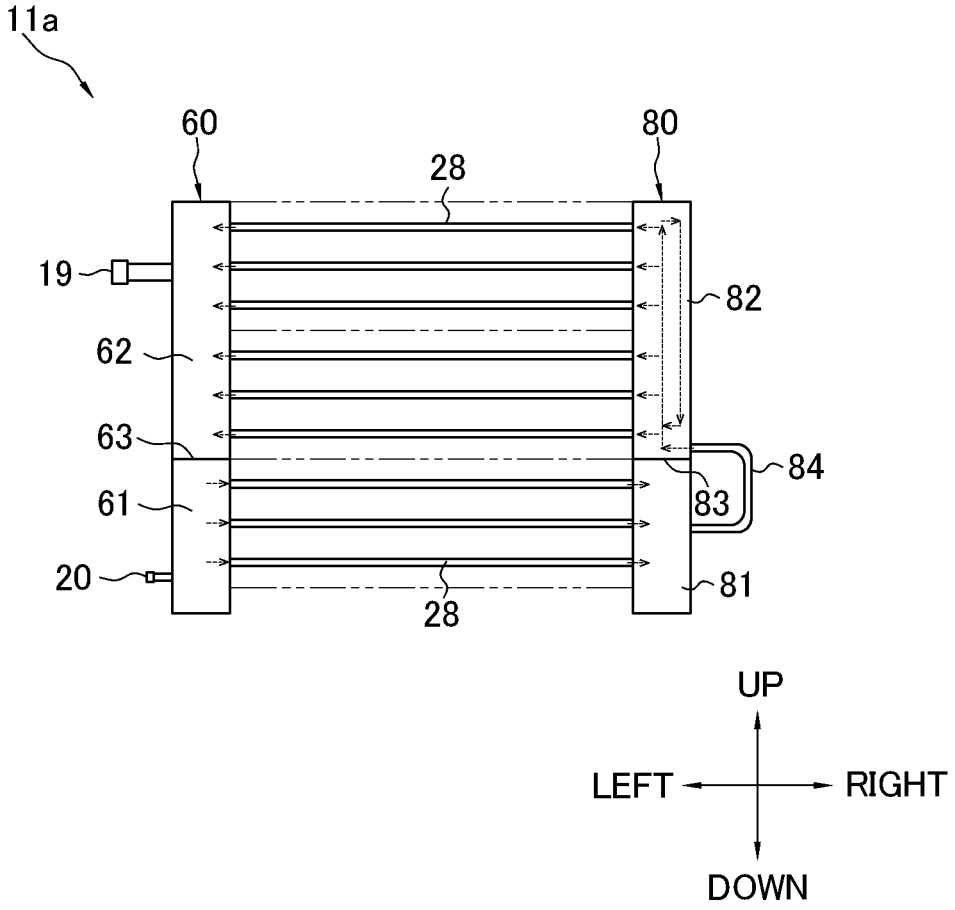
FIG. 30 is a front view of a heat exchanger according to Modification G.

Such a structure may be mounted in, for example, a heat exchanger 11*a* shown in FIG. 30.

The heat exchanger 11*a* includes an entrance/exit header 60, a turn-around header 80, and a plurality of heat transfer tubes 28 that connect these headers.

The entrance/exit header 60 includes an entrance/exit lower header 61, an entrance/exit upper header 62, and a partition plate 63 that separates the entrance/exit lower header 61 and the entrance/exit upper header 62. The entrance/exit lower header 61 has an internal space, and the liquid refrigerant pipe 20 and the plurality of heat transfer tubes 28 are connected to the entrance/exit lower header 61. The entrance/exit upper header 62 has an internal space, and the gas-refrigerant pipe 19 and the corresponding heat transfer tubes 28 are connected to the entrance/exit upper header 62.

The turn-around header 80 includes a turn-around lower header 81, a turn-around upper header 82, a partition plate 83 that separates the turn-around lower header 81 and the turn-around upper header 82 in the up-down direction, and a connection pipe 84. The turn-around lower header 81 has an internal space, and the other end of each of the corresponding heat transfer tubes 28 whose one end is connected to the entrance/exit lower header 61 is connected to the turn-around lower header 81. The turn-around upper header 82 has an internal space, and the other end of each of the corresponding heat transfer tubes 28 whose one end is connected to the entrance/exit upper header 62 is connected to the turn-around upper header 82. The connection pipe 84 connects the internal space of the turn-around lower header 81 and the internal space of the turn-around upper header 82 to each other.

In the heat exchanger 11*a*, when the heat exchanger 11*a* functions as an evaporator of a refrigerant, the refrigerant flows as indicated by dotted arrows in FIG. 30. That is, the refrigerant that has flowed into the entrance/exit lower header 61 from the liquid refrigerant pipe 20 exchanges heat with air while flowing by being divided by the plurality of heat transfer tubes 28, and then the separated portions of the refrigerant are gathered at the turn-around lower header 81 and are sent to the turn-around upper header 82 via the connection pipe 84. The refrigerant that has been sent to the turn-around upper header 82 further exchanges heat with air while flowing by being divided by the plurality of heat transfer tubes 28 connected to the turn-around upper header 82, and then the separated portions of the refrigerant are gathered at the entrance/exit upper header 62 and flow out via the gas-refrigerant pipe 19. Here, since the refrigerant that has reached the turn-around upper header 82 has already exchanged heat with air after the refrigerant has flowed into the heat exchanger 11*a*, its dryness is higher than the dryness of the refrigerant that flows into the heat exchanger 11*a*. When the heat exchanger 11*a* functions as an evaporator of the refrigerant, for example, the dryness of the refrigerant that has reached the turn-around upper header 82 is greater than or equal to 0.4 and less than or equal to 0.6. Note that when the heat exchanger 11*a* functions as a condenser of a refrigerant, the flow is in a direction opposite to that when the heat exchanger 11*a* functions as an evaporator of a refrigerant.

Figure 31:
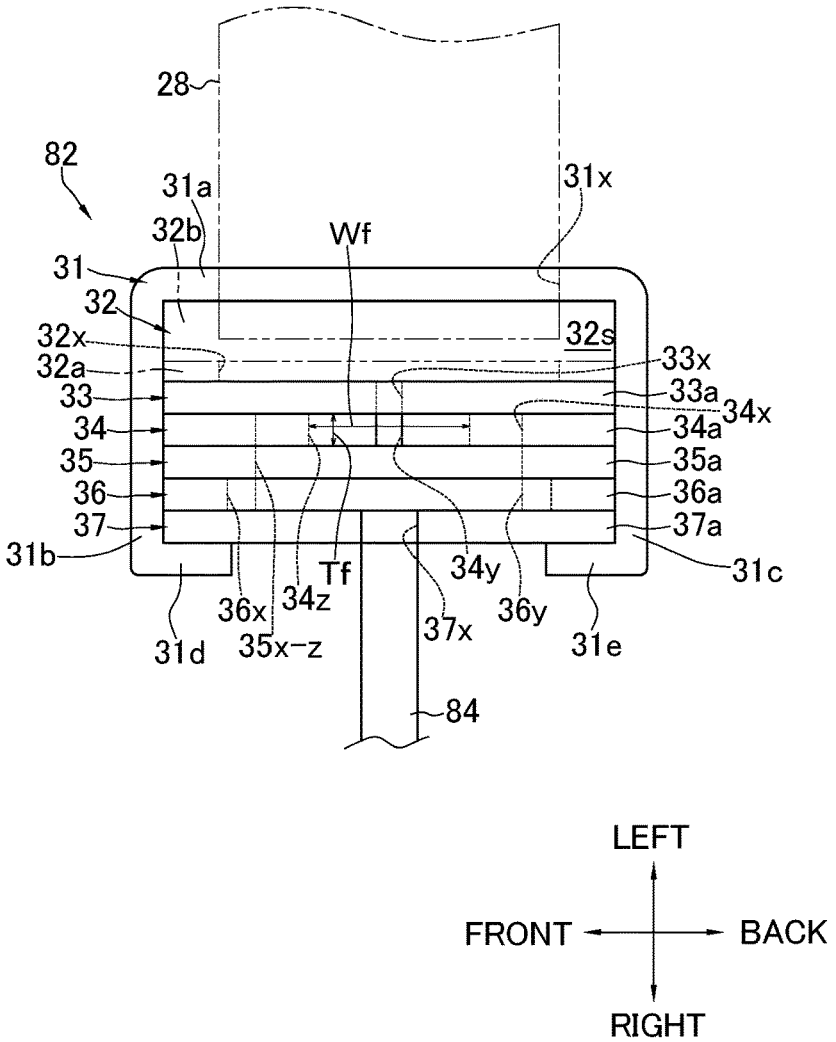
FIG. 31 is a plan sectional view showing a state of connection of connection pipes and the flat tubes with a turn-around upper header of the heat exchanger according to Modification G.

In the heat exchanger 11*a* above, as shown in FIG. 31, the turn-around upper header 82 can have a structure that is the same as that of the liquid header 30 described in the embodiments described above. Specifically, the turn-around upper header 82 has a structure that uses the connection pipe 84 instead of the branch liquid-refrigerant connection pipes 49*a* to 49*e* of the embodiments described above. Here, the turn-around upper header 82 includes a first liquid-side member 31, a second liquid-side member 32, a third liquid-side member 33, a fourth liquid-side member 34, a fifth liquid-side member 35, a sixth liquid-side member 36, and a seventh liquid-side member 37, and only their front-back direction and left-and-right direction differ and each member has the same structure, and thus they are not described.

In the turn-around upper header 82 above, when the heat exchanger 11*a* functions as an evaporator of a refrigerant, the refrigerant that has been blown via each nozzle 34*y* flows to the corresponding ascending space 34*z*. Each ascending space 34*z* satisfies the relationship Wf/Tf≤2.5, where Wf is the width in a direction (here, the front-back direction) perpendicular to both the longitudinal direction (here, the up-down direction) of the turn-around upper header 82 and the stacking direction (here the left-right direction) in which the plurality of members that constitute the turn-around upper header 82 are stacked, and where Tf is the width in the stacking direction (here, the left-right direction) in which the plurality of members that constitute the turn-around upper header 82 are stacked.

Therefore, even if the heat exchanger 11*a* is used in a state in which the flow velocity of a refrigerant that moves upward in each ascending space 34*z* is relatively high, the flow of the refrigerant can be divided by keeping small deflections between the plurality of heat transfer tubes 28. In particular, even if the dryness of the refrigerant that flows in each ascending space 34*z* is greater than or equal to 0.4 and less than or equal to 0.6, the flow of the refrigerant can be divided by keeping small deflections between the plurality of heat transfer tubes 28.

The technical significance of prescribing Wf/Tf is described below.

Differences between the capacities of the heat exchanger 11*a* when a refrigerant is caused to move upward in each ascending space 34*z* were confirmed by using samples having different Wf/Tf values while providing the structure of the turn-around upper header 82 above. Note that the capacities here may result from flow dividing performances.

Figure 32:
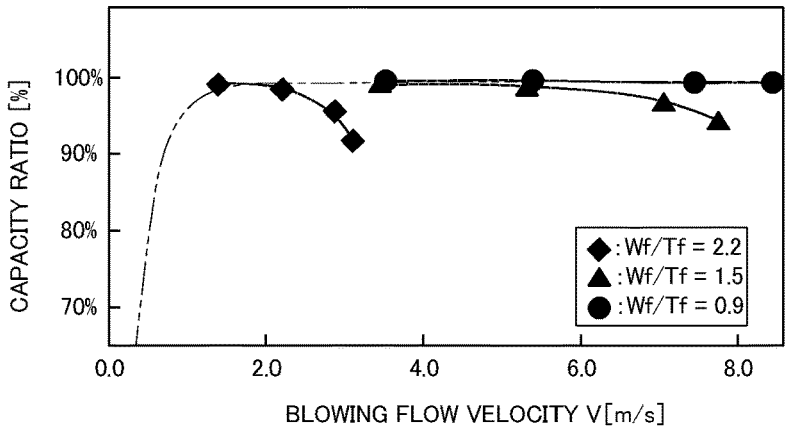
FIG. 32 is a graph showing the relationship of capacity ratio with respect to blowing flow velocity for each Wf/Tf according to one or more embodiments.

The test conditions regarding the heat exchanger 11*a* were such that the height dimension was 133.1 mm, the effective length was 1740 mm, DB/WB=7° C./6° C., refrigerant was carbon dioxide, air volume Va=0.6 to 3.2 m/s, evaporation temperature Te=−0.5° C., the dryness of refrigerant flowing into the heat exchanger 11*a* was 0.4, and the dryness of refrigerant flowing out the heat exchanger 11*a* was 0.98. Capacity ratios (capacities when a refrigerant having a dryness of 0.08 was supplied is 100%) are shown in FIG. 32 for an Wf/Tf value of 2.2, an Wf/Tf value of 1.5, and an Wf/Tf value of 0.9. Note that the alternate long and short dash line in FIG. 32 indicates the capacity (does not depend upon the Wf/Tf value) when a refrigerant having a dryness of 0.08 was supplied.

As is clear from FIG. 32, it has been confirmed that the higher the dryness of the refrigerant supplied to the heat exchanger 11*a*, the lower the capacity tended to be. It has also been confirmed that, regardless of the Wf/Tf value, the capacity ratio tended to decrease as the blowing flow velocity value increased.

Figure 33:
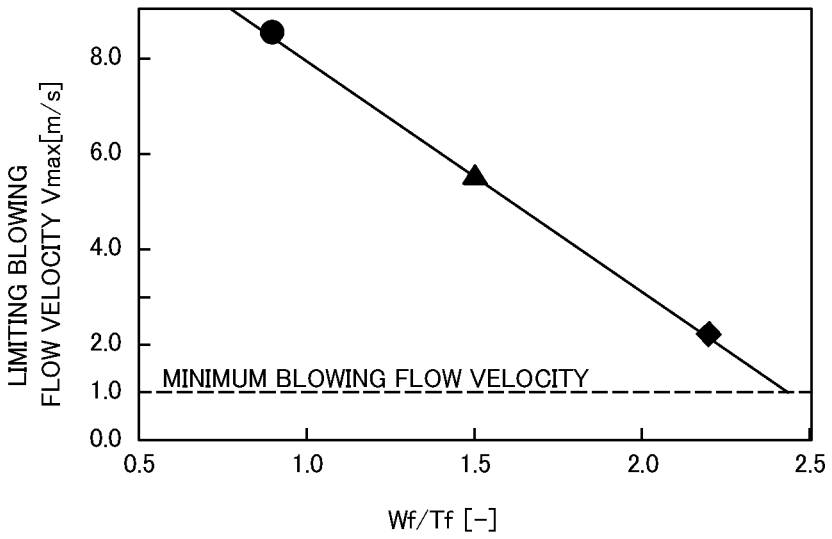
FIG. 33 is a graph showing the relationship of limiting blowing flow velocity with respect to Wf/Tf according to one or more embodiments.

Based on the above, for each Wf/Tf, a limiting blowing flow velocity Vmax, which is a limiting value that can guarantee a capacity equivalent to the capacity when a refrigerant having a dryness of 0.08 has been supplied (limiting value that can guarantee an equivalent flow dividing performance), has been determined and plotted with respect to Wf/Tf. The graph thereof is shown in FIG. 33. Note that it has been confirmed that the graph obtained from the plotting becomes the limiting blowing flow velocity Vmax≤−4.84(Wf/Tf)+12.9. Here, since the heat exchanger 11*a* is such that, when the blowing flow velocity is less than 1.0 m/s, the capacity ratio tends to decrease (see FIG. 32), a minimum blowing flow velocity Vmin of a refrigerant in each ascending space 34*z* is 1.0 m/s. Based on this, the relationship 1.0 m/s≤blowing flow velocity V≤−4.84(Wf/Tf)+12.9 is established, and, by summarizing this relationship, the relationship Wf/Tf≤2.5 is established.

According to the above, by designing each ascending space 34*z* to satisfy the relationship Wf/Tf≤2.5, even if a refrigerant having a relatively high dryness, such as a dryness of 0.4 or greater, flows at a high flow velocity, it is possible to increase the flow dividing performance with respect to each flat tube 28 in the turn-around upper header 82 and thus to increase the capacity of the heat exchanger 11*a*.

(8)

Note that it is desirable that, in the third direction, the second region include a portion that provides a minimum distance of the opening.

The shape of the second region at an edge of the first opening is not limited. For example, the second region may be formed such that edge portions of the first opening that face each other protrude toward each other, or such that the edge portions of the first opening that face each other bulge toward each other.

Note that it is desirable that the first plate-shaped portion, the second plate-shaped portion, and the third plate-shaped portion extend on a plane orthogonal to a direction of extension of the heat transfer tubes.

Note that it is desirable that, when the heat transfer tubes are flat tubes, the heat transfer tubes have a flat shape whose length in the second direction is shorter than the length in the third direction.

Note that it is desirable that the length of the second region in the third direction be larger than or equal to the thickness of the third plate-shaped portion.

Note that it is desirable that the fourth plate-shaped portion and the fifth plate-shaped portion extend on a plane orthogonal to the direction of extension of the heat transfer tubes.

Note that it is desirable that the sixth plate-shaped portion extend on a plane orthogonal to the direction of extension of the heat transfer tubes.

Here, the liquid refrigerant pipe is a pipe in which a liquid refrigerant or a refrigerant in a gas-liquid two-phase state flows, and is a pipe in which a refrigerant having a density that is higher than the density of a refrigerant that flows on a side of the heat transfer tubes opposite to a connection portion of the header flows.

Note that it is desirable that a region that is obtained by extending in the first direction in a virtual manner the connection portion between the flow path and the first region overlap the second region when viewed in a longitudinal direction of the header.

(Supplementary Note)

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1 air conditioner (heat pump device)
11 outdoor heat exchanger (heat exchanger)
11*a* heat exchanger
18 outdoor fan (fan)
22*a* to 22*e* flow dividing pipe (refrigerant pipe)
28 flat tube (heat transfer tube)
30 liquid header (header)
31 first liquid-side member (first member)
31*a* liquid-side flat-tube connection plate (first plate-shaped portion)
32 second liquid-side member
32*s* insertion space
33 third liquid-side member (sixth member)
33*a* third internal plate (sixth plate-shaped portion)
33*aa* wall portion
33*x* flow dividing opening (fifth opening)
34 fourth liquid-side member (third member)
34*a* fourth internal plate (third plate-shaped portion)
34*o* first penetration portion (first opening)
34*x* introduction space (first region)
34*y* nozzle (second region)
34*z* ascending space (third region)
35 fifth liquid-side member (fifth member)
35*a* fifth internal plate (fifth plate-shaped portion)
35*x* second connection opening (seventh opening)
35*y* return flow path (fourth opening)
35*z* outward flow path (third opening)
36 sixth liquid-side member (fourth member)
36*a* sixth internal plate (fourth plate-shaped portion)
36*x* first connection opening (sixth opening)
36*y* descending space (second opening)

37 seventh liquid-side member (second member)
37*a* liquid-side external plate (second plate-shaped portion)
37*x* external liquid-pipe connection opening
40 liquid header (header)
41 eleventh liquid-side member (first member)
41*a* liquid-side flat-tube connection plate (first plate-shaped portion)
42 twelfth liquid-side member
42*a* twelfth internal plate
42*x* twelfth opening
43 thirteenth liquid-side member
43*a* thirteenth internal plate (plate-shaped portion)
43*x* thirteenth opening (opening)
44 fourteenth liquid-side member
44*a* fourteenth internal plate (plate-shaped portion)
44*p* upper bypass opening
44*q* lower bypass opening
44*x* fourteenth ascending-side opening (opening)
44*y* fourteenth descending-side opening
45 fifteenth liquid-side member (third member)
45*a* fifteenth internal plate (third plate-shaped portion)
45*b* partition portion
45*c* connection portion
45*x* first penetration portion (first opening)
45*y* second penetration portion
46 sixteenth liquid-side member (second member)
46*a* liquid-side external plate (second plate-shaped portion)
46*x* external liquid-pipe connection opening
49*a* to 49*e* branch liquid-refrigerant connection pipe (liquid refrigerant pipe)
51 introduction space (first region)
52 nozzle (second region)
53 ascending space (third region)
80 turn-around header (header)
82 turn-around upper header (header)
130 liquid header (header)
134 eighth liquid-side member (fourth member)
134*a* eighth internal plate (fourth plate-shaped portion)
134*x* descending space (second opening)
135 ninth liquid-side member (fifth member)
135*a* ninth internal plate (fifth plate-shaped portion)
135*x* return flow path (fourth opening)
135*y* outward flow path (third opening)
136 tenth liquid-side member (third member)
136*a* tenth internal plate (third plate-shaped portion)
136*o* first penetration portion (first opening)
136*x* introduction space (first region)
136*y* nozzle (second region)
136*z* ascending space (third region)
145*x* penetration portion (first opening)
151 introduction space (first region)
152 nozzle (second region)
153 ascending space (third region)
230 liquid header (header)

The invention claimed is:

1. A heat exchanger comprising:
heat transfer tubes; and
a header that forms a refrigerant flow path,
wherein the header includes:
a first member that includes a first plate-shaped portion;
a second member that includes a second plate-shaped portion;
a third member that includes a third plate-shaped portion positioned between the first plate-shaped portion and the second plate-shaped portion in a first direction that is a direction in which the first plate-shaped portion and the second plate-shaped portion are arranged;
a fourth member that includes:
a fourth plate-shaped portion positioned between the first plate-shaped portion and the second plate-shaped portion in the first direction; and
a second opening that constitutes a part of the refrigerant flow path, where a second direction is along a longitudinal direction of the second opening; and
a fifth member that includes a fifth plate-shaped portion positioned between the third plate-shaped portion and the fourth plate-shaped portion in the first direction,
wherein the heat transfer tubes are connected to the first plate-shaped portion and are disposed along the second direction,
wherein the third plate-shaped portion has a first opening that constitutes a part of the refrigerant flow path, where the first opening:
extends in the second direction, and
includes a first region, a second region, and a third region that are arranged in this order in the second direction,
wherein a length of the second region in a third direction, the third direction being perpendicular to both of the first direction and the second direction, is:
shorter than a length of the first region in the third direction; and
shorter than a length of the third region in the third direction, and
wherein the fifth plate-shaped portion has:
a third opening that communicates with the third region and the second opening, and
a fourth opening that, at a position differing from a position of the third opening in the second direction, communicates with the third region and the second opening.

2. The heat exchanger according to claim 1, wherein the length of the second region in the third direction is larger than or equal to a length of the third plate-shaped portion in the first direction.

3. The heat exchanger according to claim 1, wherein Wf/Tf is less than or equal to 2.5, where Wf is the length of the third region in the third direction and Tf is a length of the third region in the first direction.

4. The heat exchanger according to claim 1, wherein, in the first direction, the first plate-shaped portion, the fourth plate-shaped portion, the fifth plate-shaped portion, the third plate-shaped portion, and the second plate-shaped portion are arranged in this order.

5. The heat exchanger according to claim 1, wherein the heat transfer tubes include a first heat transfer tube that guides a refrigerant to the third region and a second heat transfer tube that allows the refrigerant that has passed through the third region to flow.

6. The heat exchanger according to claim 1, further comprising:
a refrigerant pipe connected to the header,
wherein the header forms the refrigerant flow path between the refrigerant pipe and the heat transfer tubes.

7. The heat exchanger according to claim 1, wherein lengths of the first plate-shaped portion, the second plate-shaped portion, and the third plate-shaped portion in the first direction are each 3 mm or less.

8. The heat exchanger according to claim 1, further comprising:

a liquid refrigerant pipe connected to the header, wherein the header is connected to the first region and includes a flow path that extends in the header from the liquid refrigerant pipe, and wherein, when viewed from the first direction, a connection portion between the first region and the flow path, the second region, and the third region are arranged in the second direction.

9. The heat exchanger according to claim 1, wherein the second direction is a vertical direction of the heat exchanger.

10. The heat exchanger according to claim 9, wherein the first region, the second region, and the third region are arranged in this order from a bottom of the heat exchanger, and wherein a length of the third region in the vertical direction is longer than a length of the first region in the vertical direction.

11. A heat pump device comprising:

the heat exchanger according to claim 1.

12. The heat pump device according to claim 11, further comprising:

a fan that produces an air flow that passes through the heat exchanger, wherein the header includes a plate-shaped portion that is positioned between an end portion of each of the heat transfer tubes and the third plate-shaped portion, and has openings, and wherein the openings are disposed closer to a windward end portion of the plate-shaped portion than a leeward end portion of the plate-shaped portion in an air flow direction.

13. The heat exchanger according to claim 1, wherein, in the first direction, the first plate-shaped portion, the third plate-shaped portion, the fifth plate-shaped portion, the fourth plate-shaped portion, and the second plate-shaped portion are arranged in this order.

14. The heat exchanger according to claim 13, further comprising:

a liquid refrigerant pipe connected to the second plate-shaped portion, wherein the fourth plate-shaped portion further has a sixth opening, wherein the fifth plate-shaped portion further has a seventh opening, and wherein a connection portion between the second plate-shaped portion and the liquid refrigerant pipe communicates with the first region via the sixth opening and the seventh opening.

15. The heat exchanger according to claim 13, further comprising:

a sixth member that includes a sixth plate-shaped portion positioned between the first plate-shaped portion and the third plate-shaped portion in the first direction, wherein the sixth plate-shaped portion has fifth openings that are arranged in the second direction to correspond with the heat transfer tubes.

16. The heat exchanger according to claim 15, wherein, when viewed in the first direction, the first region and the fifth openings do not overlap each other, and wherein the sixth member includes a wall portion that covers the first region in an entirety thereof from a side of connection positions of the heat transfer tubes.

17. The heat exchanger according to claim 15, wherein, when viewed from the first direction, the fifth openings are positioned within a range of a region obtained by extending in a virtual manner the second region in the second direction.

18. A heat exchanger comprising:

heat transfer tubes; and a header that forms a refrigerant flow path, wherein the header includes:

a first member that includes a first plate-shaped portion;

a second member that includes a second plate-shaped portion; and a third member that includes a third plate-shaped portion positioned between the first plate-shaped portion and the second plate-shaped portion in a first direction that is a direction in which the first plate-shaped portion and the second plate-shaped portion are arranged, wherein the heat transfer tubes are connected to the first plate-shaped portion, wherein the third plate-shaped portion has a first opening that constitutes a part of the refrigerant flow path, where the first opening:

extends in a second direction that is a direction in which the heat transfer tubes are arranged, and includes a first region, a second region, and a third region that are arranged in this order in the second direction, wherein a length of the second region in a third direction, the third direction being perpendicular to both of the first direction and the second direction, is:

shorter than a length of the first region in the third direction; and shorter than a length of the third region in the third direction, wherein the second direction is a vertical direction of the heat exchanger, and wherein the first region, the second region, and the third region are arranged in this order from a bottom of the heat exchanger, and wherein a length of the third region in the vertical direction is longer than a length of the first region in the vertical direction.

19. A heat pump device comprising:

a heat exchanger; and a fan that produces an air flow that passes through the heat exchanger, wherein the heat exchanger includes:

heat transfer tubes; and a header that forms a refrigerant flow path, wherein the header includes a first member that includes a first plate-shaped portion, a second member that includes a second plate-shaped portion, and a third member that includes a third plate-shaped portion positioned between the first plate-shaped portion and the second plate-shaped portion in a first direction that is a direction in which the first plate-shaped portion and the second plate-shaped portion are arranged, wherein the heat transfer tubes are connected to the first plate-shaped portion, wherein the third plate-shaped portion has a first opening that constitutes a part of the refrigerant flow path, where the first opening:

extends in a second direction that is a direction in which the heat transfer tubes are arranged, and includes a first region, a second region, and a third region that are arranged in this order in the second direction, wherein a length of the second region in a third direction, the third direction being perpendicular to both of the first direction and the second direction, is:

shorter than a length of the first region in the third direction; and shorter than a length of the third region in the third direction, wherein the header includes a plate-shaped portion that is positioned between an end portion of each of the heat transfer tubes and the third plate-shaped portion, and that has openings, and wherein the openings are disposed closer to a windward end portion of the plate-shaped portion than a leeward end portion of the plate-shaped portion in an air flow direction.

* * * * *